US005567578A

United States Patent [19]

Makuta et al.

[11] Patent Number: 5,567,578

[45] Date of Patent: Oct. 22, 1996

[54] SILVER HALIDE COLOR PHOTOGRAPHIC MATERIAL

[75] Inventors: Toshiyuki Makuta; Nobuo Seto; Yasuhiro Yoshioka, all of Kanagawa, Japan

[73] Assignee: Fuji Photo Film Co., Ltd., Kanagawa, Japan

[21] Appl. No.: 345,745

[22] Filed: Nov. 22, 1994

[30] Foreign Application Priority Data

Nov. 24, 1993 [JP] Japan ..... 5-315782

[51] Int. Cl.[6] ..... G03C 7/36; G03C 7/392

[52] U.S. Cl. ..... 430/551; 430/556; 430/557

[58] Field of Search ..... 430/551, 556, 430/557

[56] References Cited

U.S. PATENT DOCUMENTS

| | | | |
|---|---|---|---|
| 4,174,220 | 11/1979 | Taguchi et al. | 430/613 |
| 5,118,599 | 6/1992 | Lau et al. | 430/557 |
| 5,213,958 | 5/1993 | Motoki et al. | 430/557 |
| 5,238,803 | 8/1993 | Ichijima et al. | 430/557 |
| 5,283,166 | 2/1994 | Kobayashi et al. | 430/557 |
| 5,294,527 | 3/1994 | Deguchi | 430/551 |
| 5,294,530 | 3/1994 | Seto et al. | 430/551 |
| 5,382,506 | 1/1995 | Tosaka et al. | 430/557 |
| 5,427,902 | 6/1995 | Shimura et al. | 430/557 |
| 5,459,023 | 10/1995 | Yamada et al. | 430/551 |

FOREIGN PATENT DOCUMENTS

| | | | |
|---|---|---|---|
| 0298321 | 1/1989 | European Pat. Off. | 430/551 |
| 0447969 | 9/1991 | European Pat. Off. . | |
| 0482552 | 4/1992 | European Pat. Off. . | |
| 0508398 | 10/1992 | European Pat. Off. . | |
| 0222853 | 11/1985 | Japan . | |
| 0247240 | 12/1985 | Japan | 430/551 |

*Primary Examiner*—Richard L. Schilling
*Attorney, Agent, or Firm*—Sughrue, Mion, Zinn, Macpeak & Seas

[57] ABSTRACT

Provided is a silver halide color photographic material containing at least one particular acylamide-type yellow coupler in at least one light-sensitive layer therein along with a particular bisphenolic image stabilizer and a particular spirocyclic or bicyclic image stabilizer. The material has excellent coloring properties and excellent color reproducibility and forms thereon color images having high fastness to light all from the high-density areas to the low-density areas.

15 Claims, No Drawings

SILVER HALIDE COLOR PHOTOGRAPHIC MATERIAL

FIELD OF THE INVENTION

The present invention relates to a silver halide color photographic material and, more precisely, to a silver halide color photographic material which has excellent coloring properties and excellent color reproducibility and which forms color images having high stability in storage.

BACKGROUND OF THE INVENTION

Silver halide color photographic material are characterized in that they may form high-quality images and are economically advantageous. They are most popularly used to reproduce color images. In order to further improve the characteristics of such silver halide color photographic materials, various studies have been and are being made to obtain more improved high-quality color images. To improve the image quality of color images to be formed on color printing materials, it is required that the color reproduction of the color prints obtained after development is good, that the color images formed are sharp and are not blurred (that is, the sharpness of the color images formed is high) and that the fine dye grains constituting the color images formed are negligible with the naked eye (that is, the graininess of the color images formed is fine). In addition, it is also desired that the color images formed are fast to light, heat and moisture and are therefore not faded for a long period of time. In particular, the color fastness is an important factor to photographic color images. Recently, noticeable improvements have been made in the color fastness of photographic color images and storage of color prints for a long period of time has become possible.

The most popular method for producing color images on silver halide color photographic materials is such that couplers in the material are reacted with an oxidized, aromatic primary amine-type color developer to form indophenols, indanilines, indamines, azomethines, phenoxazines, phenazines and the like dyes. According to the method, color images are reproduced by a subtractive color process. According to this, in general, color images are formed by varying the amounts of three dyes of yellow, magenta and cyan to be formed.

As yellow couplers of such couplers, pivaloyl yellow couplers and benzoyl yellow couplers have heretofore been used most popularly. However, the former have a drawback that their coloring properties are poor, though the color images formed from them are fast. Therefore, their use is limitative in that they could not fully satisfy the essential requirements in these days requiring rapid processing of photographic materials while reducing the amount of replenishers to the processing solutions. In addition, the former are not on a sufficiently satisfactory level with respect to the color hue of the color images to be formed therefrom. On the other hand, the latter have serious drawbacks in that the color hue of the color images to be formed from them is much poorer than that from the former; though their coloring properties are good, and that the fastness of the color images formed from them is extremely low. For couplers for color prints, the color hue and the fastness of the dyes to be formed therefrom are considered important. In general, therefore, pivaloyl yellow couplers are used for color prints. However, pivaloyl yellow couplers are not still on a sufficiently satisfactory level with respect to the color hue of the dyes to be formed therefrom. Therefore, further improvements in them are desired.

Considering the current situation, pivaloylacetanilide couplers having an alkoxy group at the ortho-position of the anilido ring have been specifically noticed so as to further improve the color reproducibility in color prints. Such couplers have been surely improved with respect to their color reproducibility in some degree but still have problems in point of the fastness of the color images formed therefrom.

The problem common to pivaloyl couplers is that the fastness of the color images to be formed therefrom is not sufficient under high-humidity conditions. In addition, pivaloyl couplers are problematic in point of the fastness to light under high-humidity conditions. Since color prints are stored under varying conditions of light, heat and humidity, it is difficult to practically assess their fastness. Therefore, it is necessary to test color prints under various conditions.

Recently, to improve the color reproducibility and the coloring properties of couplers to form color images, for example, there have been proposed acylacetamide-type yellow couplers having 3-membered to 5-membered cyclic structures in European Patent EP 0,447,969A1, cyclic-structured malondianilide-type yellow couplers in EP 0,482,552A1, and dioxane-structured acylacetanilide-type yellow couplers in U.S. Pat. No. 5,118,599.

On the other hand, as compounds which may improve the storability of yellow color images, known are phenolic compounds with steric hindrance described in JP-A 60-222853 (the therm "JP-A" as used herein means an "unexamined published Japanese patent application"), polyalkylpiperidine compounds described in JP-A 59-11935, and compounds described in JP-A 2-300748. Combining these compounds and yellow couplers, the fastness to light of the color images formed may surely be improved. However, it has been found that such compounds worsen the coloring properties of the couplers combined with them.

Recently, bisphenols have been reported in EP 0,508,398A1 and phenol derivatives in JP-A 5-19427. Using these compounds together with couplers, the fastness to light of the color images formed can be improved in some degree only in their high density areas. In addition, the coloring properties of the couplers combined with these compounds are not worsened so much. However, even though these compounds are combined with couplers, the fastness to light of the color images formed cannot be improved on a satisfactory level in their low density areas.

SUMMARY OF THE INVENTION

The present invention has been made under the above-mentioned situation. Therefore, the object of the present invention is to provide a silver halide color photographic material which has excellent coloring properties and excellent color reproducibility and which may form color images having high fastness to light all from the high-density areas to the low-density areas.

The object of the present invention has been attained by a silver halide color photographic material mentioned below and a method for forming color images on the material.

Specifically, the present invention provides a silver halide color photographic material having at least one or more light-sensitive silver halide emulsion layers on a support, in which at least one of said light-sensitive layers contains at least one yellow coupler of the following formulae (I), (II) and (III), at least one compound of the following formula (IV) and at least one compound of the following formula (V):

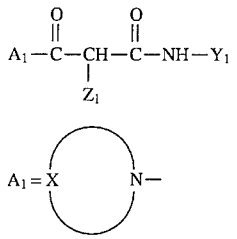

(I)

wherein

X represents an organic residue necessary for forming a nitrogen-containing hereto ring together with the nitrogen atom in the formula;

$Y_1$ represents an aromatic group or a heterocyclic group;

$Z_1$ represents a group splitting off from the coupler of the formula by coupling reaction with an oxidation product of an aromatic primary amine developing agent.

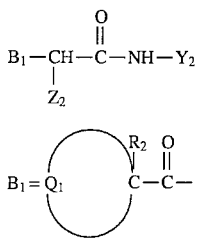

(II)

wherein $R_2$ represents a monovalent group except a hydrogen atom;

$Q_1$ represents a non-metallic atomic group necessary for forming, together with the carbon atom in the formula, a 3-membered to 5-membered hydrocarbon ring or a 3-membered to 6-membered hereto ring having therein at least one hereto atom selected from N, O, S and P; provided that $R_2$ may be bonded to $Q_1$ to form a bi-cyclic ring or a higher poly-cyclic ring;

$Z_2$ represents a hydrogen atom, or a group splitting off from the coupler of the formula by coupling reaction with an oxidation product of an aromatic primary amine developing agent;

$Y_2$ has the same meaning as $Y_1$ in formula (I).

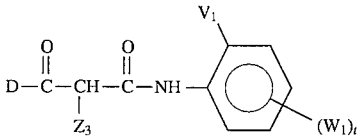

(III)

wherein

D represents a tertiary alkyl group;

$V_1$ represents a fluorine atom, an alkoxy group, an aryloxy group, a dialkylamino group, an alkylthio group, an arylthio group, or an alkyl group;

$Z_3$ has the same meaning as $Z_1$ in formula (I);

$W_1$ represents a group substitutable on the benzene ring in the formula;

t represents an integer of from 0 to 4, and when t is 2 or more, then the plural $W_1$'s may be the same or different.

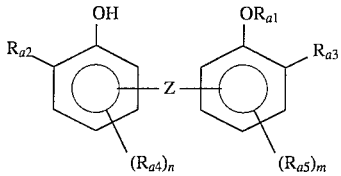

(IV)

wherein $R_{a1}$ represents a hydrogen atom, an aliphatic group, an aromatic carbonyl group, a saturated aliphatic carbonyl group, or a sulfonyl group;

$R_{a2}$ and $R_{a3}$ may be the same or different and each represents a hydrogen atom, an aliphatic group, an aliphatic-oxy group, an acylamino group, an aliphatic-oxycarbonyl group, or a carbamoyl group;

$R_{a4}$ and $R_{a5}$ may be the same or different and each represents an aliphatic group or an acylamino group;

Z represents a chemical bond or a divalent linking group;

n and m each represent 0, 1 or 2, and when n or m is 2, then the plural $R_{a4}$'s or $R_{a5}$'s may be the same or different.

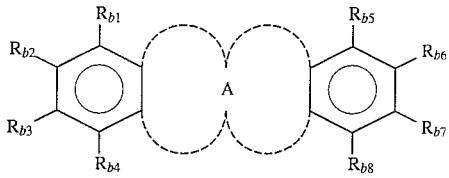

(V)

wherein $R_{b1}$, $R_{b2}$, $R_{b3}$, $R_{b4}$, $R_{b5}$, $R_{b6}$, $R_{b7}$ and $R_{b8}$ may be the same or different and each represents a hydrogen atom, an aliphatic group, an acyl group, an acylamino group, an aliphatic-oxycarbonyl group, an aryloxycarbonyl group, a halogen atom, a sulfonyl group, a carbamoyl group, a sulfamoyl group, or $—X_b—R_{b9}$;

A represents a non-metallic atomic group necessary for forming a spiro ring or a bicyclic ring;

$X_b$ represents —O—, —S— or $—N(R_{b10})—$;

$R_{b9}$ and $R_{b10}$ may be the same or different and each represents an aliphatic group;

ortho-positioned two groups of $R_{b1}$ to $R_{b8}$ may be bonded to each other to form a 5-membered to 8-membered ring;

$R_{b9}$ and $R_{b10}$ may be bonded each other to form a 5-membered to 7-membered ring;

provided that at least one of $R_{b1}$ to $R_{b4}$ and at least one of $R_{b5}$ to $R_{b8}$ are the same or different $—X_b—R_{b9}$.

As one preferred embodiment of the silver halide color photographic material of the present invention mentioned above, the yellow coupler-containing light-sensitive layer in the material contains a water-insoluble homopolymer or copolymer or at least one compound of the following general formula (VI):

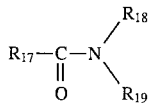

(VI)

wherein $R_{17}$, $R_{18}$ and $R_{19}$ each independently represent an alkyl group or an aryl group; and when $R_{18}$ and $R_{19}$ are both alkyl groups, they may be bonded to each other to form a 5-membered to 7-membered ring; and either one of $R_{18}$ and $R_{19}$ may be a hydrogen atom.

Being characterized by the above-mentioned constitution, the silver halide color photographic material of the present invention has excellent coloring properties and excellent color reproducibility and may form thereon color images having high fastness to light all from the high-density areas to the low-density areas.

The yellow couplers to be in the photographic material of the present invention have excellent coloring properties and excellent color reproducibility but have poor fastness to light by themselves. In order to improve the fastness to light of the dyes to be formed from these couplers, at least one compound of formula (IV), by which the fastness to light in the high-density areas is essentially improved (and, additionally, the fastness to light in the low-density areas is improved in some degree), and at least one compound of formula (V), by which the fastness to light from the high-density areas to the low-density areas is improved only a little, are added to the yellow coupler-containing light-sensitive layer, with the result that the fastness to light of the dyes formed from the couplers is unexpectedly improved all from the high-density areas to the low-density areas. It is considered that the unexpected effect will result from the synergistic effect of the combination of the compounds of formula (IV) and those of formula (V).

In addition, the fastness to light in the high-density areas is more improved when a water-insoluble polymer or a compound of formula (VI) is added to the yellow coupler-containing light-sensitive layer.

DETAILED DESCRIPTION OF THE INVENTION

Yellow couplers of formula (I) for use in the present invention are mentioned in detail hereunder.

The nitrogen-containing hetero ring represented by $A_1$ may be any of saturated or unsaturated, mono-cyclic or condensed cyclic, substituted or unsubstituted rings each having 1 or more, preferably from 1 to 20, more preferably from 2 to 12 carbon atoms. In addition to the nitrogen atom, the ring may contain therein one or more hetero atoms such as oxygen, sulfur and phosphorus atoms. The number of the atoms constituting the ring may be 3 or more, preferably from 3 to 12, more preferably from 5 to 6.

Examples of the nitrogen-containing heterocyclic group represented by $A_1$ include a pyrrolidino group, a piperidino group, a morpholino group, a 1-imidazolidinyl group, a 1-pyrazolyl group, a 1-piperazinyl group, a 1-indolinyl group, a 1,2,3,4-tetrahydroquinoxalin-1-yl group, a 1-pyrrolinyl group, a pyrazolidin-1-yl group, a 2,3-dihydro-1-indazolyl group, an isoindolin-2-yl group, a 1-indolyl group, a 1-pyrrolyl group, a benzothiazin-4-yl group, a 4-thiazinyl group, a benzodiazin-1-yl group, an aziridin-1-yl group, a benzoxazin-4-yl group, a 2,3,4,5-tetrahydroquinolyl group, a phenoxazin-10-yl group, etc.

When $Y_1$ in formula (I) is an aromatic group, it may be a substituted or an unsubstituted aromatic group having 6 or more, preferably from 6 to 10 carbon atoms. Especially preferably, it is a phenyl or naphthyl group.

When $Y_1$ in formula (I) is a heterocyclic group, it may be a saturated or unsaturated, substituted or unsubstituted heterocyclic group having 1 or more, preferably from 1 to 10, more preferably from 2 to 5 carbon atoms. Preferred examples of the hetero atom to be in the group are nitrogen, sulfur and oxygen atoms. The number of the atoms constituting the hereto ring of the group may be 5 or 6, which, however, is not limitative. The group may be of either a mono-cyclic ring or a condensed ring. Examples of the heterocyclic group of $Y_1$ include a 2-pyridyl group, a 4-pyrimidinyl group, a 5-pyrazolyl group, an 8-quinolyl group, a 2-furyl group, a 2-pyrrolyl group, etc.

When the group of $A_1$ and the group of $Y_1$ in formula (I) each have substituent(s), examples of the substituent include a halogen atom (e.g., fluorine, chlorine), an alkoxycarbonyl group (having from 2 to 30, preferably from 2 to 20 carbon atoms, e.g., methoxycarbonyl, dodecyloxycarbonyl, hexadecyloxycarbonyl), an acylamino group (having from 2 to 30, preferably from 2 to 20 carbon atoms, e.g., acetamido, tetradecanamido, 2-(2,4-di-t-amylphenoxy)butanamido, benzamido), a sulfonamido group (having from 1 to 30, preferably from 1 to 20 carbon atoms, e.g., methanesulfonamido, dodecansulfonamido, hexadecansulfonamido, benzenesulfonamido), a carbamoyl group (having from 2 to 30, preferably from 2 to 20 carbon atoms, e.g., N-butylcarbamoyl, N,N-diethylcarbamoyl), a sulfamoyl group (having from 1 to 30, preferably from 1 to 20 carbon atoms, e.g., N-butylsulfamoyl, N,N-diethylsulfamoyl, N-dodecylsulfamoyl, N-hexadecylsulfamoyl, N-3-(2,4-di-t-amylphenoxy-)butylsulfamoyl), an alkoxy group (having from 1 to 30, preferably from 1 to 20 carbon atoms, e.g., methoxy, dodecyloxy), an N-acylsulfamoyl group (having from 2 to 30, preferably from 2 to 20 carbon atoms, e.g., N-propanoylsulfamoyl, N-tetradecanoylsulfamoyl), a sulfonyl group (having from 1 to 30, preferably from 1 to 20 carbon atoms, e.g., methanesulfonyl, octanesulfonyl, dodecanesulfonyl), an alkoxycarbonylamino group (having from 1 to 30, preferably from 1 to 20 carbon atoms, e.g., methoxycarbonylamino, tetradecyloxycarbonylamino), a cyano group, a nitro group, a carboxyl group, an aryloxy group (having from 6 to 20, preferably from 6 to 10 carbon atoms, e.g., phenoxy, 4-chlorophenoxy), an alkylthio group (having from 1 to 30, preferably from 1 to 20 carbon atoms, e.g., methylthio, dodecylthio), an ureido group (having from 1 to 30, preferably from 1 to 20 carbon atoms, e.g., phenylureido), an aryl group (having the same meaning as the aromatic group of $Y_1$ mentioned above), a heterocyclic group (having the same meaning as the heterocyclic group of $Y_1$ mentioned above), a sulfo group, an alkyl group (linear, branched or cyclic, saturated or unsaturated, substituted or unsubstituted, having from 1 to 30, preferably from 1 to 20 carbon atoms, e.g., methyl, ethyl, isopropyl, cyclopropyl, trifluoromethyl, cyclopentyl, dodecyl, 2-hexyloctyl), an acyl group (having from 1 to 30, preferably from 2 to 20 carbon atoms, e.g., acetyl, benzoyl), an arylthio group (having from 6 to 20, preferably from 6 to 10 carbon atoms, e.g., phenylthio), a sulfamoylamino group (having from 0 to 30, preferably from 0 to 20 carbon atoms, e.g., N-butylsulfamoylamino, N-dodecylsulfamoylamino), an N-acylcarbamoyl group (having from 2 to 30, preferably from 2 to 20 carbon atoms, e.g., N-dodecanoylcarbamoyl), an N-sulfonylcarbamoyl group (having from 1 to 30, preferably from 2 to 20 carbon atoms, e.g., N-hexadecansulfonylcarbamoyl, N-benzenesulfonylcarbamoyl, N-(2-octyloxy-5-t-octylbenzenesulfonyl)carbamoyl), an N-sulfamoylcarbamoyl group (having from 1 to 30, preferably front 1 to 20 carbon atoms, e.g., N-(ethylsulfamoyl)carbamoyl, N-{3-(2,4-di-t-amylphenoxy)propylsulfamoyl}carbamoyl), an N-sulfonylsulfamoyl group (having from 0 to 30, preferably from 1 to 20 carbon atoms, e.g., N-dodecanesulfonylsulfamoyl, N-benzenesulfonylsulfamoyl), an N-carbamoylsulfamoyl group (having from 1 to 30, preferably from 1 to 20 carbon atoms, e.g., N-(ethylcarbamoyl)sulfamoyl, N-{3-(2,4-di-t-amylphenoxy)propylcarbamoyl}sulfamoyl), an N-(N-sulfonylcarbamoyl)sulfamoyl group (having from 1 to 30, preferably from 1 to 20 carbon atoms, e.g., N-(dodecanesulfonylcarbamoyl)sulfamoyl, N-(2-octyloxy- 5-t-octylbenzenesulfonylcarbamoyl)sulfamoyl), a 3-sulfonylureido group (having from 1 to 30, preferably from 1 to 20 carbon atoms, e.g., 3-hexadecanesulfonylureido, 3-benzenesulfonylureido), a 3-acylureido group (having from 2 to 30, preferably from 2 to 20 carbon atoms, e.g., 3-acetylureido, 3-benzoylureido), a 3-acylsulfamido group (having from 1 to 30, preferably from 1 to 20 carbon atoms, e.g., 3-propionylsulfamido, 3-(2,4-dichlorobenzoyl)sulfamido), a 3-sulfonylsulfamido group (having from 0 to 30, preferably from 1 to 20 carbon atoms, e.g., 3-methanesulfonylsulfamido, 3-(2-methoxyethoxy-5-t-octylbenzenesulfonyl)sulfamido), a hydroxyl group, an acyloxy group (having from 1 to 30, preferably from 1 to 20 carbon atoms, e.g., propanoyloxy, tetradecanoyloxy), a sulfonyloxy group (having from 0 to 30, preferably from 0 to 20 carbon atoms, e.g., dodecanesulfonyloxy, 2-octyloxy-5-t-octylbenzenesulfonyloxy), an aryloxycarbonyl group (having from 7 to 20, preferably from 7 to 10 carbon atoms, e.g., phenoxycarbonyl), etc.

When the group of $A_1$ has substituent(s), preferred examples of the substituent are selected from the substituents mentioned above, including a halogen atom, an alkoxy group, an acylamino group, a carbamoyl group, an alkyl group, a sulfonamido group and a nitro group. Also preferred is an unsubstituted group of $A_1$.

When the group of $Y_1$ has substituent(s), preferred examples of the substituent are a halogen atom, an alkoxycarbonyl group, a sulfamoyl group, a carbamoyl group, a sulfonyl group, a sulfonamido group, an acylamino group, an alkoxy group, an aryloxy group, an N-acylcarbamoyl group, an N-sulfonylcarbamoyl group, an N-sulfamoylcarbamoyl group, an N-sulfonylsulfamoyl group, an N-acylsulfamoyl group, an N-carbamoylsulfamoyl group, and an N-(N-sulfonylcarbamoyl)sulfamoyl group.

The group of $Z_1$ in formula (I) may be any of known coupling split-off groups. As preferred examples of the group of $Z_1$, mentioned are a nitrogen-containing heterocyclic group which is bonded to the coupling position in the formula via its nitrogen atom, an aromatic-oxy group, an aromatic-thio group, a heterocyclic-oxy group, a heterocyclic-thio group, an acyloxy group, a carbamoyloxy group, an alkylthio group, and a halogen atom. These split-off groups may be any of photographically-useful groups or their precursors (e.g., development inhibitors, development accelerators, desilvering accelerators, foggants, dyes, hardening agents, couplers, scavengers for oxidized products of developing agents, fluorescent dyes, developing agents, electron transferring agents) or non-photographically-useful groups.

When $Z_1$ is a nitrogen-containing heterocyclic group, it is precisely a mono-cyclic or condensed cyclic, substituted or unsubstituted heterocyclic group. As examples of the group, mentioned are a succinimido group, a maleimido group, a phthalimido group, a diglycolimido group, a pyrrolino group, a pyrazolyl group, an imidazolyl group, a 1,2,4-triazol-1-yl (or 4-yl) group, a 1-tetrazolyl group, an indolyl group, a benzopyrazolyl group, a benzimidazolyl group, a benzotriazolyl group, an imidazolidine-2,4-dion-3-yl (or 1-yl) group, an oxazolidine-2,4-dion-3-yl group, a thiazolidine-2,4-dion-3-yl group, an imidazolin-2-on-1-yl group, an oxazolin-2-on-3-yl group, a thiazolin-2-on-3-yl group, a benzoxazolin-2-on-3-yl group, a 1,2,4-triazolidine-3,5-dion-4-yl group, a 2-pyridon-1-yl group, a morpholine-3,5-dion-4-yl group, a 1,2,3-triazol-1-yl group, and a 2-imidazolin-5-one group.

When these heterocyclic groups have substituent(s), examples of the substituent are those for the group $A_1$ mentioned above.

When $Z_1$ is a nitrogen-containing heterocyclic group, it is preferably a 1-pyrazolyl group, an imidazolyl group, a 1,2,3-triazol-1-yl group, a benzotriazolyl group, a 1,2,4-triazol-1-yl group, an oxazolidine-2,4-dion-3-yl group, a 1,2,4-triazolidine-3,5-dion-4-yl group or an imidazolidine-2,4-dion-3-yl group. These groups may have substituent(s).

When $Z_1$ is an aromatic-oxy group, it is preferably a substituted or unsubstituted phenoxy group. When the group has substituent(s), examples of the substituent are those for the group $Y_1$ mentioned above. When $Z_1$ is a substituted phenoxy group, at least one substituent for the group is preferably an electron-attracting group, such as a sulfonyl group, an alkoxycarbonyl group, a sulfamoyl group, a halogen atom, a carboxyl group, a carbamoyl group, an acyl group or a nitro group.

When $Z_1$ is an aromatic-thio group, it is preferably a substituted or unsubstituted phenylthio group. When the group has substituent(s), examples of the substituent are those for the group $Y_1$ mentioned above. When $Z_1$ is a substituted phenylthio group, at least one substituent for the group is preferably an alkyl group, an alkoxy group, a sulfonyl group, an alkoxycarbonyl group, a sulfamoyl group, a halogen atom, a carbamoyl group or a nitro group.

When $Z_1$ is a heterocyclic-oxy group, the heterocyclic moiety in the group may have the same meaning as the heterocyclic group of $Y_1$ mentioned above.

When $Z_1$ is a heterocyclic-thio group, it is preferably a 5-membered or 6-membered, unsaturated heterocyclic-thio group. It includes, for example, a tetrazolylthio group, a 1,3,4-thiadiazolylthio group, a 1,3,4-oxadiazolylthio group, a 1,3,4-triazolylthio group, a benzimidazolylthio group, a benzothiazolylthio group and a 2-pyridylthio group. The heterocyclic-thio group of $Z_1$ may be substituted. As examples of the substituent for the group, mentioned are those for the heterocyclic group of $Y_1$ mentioned above. Of those mentioned above, especially preferred substituents for the heterocyclic-thio group of $Z_1$ are an aromatic group, an alkyl group, an alkylthio group, an acylamino group, an alkoxycarbonyl group and an aryloxycarbonyl group.

When $Z_1$ is an acyloxy group, it is precisely an aromatic acyloxy group (having from 7 to 11 carbon atoms, e.g., benzoyloxy), or an aliphatic acyloxy group (having from 2 to 20, preferably from 2 to 10 carbon atoms). The acyloxy group may optionally be substituted. As examples of the substituent for the group, mentioned are those for the aromatic group of $Y_1$ mentioned above. Preferably, at least one substituent for the substituted acyloxy group is a halogen atom, a nitro group, an aryl group, an alkyl group or an alkoxy group.

When $Z_1$ is a carbamoyloxy group, it may be an aliphatic, aromatic or heterocyclic, substituted or unsubstituted carbamoyloxy group having from 1 to 30, preferably from 1 to 20 carbon atoms. For instance, mentioned are an N,N-diethylcarbamoyloxy group, an N-phenylcarbamoylmorpholinocarbonyloxy group, a 1-imidazolylcarbonyloxy group, and an N,N-dimethylcarbamoyloxy group. The alkyl, aromatic and heterocyclic groups referred to herein have the same meanings as those referred to for the group $Y_1$ mentioned above.

When $Z_1$ is an alkylthio group, it may have from 1 to 30, preferably from 1 to 20 carbon atoms. The alkyl moiety in the group has the same meaning as that referred to for the group $Y_1$ mentioned above.

In formula (I), $Z_1$ is preferably a 5-membered or 6-membered, nitrogen-containing heterocyclic group (which is bonded to the coupling position in the formula via its nitrogen atom), an aromatic-oxy group, a 5-membered or 6-membered heterocyclic-oxy group, or a 5-membered or 6-membered heterocyclic-thio group.

In formula (I), $Y_1$ is preferably an aromatic group, especially preferably a phenyl group having at least one substituent at the ortho position. Examples of the substituent for the phenyl group are the same as those for the aromatic group of $Y_1$ mentioned above.

Where $Y_1$ in formula (I) is a phenyl group having at least one substituent at the ortho position, the ortho-positioned substituent is especially preferably a halogen atom, an alkoxy group, an alkyl group or an aryloxy group.

Of yellow couplers of formula (I), especially preferred are those of the following general formula (I-A):

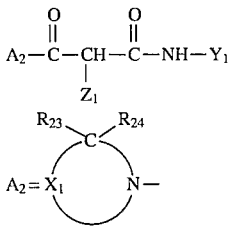

(I-A)

wherein $Y_1$ and $Z_1$ have the same meanings as those in formula (I);

$X_1$ represents an organic residue necessary for forming a nitrogen-containing hetero ring along with $>C(R_{23})(R_{24})$ and >N— in the formula;

$R_{23}$ and $R_{24}$ each represent a hydrogen atom or a substituent. Examples of the substituent are the same as those of substituent of the group A, mentioned above.

In formula (I-A), the preferred ranges and the examples of $Y_1$ and $Z_1$ are the same as those hereinabove mentioned for formula (I).

In formula (I-A), the examples of the heterocyclic group of $A_2$ and the examples of the substituent for the group can be selected from those of $A_1$ in formula (I) mentioned hereinabove. The preferred ranges of the former formula (I-A) are the same as those of the latter formula (I). Especially preferably, the nitrogen-containing heterocyclic group of $A_2$ is of a benzene-condensed ring.

Of couplers of formula (I-A), more preferred are those of the following general formula (I-B):

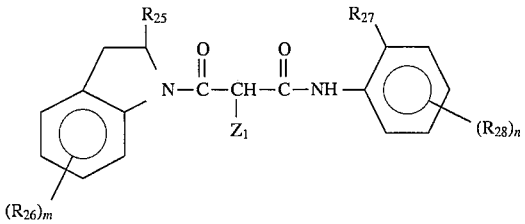

(I-B):

wherein $R_{25}$ represents a hydrogen atom or a substituent;

$R_{26}$, $R_{27}$ and $R_{28}$ each represent a substituent;

$Z_1$ has the same meaning as that in formula (I);

m and n each represent an integer of from 0 to 4, and when m and n each are an integer of 2 or more, plural $R_{26}$'s and $R_{27}$'s each may be the same or different or may be bonded to each other to form ring(s).

In formula (I-B), when $R_{25}$ and $R_{26}$ each are a substituent, examples of the substituent are the same as those of the substituent of $A_1$ in formula (I). Preferred examples of $R_{25}$ are a hydrogen atom, an alkyl group and an aryl group; and preferred examples of $R_{26}$ are a halogen atom, an alkoxy group, an acylamino group, a carbamoyl group, an alkyl group, a sulfonamido group, a cyano group and a nitro group. m is preferably an integer of from 0 to 2, especially preferably 0 or 1.

Examples of the substituent of $R_{27}$ and $R_{28}$ in formula (1-B) are the same as those of the substituent of $Y_1$ in formula (I). $R_{27}$ is preferably a halogen atom, an alkoxy group, an alkyl group or an aryloxy group. Preferred examples of $R_{28}$ are the same as those of the preferred substituent of $Y_1$ in formula (I). n is preferably an integer of from 0 to 2, more preferably 1 or 2.

Two or more couplers of formulae (I), (I-A) and (I-B) may be bonded to each other at any of X, $X_1$, $Y_1$ and $Z_1$ via a divalent or higher polyvalent group to form dimers or higher polymers. To such dimers or polymers, the ranges of the number of the carbon atoms constituting the substituents mentioned above do not apply.

Specific examples of couplers of formula (I) are mentioned below, which, however, are not limitative.

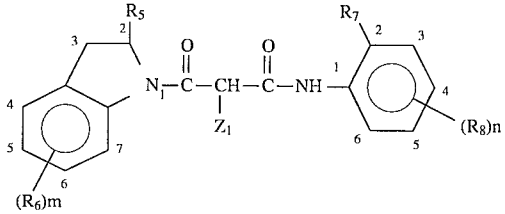

| No. | $R_5$ | m | $R_6$ | $R_7$ | n | $R_8$ | $Z_1$ |
|---|---|---|---|---|---|---|---|
| $Y_1$-1 | H | 0 | — | $-OCH_3$ | 1 | $-5-SO_2NHCO\underset{\vert}{C}HC_9H_{19}$ (C7H15) | 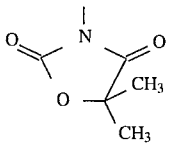 |
| $Y_1$-2 | " | " | — | $-OC_{18}H_{37}(n)$ | 1 | $-5-SO_2NHCO\underset{\vert}{C}HC_4H_9$ (C2H5) | " |
| $Y_1$-3 | " | " | — | $-OC_{12}H_{25}(n)$ | 1 | $-5-SO_2NHCON(C_3H_7)_2$ | " |
| $Y_1$-4 | " | " | — | $-O-CH_2\underset{\vert}{C}H-C_8H_{17}(n)$ (C6H13(n)) | 1 | $-5-SO_2NHCO\underset{\vert}{C}HC_4H_9$ (C2H5) | " |
| $Y_1$-5 | H | 0 | — | $-O-\underset{\vert}{C}HCOOC_{12}H_{25}(n)$ (CH3) | 1 | $-5-SO_2NHCOC_2H_5$ | 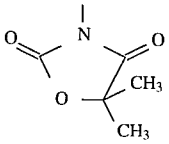 |
| $Y_1$-6 | " | " | — | $-OCH_2\underset{\vert}{C}H$ ($\underset{\vert}{C}H(CH_3)CH_2C(CH_3)_3$; $(CH_2)_2CH(CH_3)CH_2C(CH_3)_3$) | 1 | $-5-SO_2NHCOC_2H_5$ | " |
| $Y_1$-7 | " | " | — | $-OCH_2COOCH_2\underset{\vert}{C}HC_8H_{17}$ ($C_{10}H_{21}$) | 1 | $-5-SO_2NHCOCH_3$ | " |
| $Y_1$-8 | " | " | — | 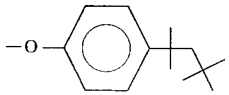 | 1 | $-5-SO_2NHCO\underset{\vert}{C}HC_4H_9$ (C2H5) | " |

-continued
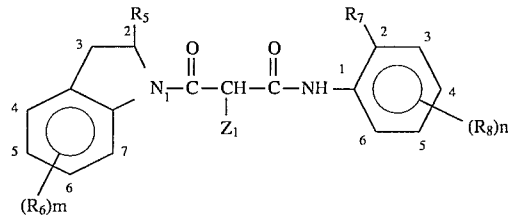
| No. | $R_5$ | m | $R_6$ | $R_7$ | n | $R_8$ | $Z_1$ |
|---|---|---|---|---|---|---|---|
| $Y_1$-9 | " | " | — | 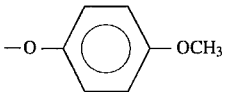 | 1 | $C_7H_{15}$ \| -5-$SO_2NHCOCH-C_9H_{19}$ | " |
| $Y_1$-10 | H | 0 | — | 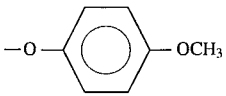 | 1 | -5-$CONHSO_2C_{12}H_{25}$ | 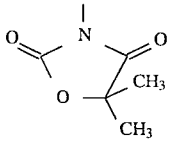 |
| $Y_1$-11 | " | " | — | 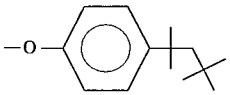 | 1 | -4-$SO_2NHCOC_9H_{19}$ | " |
| $Y_1$-12 | " | " | — | " | 2 | -4-Cl-5-$CONHSO_2C_{16}H_{33}$(n) | " |
| $Y_1$-13 | " | " | — | " | 2 | -3-Cl-5-$CONHCOC_{11}H_{23}$ | " |
| $Y_1$-14 | " | " | — | $-OCH_3$ | 2 | -3-Cl-5-$CONHSO_2C_{12}H_{25}$(n) | " |
| $Y_1$-15 | H | 0 | — | $-OC_{16}H_{33}$(n) | 1 | 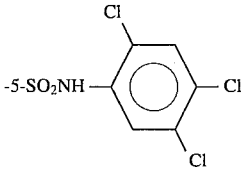 | 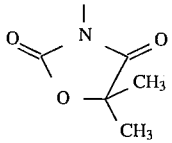 |

-continued
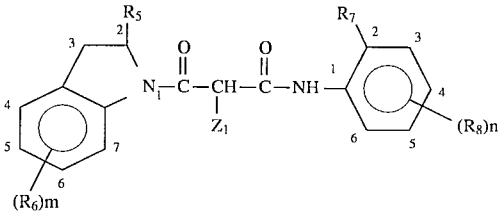
| No. | $R_5$ | m | $R_6$ | $R_7$ | n | $R_8$ | $Z_1$ |
|---|---|---|---|---|---|---|---|
| $Y_1$-16 | " | " | — | $-OCH_2CH(C_6H_{13})C_8H_{17}$ | 1 | 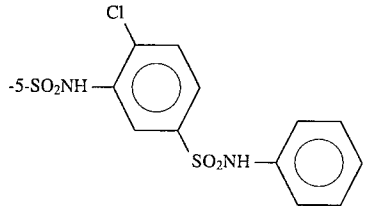 | " |
| $Y_1$-17 | " | " | — | $-OCH(CH_3)_2$ | 1 | 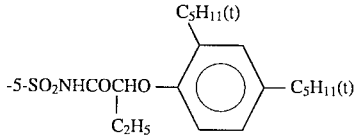 | " |
| $Y_1$-18 | " | " | — | $-OC_{18}H_{37}(n)$ | 1 | 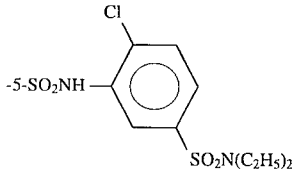 | " |
| $Y_1$-19 | H | 0 | — | 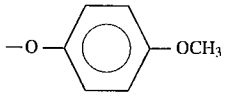 | 1 | 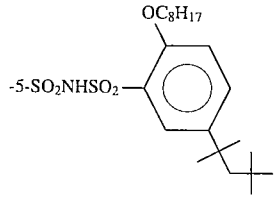 | 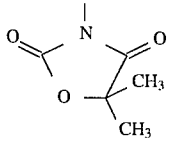 |

-continued
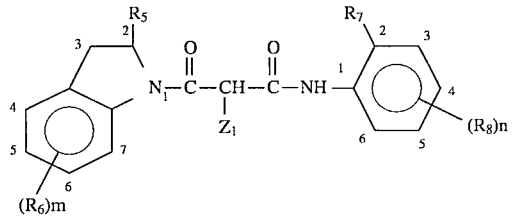
| No. | $R_5$ | m | $R_6$ | $R_7$ | n | $R_8$ | $Z_1$ |
|---|---|---|---|---|---|---|---|
| $Y_1$-20 | " | " | — | $-OC_2H_5$ | 1 | " | 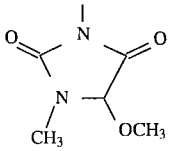 |
| $Y_1$-21 | " | " | — | $-OC_{18}H_{37}(n)$ | 2 | -4-Cl-5-$CONHSO_2C_{12}H_{25}$ | 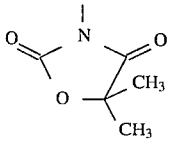 |
| $Y_1$-22 | " | " | — | " | 1 | 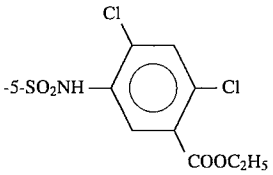 | " |
| $Y_1$-23 | H | 0 | — | 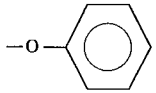 | 1 | 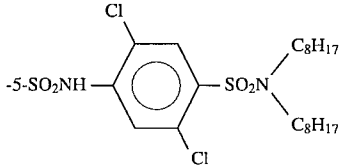 | 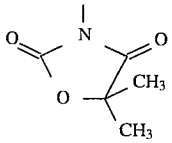 |

-continued
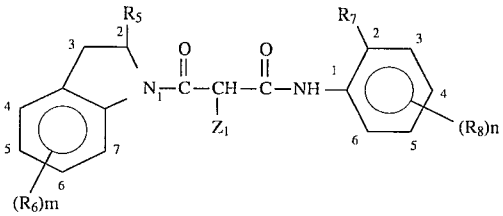
| No. | $R_5$ | m | $R_6$ | $R_7$ | n | $R_8$ | $Z_1$ |
|---|---|---|---|---|---|---|---|
| $Y_1$-24 | " | " | — | $-OCH(CH_3)_2$ | 1 | 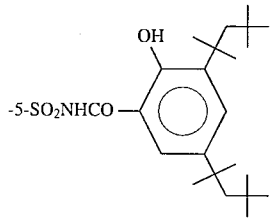 | " |
| $Y_1$-25 | $CH_3$ | " | — | $-OC_2H_5$ | 1 | $-5-SO_2NHCO\overset{C_7H_{15}}{\overset{\vert}{C}}HC_9H_{19}$ | " |
| $Y_1$-26 | H | " | — | $-OC_{18}H_{37}(n)$ | 1 | 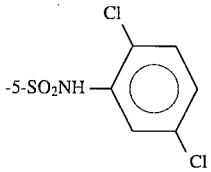 | 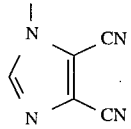 |
| $Y_1$-27 | H | 0 | — | 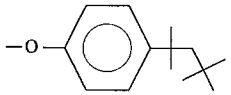 | 1 | 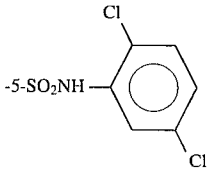 | 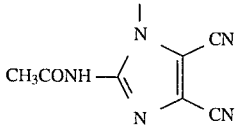 |
| $Y_1$-28 | " | 0 | — | $-OC_{16}H_{33}(n)$ | 1 | $-5-SO_2NHCOC_2H_5$ | 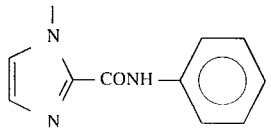 |

-continued
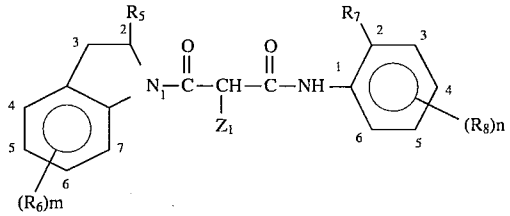
| No. | $R_5$ | m | $R_6$ | $R_7$ | n | $R_8$ | $Z_1$ |
|---|---|---|---|---|---|---|---|
| $Y_1$-29 | " | 0 | — | $-Cl$ | 1 | -5-$CONHSO_2-C_{16}H_{33}$(n) | 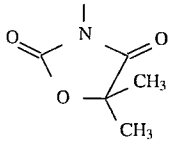 |
| $Y_1$-30 | " | 0 | — | " | 1 | -5-$NHCOCH(CH_3)CH_2SO_2C_{12}H_{25}$ | 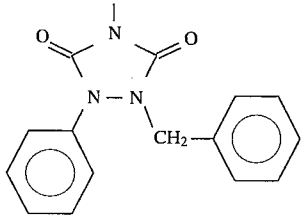 |
| $Y_1$-31 | H | 0 | — | $-Cl$ | 1 | 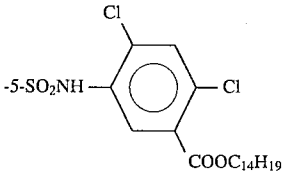 | 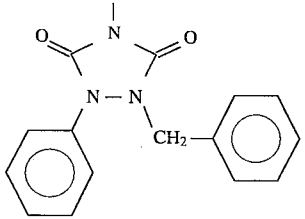 |
| $Y_1$-32 | " | 0 | — | " | 2 | -4-Cl-5-$COOC_{12}H_{25}$ | 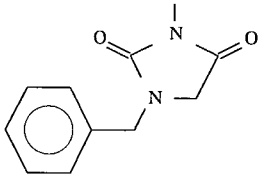 |

-continued
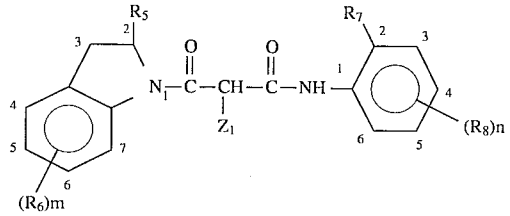
| No. | $R_5$ | m | $R_6$ | $R_7$ | n | $R_8$ | $Z_1$ |
|---|---|---|---|---|---|---|---|
| $Y_1$-33 | " | 0 | — | " | 2 | 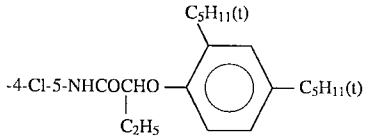 | 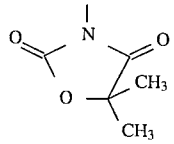 |
| $Y_1$-34 | " | 0 | — | " | 1 | -5-$SO_2NHC_{12}H_{25}$ | " |
| $Y_1$-35 | " | 0 | — | " | 1 | -5-$SO_2NHSO_2C_{16}H_{33}$(n) | 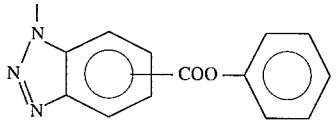 |
| $Y_1$-36 | H | 1 | 5-$NO_2$ | −Cl | 1 | 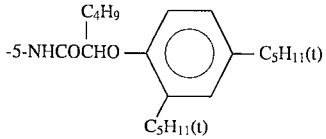 | 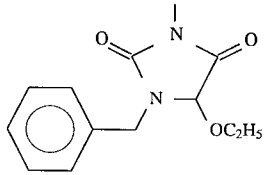 |
| $Y_1$-37 | " | 2 | 5,7-Br | " | 1 | -5-$NHSO_2C_{16}H_{33}$(n) | " |
| $Y_1$-38 | " | 0 | — | −$C_{18}H_{37}$(n) | 1 | 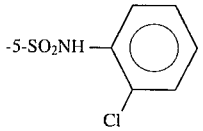 | 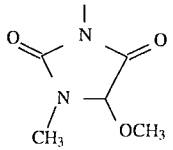 |

-continued
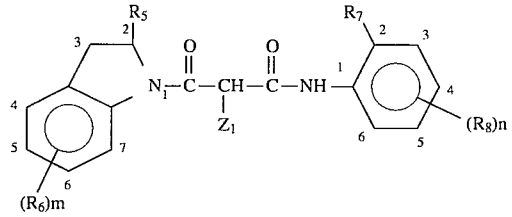
| No. | $R_5$ | m | $R_6$ | $R_7$ | n | $R_8$ | $Z_1$ |
|---|---|---|---|---|---|---|---|
| $Y_1$-39 | " | 0 | — | $-OCH_2CH_2O-C(=O)-CH(CH_3)-CHCH_2CH_2CHCH_2C(CH_3)_3$ | 1 | $-5-SO_2NH-C_6H_3(Cl)-SO_2NHCH_2CH(C_2H_5)C_4H_9$ | 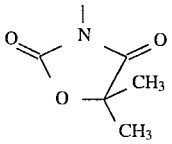 |
| $Y_1$-40 | " | 0 | — | $-OCH_2CH(C_8H_{17})-C_{10}H_{21}$ | 1 | $-5-SO_2NH-C_6H_5$ | " |
| $Y_1$-41 | H | 1 | 5-Cl | $-Cl$ | 1 | $-5-NHSO_2C_{16}H_{33}$ | 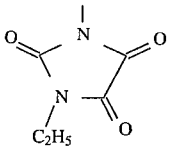 |
| $Y_1$-42 | 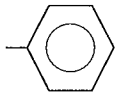 | 1 | 5-$NO_2$ | $-OC_{14}H_{29}$ | 1 | $-5-SO_2NH-C_6H_3(Cl)-Cl$ | 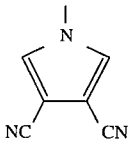 |
| $Y_1$-43 | H | 1 | 5-Br | $-Cl$ | 1 | $-5-COOCH(CH_3)-COOC_{12}H_{25}$ | 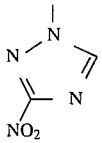 |

-continued
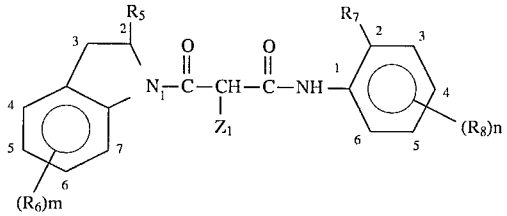
| No. | $R_5$ | m | $R_6$ | $R_7$ | n | $R_8$ | $Z_1$ |
|---|---|---|---|---|---|---|---|
| $Y_1$-44 | H | 1 | " | " | 1 | " | 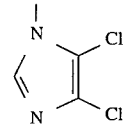 |
| $Y_1$-45 | " | 1 | 5-Cl | " | 1 | -5-$NHSO_2C_{12}H_{25}$ | 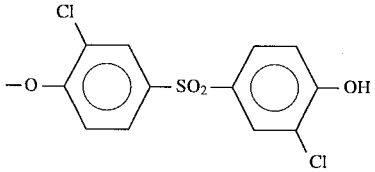 |
| $Y_1$-46 | H | 1 | 5-$NO_2$ | —Cl | 1 | -5-$NHSO_2C_{12}H_{25}$ | 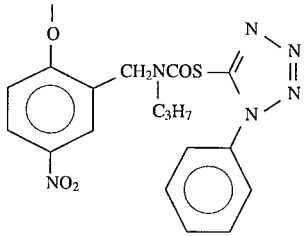 |

-continued
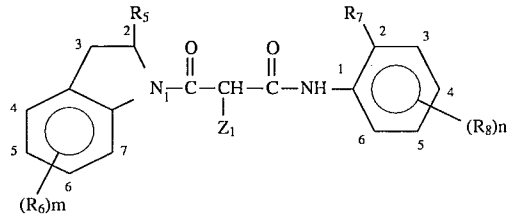
| No. | $R_5$ | m | $R_6$ | $R_7$ | n | $R_8$ | $Z_1$ |
|---|---|---|---|---|---|---|---|
| $Y_1$-47 | " | 0 | — | " | 1 | 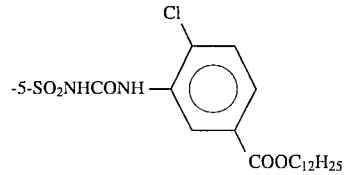 | 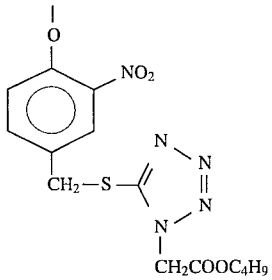 |
| $Y_1$-48 | " | 1 | 5-$OCH_3$ | " | 2 | -4-Cl-5-$COOC_{12}H_{25}$ | 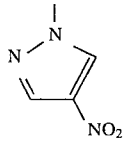 |
| $Y_1$-49 | " | 1 | 5-$NO_2$ | $-CF_3$ | 1 | 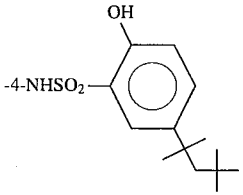 | 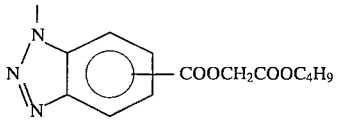 |
| $Y_1$-50 | H | 0 | — | $-OC_2H_5$ | 1 | -5-$SO_2C_{12}H_{25}$ | 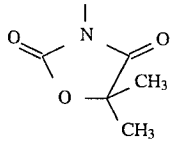 |

-continued
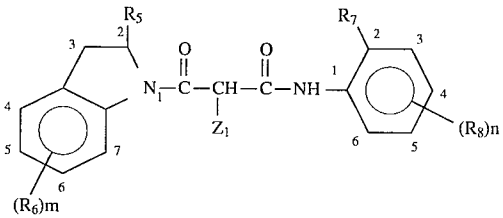
| No. | $R_5$ | m | $R_6$ | $R_7$ | n | $R_8$ | $Z_1$ |
|---|---|---|---|---|---|---|---|
| $Y_1$-51 | " | 0 | — | —Cl | 1 | 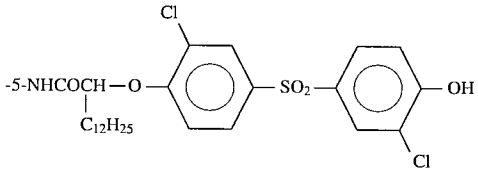 | " |
| $Y_1$-52 | $C_2H_5$ | 0 | — | " | 1 | 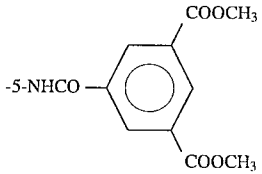 | 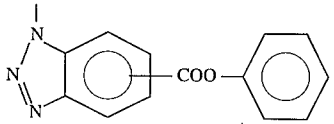 |
| $Y_1$-53 | H | 0 | — | " | 1 | 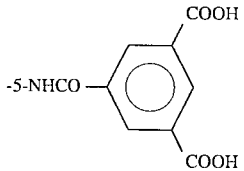 | 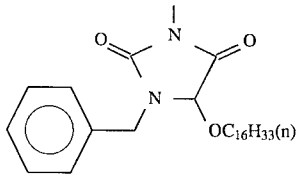 |
| $Y_1$-54 | H | 0 | — | —Cl | 1 | $-5-SO_2NHCOC_{11}H_{23}$ | 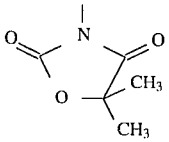 |

-continued
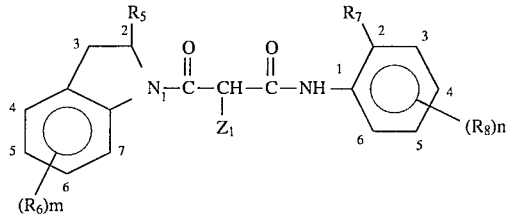
| No. | $R_5$ | m | $R_6$ | $R_7$ | n | $R_8$ | $Z_1$ |
|---|---|---|---|---|---|---|---|
| $Y_1$-55 | H | 0 | — | 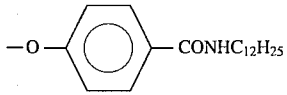 | 1 | 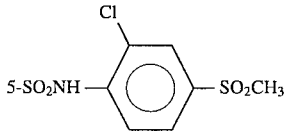 | 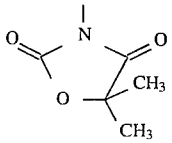 |
| $Y_1$-56 | H | 1 | Br | 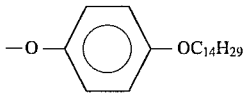 | 1 | 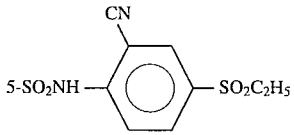 | " |
| $Y_1$-57 | H | 0 | — | 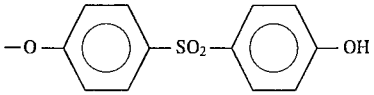 | 1 | 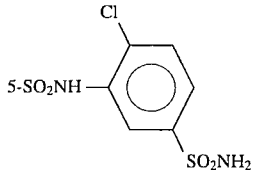 | " |
| $Y_1$-58 | H | 0 | — | 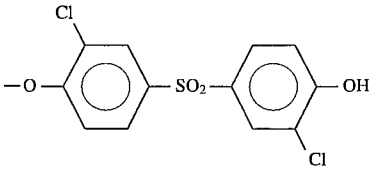 | 1 | $5\text{-}SO_2NHC_{14}H_{29}$ | 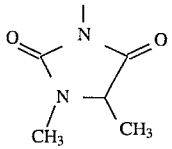 |
| $Y_1$-59 | " | " | — | 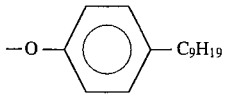 | 1 | $5\text{-}SO_2NHCONHC_{12}H_{25}$ | 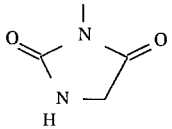 |

-continued
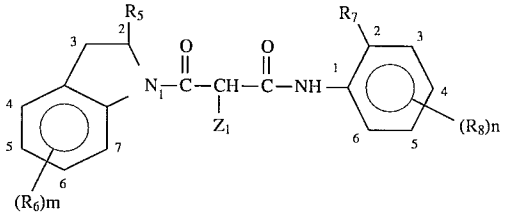
| No. | $R_5$ | m | $R_6$ | $R_7$ | n | $R_8$ | $Z_1$ |
|---|---|---|---|---|---|---|---|
| $Y_1$-60 | " | " | — | 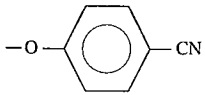 | 1 | 5-$NHSO_2C_{16}H_{33}$(n) | 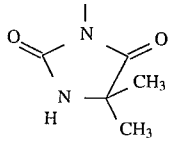 |
| $Y_1$-61 | " | " | — | 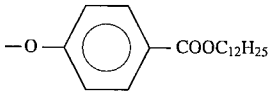 | 1 | 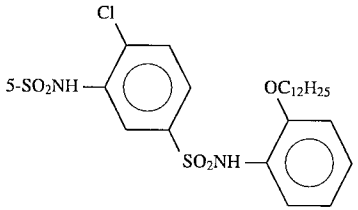 | 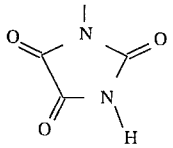 |
| $Y_1$-62 | H | 0 | — | 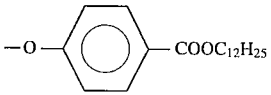 | 1 | 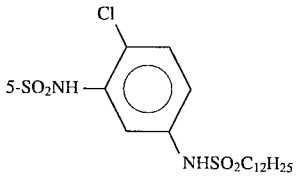 | 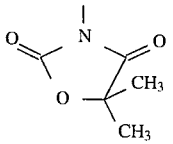 |
| $Y_1$-63 | " | 1 | 5-$NO_2$ | " | 1 | " | 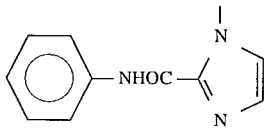 |

-continued
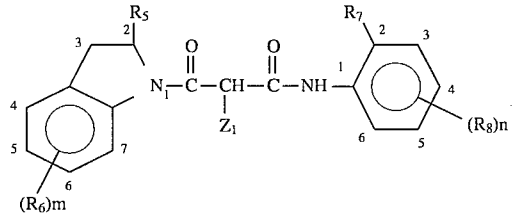
| No. | $R_5$ | m | $R_6$ | $R_7$ | n | $R_8$ | $Z_1$ |
|---|---|---|---|---|---|---|---|
| $Y_1$-64 | " | 1 | 5-$NHSO_2CH_3$ | 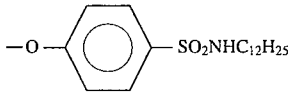 | 1 | 5-$SO_2NH_2$ | 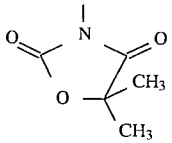 |
| $Y_1$-65 | " | 0 | — | 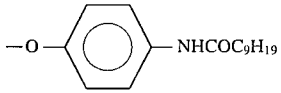 | 2 | 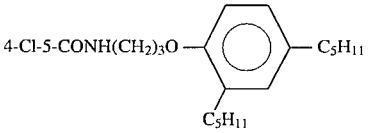 | " |
| $Y_1$-66 | $-CH_3$ | 1 | 5-Br | 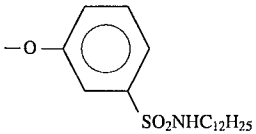 | 1 | 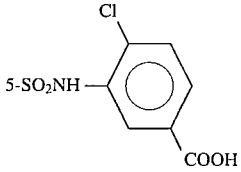 | 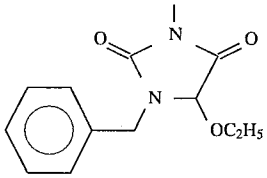 |
| $Y_1$-67 | H | 0 | — | 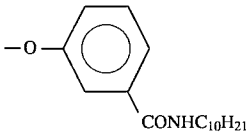 | 1 | 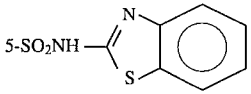 | 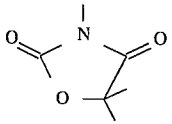 |
| $Y_1$-68 | " | 1 | 5-Br | $-OC_{12}H_{25}$ | 1 | 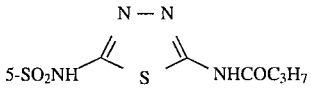 | " |

-continued
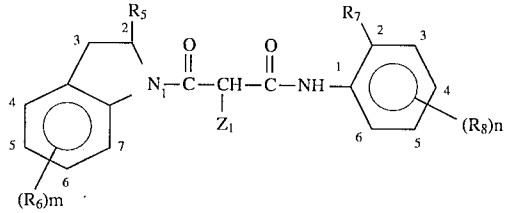
| No. | $R_5$ | m | $R_6$ | $R_7$ | n | $R_8$ | $Z_1$ |
|---|---|---|---|---|---|---|---|
| $Y_1$-69 | " | 0 | — | 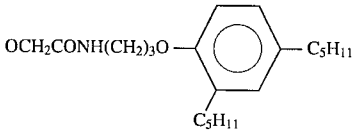 | 1 | 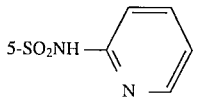 | " |
| $Y_1$-70 | " | 0 | — | 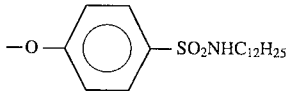 | 1 | 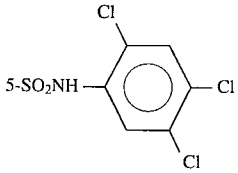 | 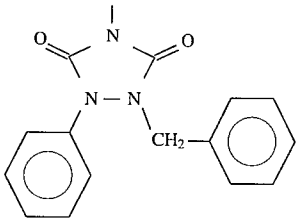 |

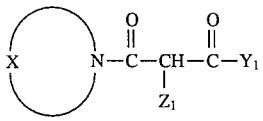
| No. | 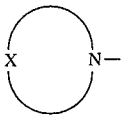 | $Y_1$ | $Z_1$ |
|---|---|---|---|
| $Y_1$-71 | 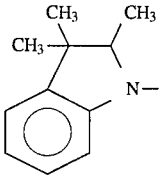 | 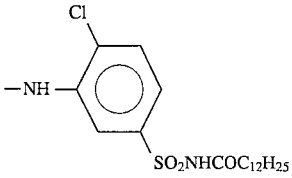 | 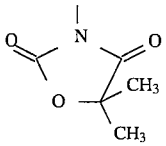 |
| $Y_1$-72 | 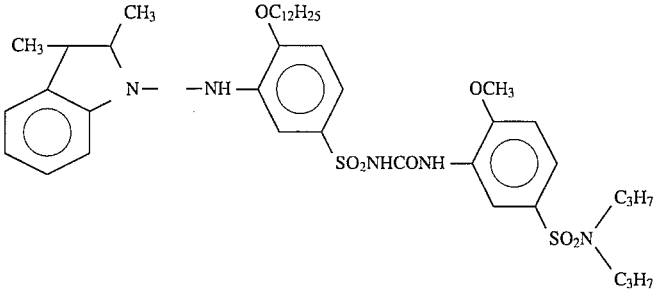 | | " |
| $Y_1$-73 | 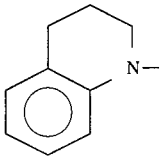 | 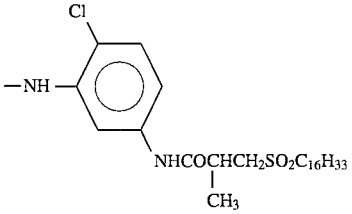 | 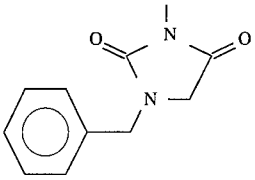 |
| $Y_1$-74 | 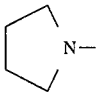 | 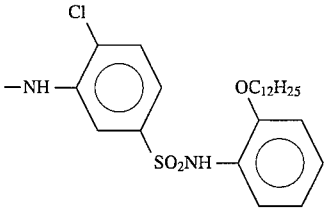 | 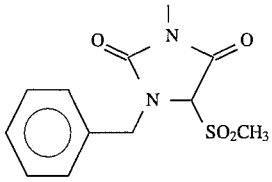 |
| $Y_1$-75 | 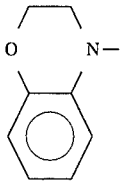 | 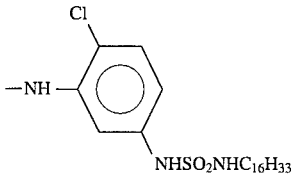 | 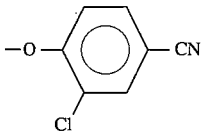 |
| $Y_1$-76 | 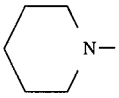 | 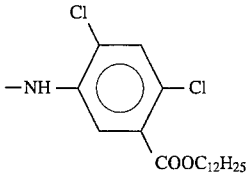 | 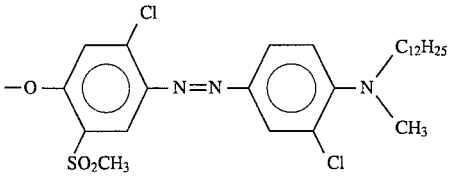 |

-continued
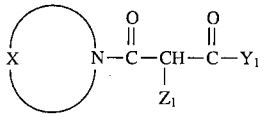
| No. | 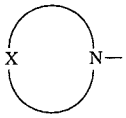 | $Y_1$ | $Z_1$ |
|---|---|---|---|
| $Y_1$-77 | 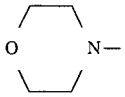 | 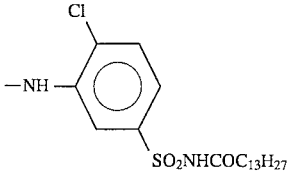 | 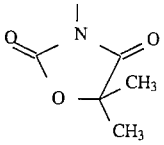 |
| $Y_1$-78 | 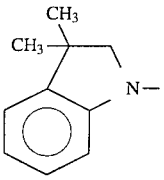 | 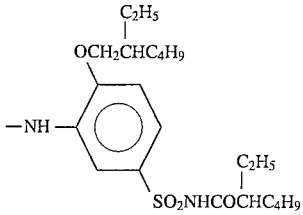 | $-SCH_2COOH$ |
| $Y_1$-79 | 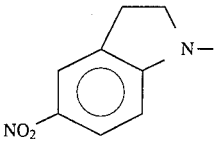 | 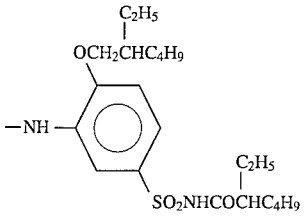 | 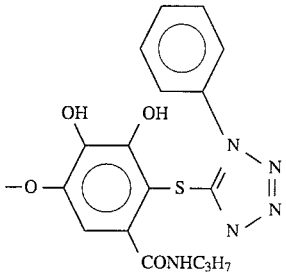 |
| $Y_1$-80 | " | " | 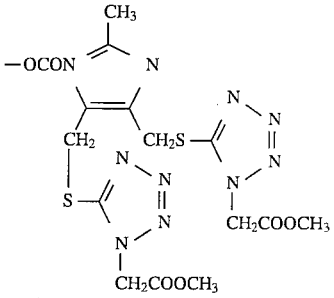 |
| (81) | 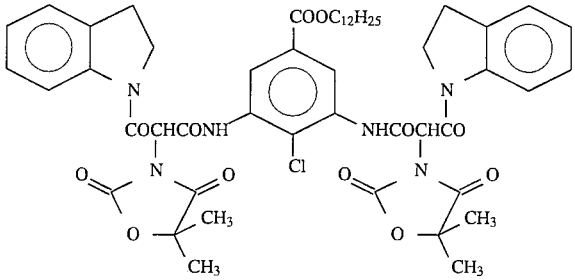 | | |

-continued

| No. | | $Y_1$ | $Z_1$ |
|---|---|---|---|
| (82) | 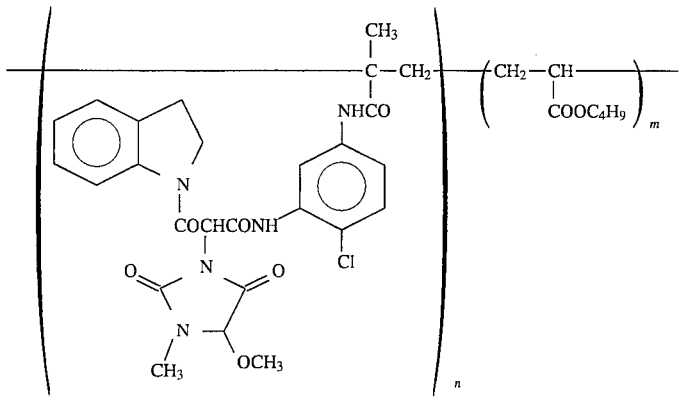 | | |

n:m = 50:50 (by weight)
mean molecular weight 25,000

Compounds of formula (I) for use in the present invention can be produced by known methods, for example, those described in EP 482,552A1, etc., or by methods similar to such known methods.

Yellow couplers of formula (II) for use in the present invention are described in detail hereunder.

In formula (II), $Z_2$ represents a hydrogen atom or a group which may split off from the coupler by coupling reaction with an oxidation product of an aromatic primary amine developing agent. $Y_2$ has the same meaning as Y1 in formula (I).

Of yellow couplers of formula (II), preferred are those of the following general formula (II-A):

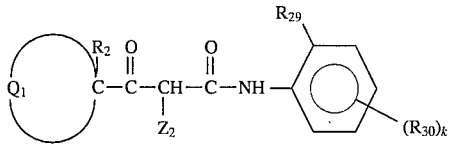

(II-A)

wherein $R_2$ represents a monovalent substituent except a hydrogen atom;

$Q_1$ represents a non-metallic atomic group necessary for forming, along with the carbon atom in the formula, a 3-membered to 5-membered hydrocarbon ring or a 3-membered to 6-membered hereto ring having therein at least one hereto atom selected from N, S, O and P;

$R_{29}$ represents a hydrogen atom, a halogen atom (e.g., fluorine, chlorine, bromine, iodine), an alkoxy group, an aryloxy group, an alkylthio group, an arylthio group, an alkyl group, or an amino group;

$R_{30}$ preferably represents a group substitutable on the benzene ring of the formula;

$Z_2$ represents a hydrogen atom, or a group which may split off from the coupler by coupling reaction with an oxidation product of an aromatic primary amine developing agent (hereinafter referred to as a "split-off group");

k represents an integer of from 0 to 4; provided that when k is a plural number, plural $R_{30}$'s may be the same or different;

$R_2$ may be bonded to $Q_1$ to form a bi-cyclic or poly-cyclic ring.

Examples of $R_{30}$ include a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an ureido group, a sulfamoylamino group, an alkoxycarbonylamino group, an aryloxysulfonyl group, an acyloxy group, a nitro group, a heterocyclic group, a cyano group, an acyl group, an acyloxy group, an alkylsulfonyloxy group, and an arylsulfonyloxy group. Examples of the split-off group of $Z_2$ include a heterocyclic group to be bonded to the coupling-active position of the compound via its nitrogen atom, an aryloxy group, an arylthio group, an acyloxy group, an alkylsulfonyloxy group, an arylsulfonyloxy group, a heterocyclic-oxy group, a heterocyclic-thio group, and a halogen atom.

Preferred substituents to be in formula (II-A) are mentioned below.

In formula (II-A), $R_2$ is preferably a halogen atom, a cyano group, an optionally-substituted, monovalent group having from 1 to 30 carbon atoms (e.g., an alkyl group, an alkoxy group, an alkylthio group, or an optionally-substituted, monovalent group having from 6 to 30 carbon atoms (e.g., an aryl group, an aryloxy group, an arylthio group). As examples of the substituent for the substituted group of $R_2$, mentioned are a halogen atom, an alkyl group, an alkoxy group, a nitro group, an amino group, a carbonamido group, a sulfonamido group, and an acyl group.

In formulae (II) and (II-A), $Q_1$ is preferably a non-metallic atomic group necessary for forming, along with the carbon atom in the formula, a 3-membered to 5-membered, optionally-substituted hydrocarbon ring having from 3 to 30 carbon atoms or a 3-membered to 6-membered, optionally-substituted hereto ring having therein at least one hereto atom selected from N, S, O and P and having from 2 to 30 carbon atoms. The ring to be formed by $Q_1$ and the carbon atom may have unsaturated bond(s) therein. Examples of the ring to be formed by $Q_1$ and the carbon atom include a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thietane ring, a thiolane ring, a pyrrolidine ring, a tetrahydropyrane ring, a 1,3-dioxane ring, a 1,4-dioxane ring, a tetrahydrothiopyrane ring, an oxathiane ring, a morpholine ring, etc. Examples of the substituent for the rings include a halogen atom, a hydroxyl group, an alkyl group, an aryl group, an acyl group, an alkoxy group, an aryloxy group, a cyano group, an alkoxycarbonyl group, an alkylthio group, and an arylthio group.

$Q_1$ may be bonded to $R_2$ to form a bicycloalkyl or a poly-cycloalkyl group along with the carbon atom bonded to $Q_1$. Examples of such groups include a bicyclo(2.1.0)pentan-1-yl group, a bicyclo(2.2.0)hexan-1-yl group, a bicyclo(3.1.0)hexan-1-yl group, a bicyclo(3.2.0)heptan-1-yl group, a bicyclo(3.3.0)octan-1-yl group, a bicyclo(4.1.0)heptan-1-yl group, a bicyclo(4.2.0)octan-1-yl group, a bicyclo(4.3.0)nonan-1-yl group, a bicyclo(5.1.0)octan-1-yl group, a bicyclo(5.2.0)nonan-1-yl group, a bicyclo(1.1.1)pentane-1-carbonyl group, a bicyclo(2.1.1)hexane-1-carbonyl group, a bicyclo(2.2.1)heptane-1-carbonyl group, a bicyclo(2.2.2)octane-1-carbonyl group, a tricyclo($3.1.1.0^{3,6}$)heptane-6-carbonyl group, a tricyclo($3.3.0.0^{3,7}$)octane-1-carbonyl group, and a tricyclo($3.3.1.0^{3,7}$)nonane-3-carbonyl group. These may optionally be substituted. Examples of the substituent for these groups are the same as those for $Q_1$ mentioned above. The position of the substituent in these groups is preferably selected from the positions except the β-position relative to the carbonyl group to which the group is bonded in the formula.

Of the acyl groups of $B_1$ in formula (II), more preferred are a 1-alkylcycloproapne-1-carbonyl group, a bicyclo(2.1.0)pentane-1-carbonyl group, a bicyclo(3.1.0)hexane-1-carbonyl group, a bicyclo(4.1.0)heptane-1-carbonyl group, a bicyclo(2.2.0)hexane-1-carbonyl group, a bicyclo(1.1.1)pentane-1-carbonyl group, a bicyclo(2.1.1)hexane-1-carbonyl group, and a tricyclo($3.1.1.0^{3,6}$)heptane-6-carbonyl group.

Of these, most preferred is a 1-alkylcyclopropane-1-carbonyl group. The 1-positioned alkyl moiety in the 1-alkylcyclopropane-1-carbonyl group is preferably a substituted or unsubstituted alkyl group having from 2 to 18 carbon atoms, more preferably a substituted or unsubstituted alkyl group having from 2 to 12 carbon atoms in which the α-position is not branched. Especially preferred are an ethyl group, a propyl group, a butyl group, a benzyl group, and a phenethyl group.

In formula (II-A), $R_{29}$ is preferably a halogen atom, an optionally substituted alkoxy group having from 1 to 30 carbon atoms, an optionally substituted aryloxy group having from 6 to 30 carbon atoms, an optionally substituted alkyl group having from 1 to 30 carbon atoms, or an optionally substituted amino group having from 0 to 30 carbon atoms. Examples of the substituent for these groups include a halogen atom, an alkyl group, an alkoxy group, and an aryloxy group.

In formula (II-A), $R_{30}$ is preferably a halogen atom, an optionally substituted alkyl group having from 1 to 30 carbon atoms, an optionally substituted aryl group having from 6 to 30 carbon atoms, an optionally substituted alkoxy group having from 1 to 30 carbon atoms, an optionally substituted alkoxycarbonyl group having from 2 to 30 carbon atoms, an optionally substituted aryloxycarbonyl group having from 7 to 30 carbon atoms, an optionally substituted carbonamido group having from 1 to 30 carbon atoms, an optionally substituted sulfonamido group having from 1 to 30 carbon atoms, an optionally substituted carbamoyl group having from 1 to 30 carbon atoms, an optionally substituted sulfamoyl group having from 0 to 30 carbon atoms, an optionally substituted alkylsulfonyl group having from 1 to 30 carbon atoms, an optionally substituted arylsulfonyl group having from 6 to 30 carbon atoms, an optionally substituted ureido group having from 1 to 30 carbon atoms, an optionally substituted sulfamoylamino group having from 0 to 30 carbon atoms, an optionally substituted alkoxycarbonylamino group having from 2 to 30 carbon atoms, an optionally substituted heterocyclic group having from 1 to 30 carbon atoms, an optionally substituted acyl group having from 1 to 30 carbon atoms, an optionally substituted alkylsulfonyloxy group having from 1 to 30 carbon atoms, or an optionally substituted arylsulfonyloxy group having from 6 to 30 carbon atoms. Examples of the substituent for these groups include a halogen atom, an alkyl group, an aryl group, a heterocyclic group, an alkoxy group, an aryloxy group, a heterocyclic-oxy group, an alkylthio group, an arylthio group, a heterocyclic-thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, an ureido group, a cyano group, a nitro group, an acyloxy group, an alkoxycarbonyl group, an aryloxycarbonyl group, an alkylsulfonyloxy group, and an arylsulfonyloxy group.

In formula (II-A), k is preferably an integer of 1 or 2, and the position of $R_{30}$ is preferably a meta- or para-position relative to the acylacetamido group in the formula.

In formula (II-A), $Z_2$ is preferably a heterocyclic group to be bonded to the coupling-active position in the formula via its nitrogen atom, or an aryloxy group.

When $Z_2$ is a heterocyclic group, it is preferably selected from an imidazolidine-2,4-dion-3-yl group, an oxazolidine-2,4-dion-3-yl group, a 1,2,4-triazolidine-3,5-dion-4-yl group, a succinimido group, a 1-pyrazolyl group and a 1-imidazolyl group, which may optionally be substituted.

When $Z_2$ is an aryloxy group, it is preferably substituted by at least one electron-attracting substituent (e.g., a halogen atom, a cyano group, a nitro group, a trifluoromethyl group, an acyl group, an alkylsulfonyl group, an arylsulfonyl group, an alkoxycarbonyl group, a carbamoyl group, a sulfamoyl group).

$Z_2$ is especially preferably the above-mentioned 5-membered heterocyclic group.

Two or more couplers of formulae (II) and (II-A) may be bonded to each other at any of their substituents $R_2$, $R_{29}$, $R_{30}$, $Q_1$ and $Z_2$, via a chemical bond or a divalent or polyvalent group to form dimers or polymers. To such dimers or polymers, the ranges of the number of the carbon atoms constituting the substituents mentioned above do not apply.

Specific examples of yellow couplers of formula (II-A) are mentioned below, which, however, are not limitative.

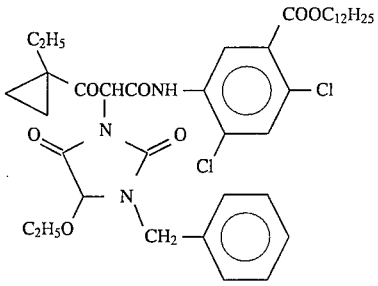
Y2-1
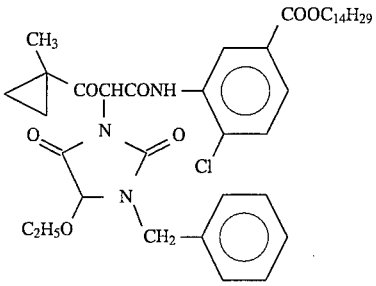
Y2-2
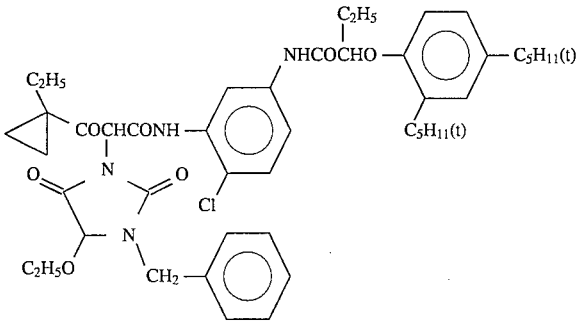
Y2-3
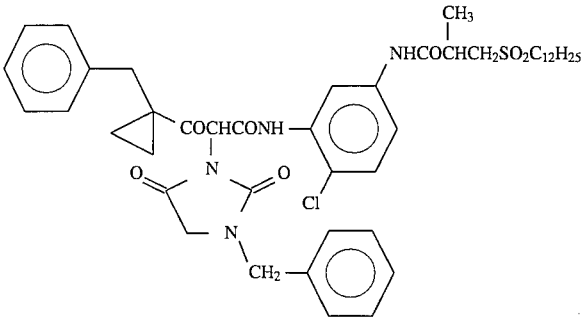
Y2-4
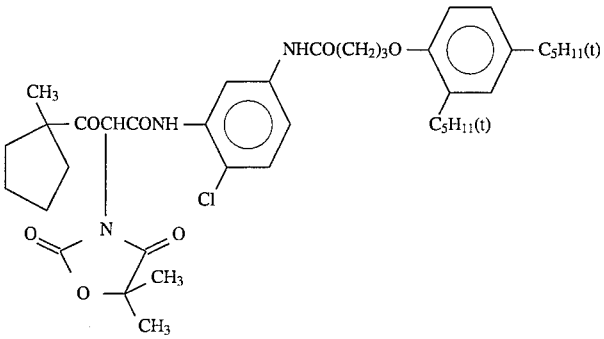
Y2-5
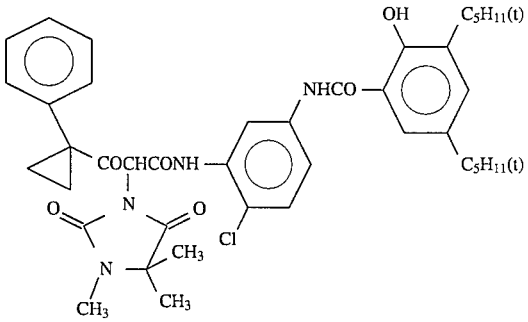
Y2-6
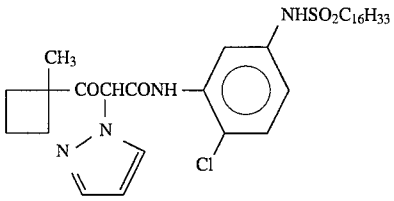
Y2-7

-continued
Y2-8
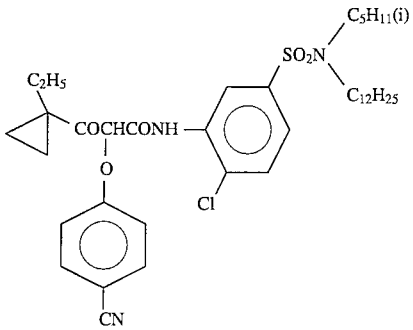
Y2-9
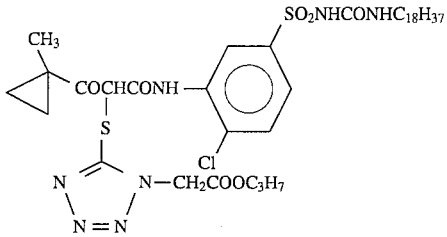
Y2-10
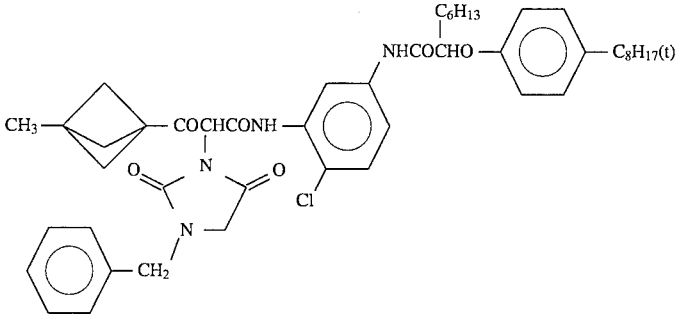
Y2-11
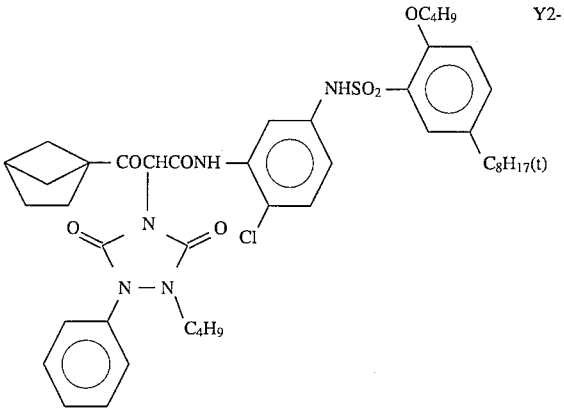
Y2-12
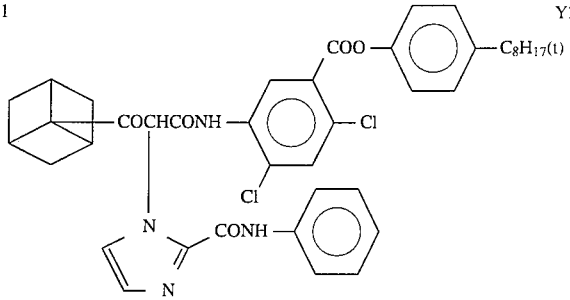
Y2-13
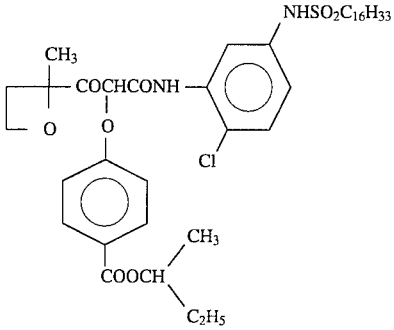
Y2-14
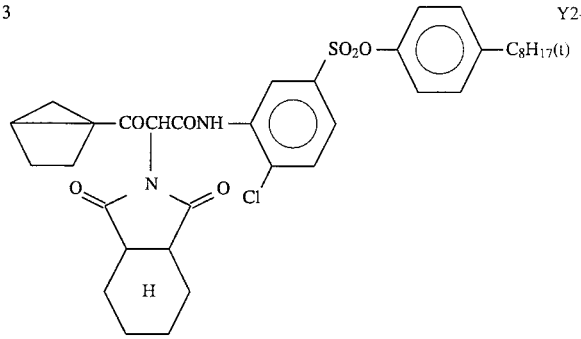

-continued
Y2-15
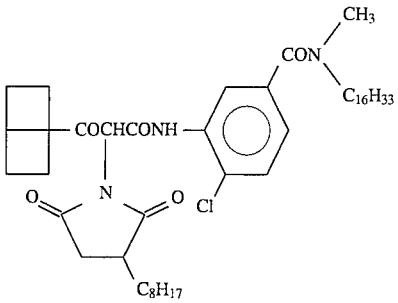
Y2-16
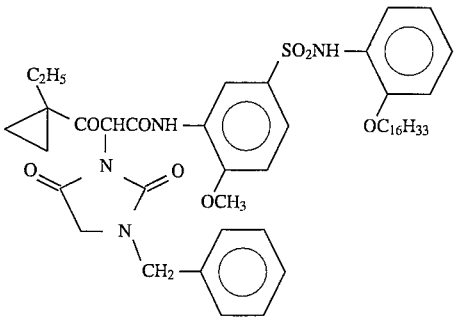
Y2-17
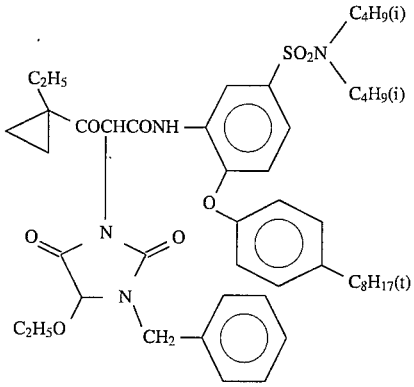
Y2-18
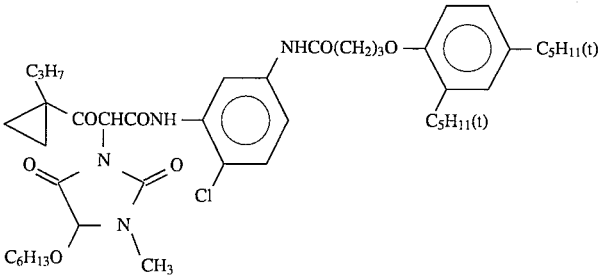
Y2-19
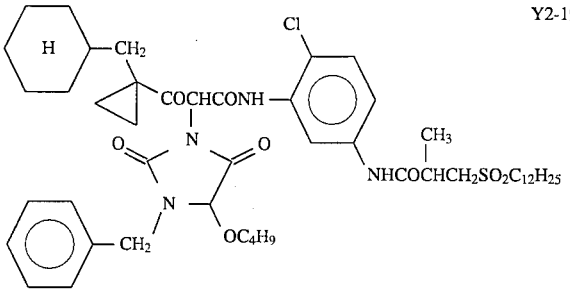
Y2-20
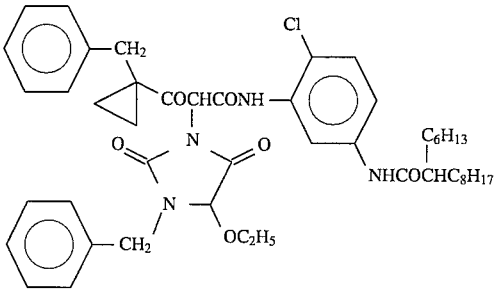
Y2-21
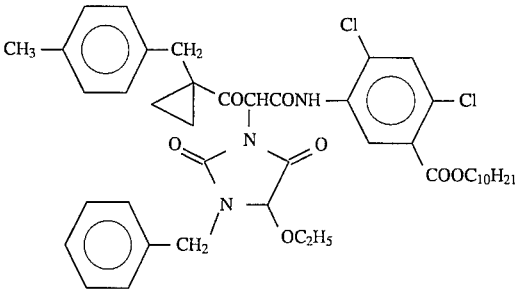
Y2-22
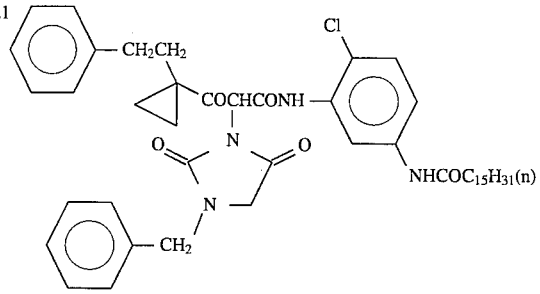

-continued
Y2-23
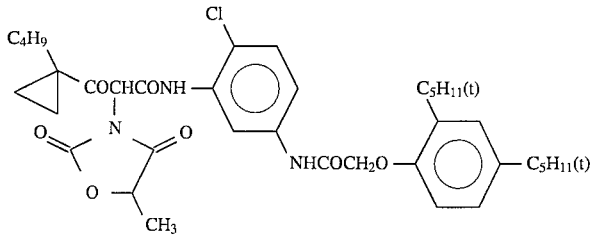
Y2-24
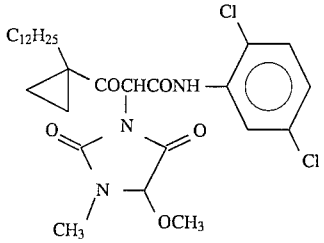
Y2-25
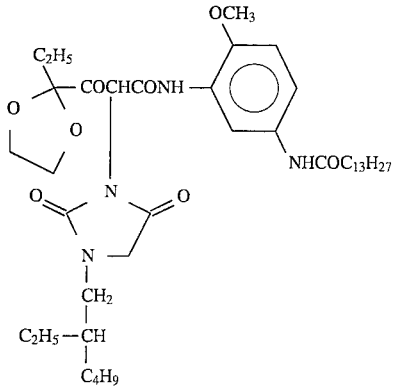
Y2-26
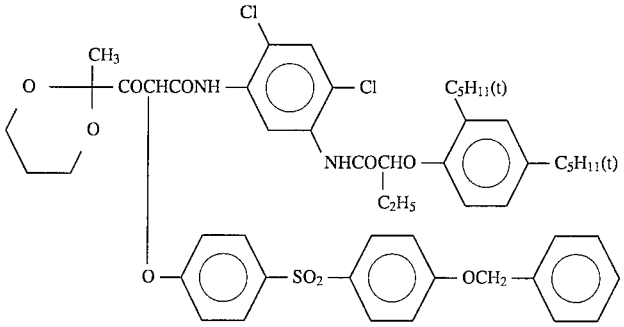
Y2-27
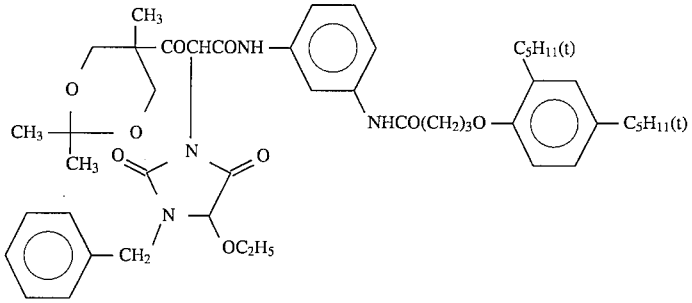
Y2-28
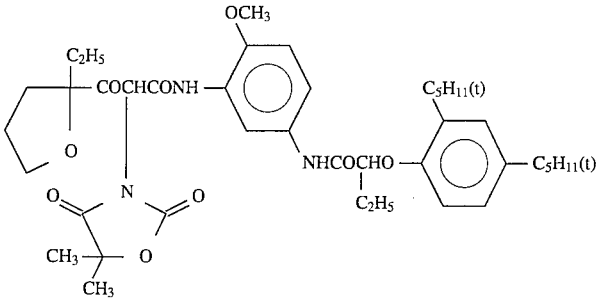

-continued
Y2-29
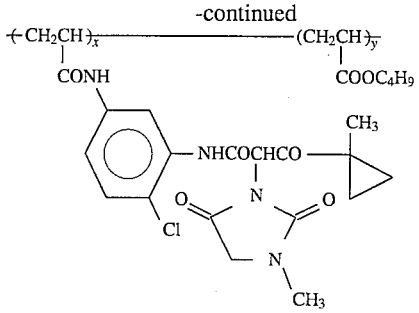
x:y = 60:40 (by weight)
number average molecular weight 50,000
Y2-30
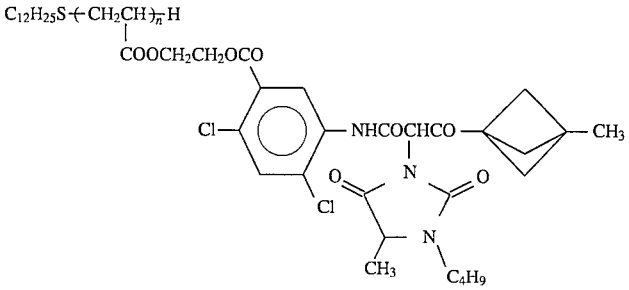
Y2-31
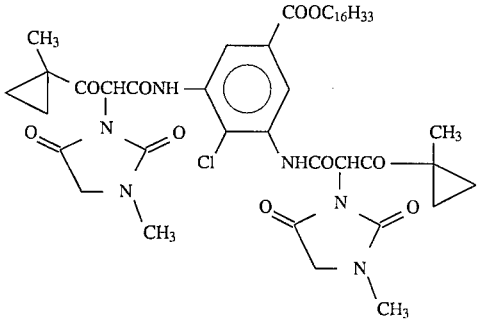
Y2-32
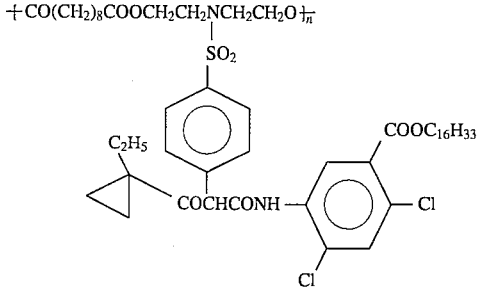
number average molecular weight 84,000
Y2-33
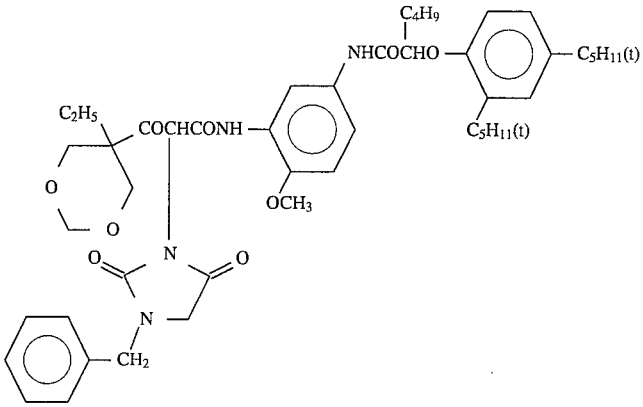
Y2-34
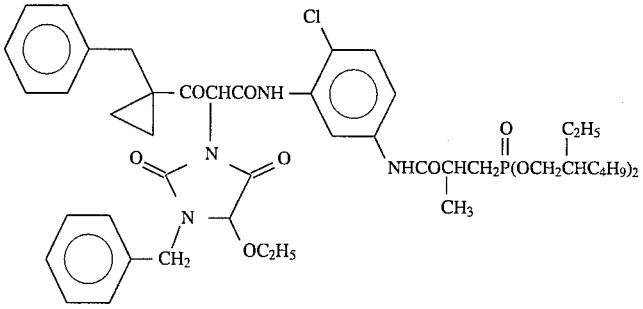

Other acetamide-type yellow couplers of formula (II) for use in the present invention than those mentioned hereinabove, and methods for producing yellow couplers of formula (II) are described in EP 447,969A, JP-A 4-344640 and 5-80469.

Next, yellow couplers of formula (III) for use in the present invention are mentioned in detail hereunder.

In formula (III), D represents an tertiary alkyl group; $Z_3$ has the same meaning as Z1 in formula (I); $V_1$ represents a fluorine atom, an alkoxy group, an aryloxy group, a dialkylamino group, an alkylthio group, an arylthio group, or an alkyl group.

In formula (III), $W_1$ represents a group substitutable on the benzene ring in the formula. More concretely, $W_1$ has the same meaning as $R_{30}$ in formula (II-A). A). t represents an integer of from 0 to 4, and when t is 2 or more, plural $W_1$'s may be the same or different.

Preferred substituents in couplers of formula (III) are mentioned below.

In formula (III), D is preferably a tertiary alkyl group having from 4 to 8 carbon atoms, especially preferably a tert-butyl group.

In formula (III), $V_1$ is preferably an alkoxy group having from 1 to 24 carbon atoms, or an aryloxy group having from 1 to 30 carbon atoms. The alkoxy and aryloxy groups may be substituted by suitable substituent(s). Preferred examples of the substituent are a halogen atom, an alkyl group, an alkoxy group, an aryloxy group, an alkoxycarbonyl group, an acyloxy group, an alkylsulfonyl group, an acylamino group, a carbamoyl group, a sulfonylamino group, and a sulfamoyl group. Especially preferred is an alkoxy or aryloxy group substituted by one or more substituents selected from branched or linear alkyl, alkoxy, alkoxycarbonyl and alkylsulfonyl groups.

Preferred examples of $Z_3$ in formula (III) are the same as the preferred examples of $Z_2$ in formula (II-A) mentioned hereinabove.

Like couplers of formula (II), couplers of formula (III) may also form dimers or polymers.

Specific examples of yellow couplers of formula (III) for use in the present invention are mentioned below, which, however, are not limitative.

Y3-1

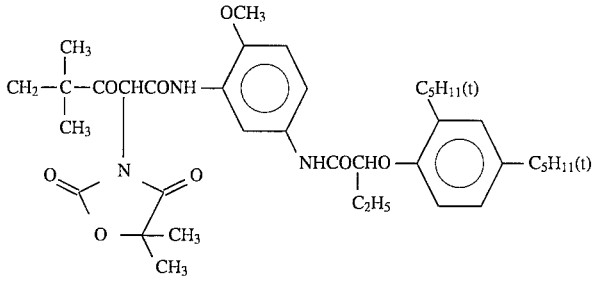

Y3-2

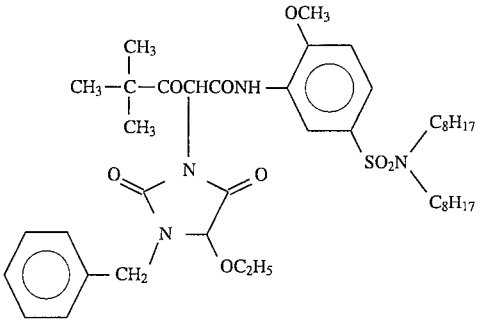

Y-3

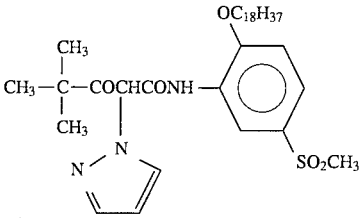

-continued
Y3-4
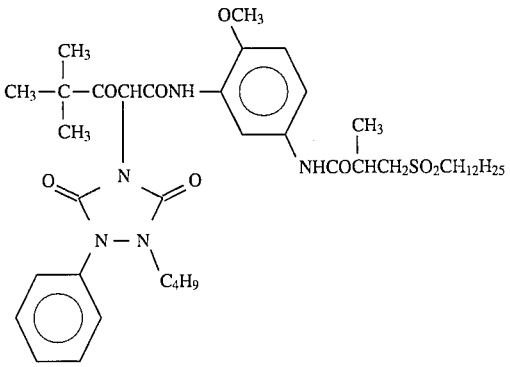
Y3-5
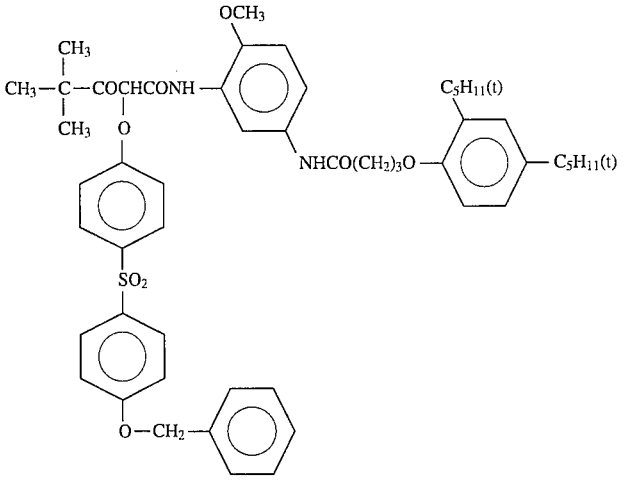
Y3-6
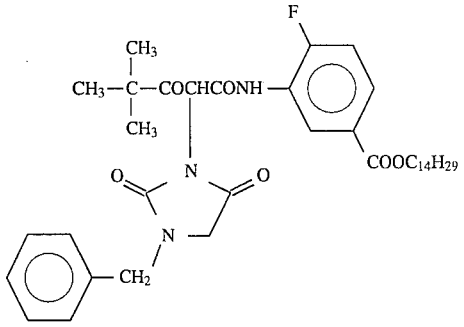
Y3-7
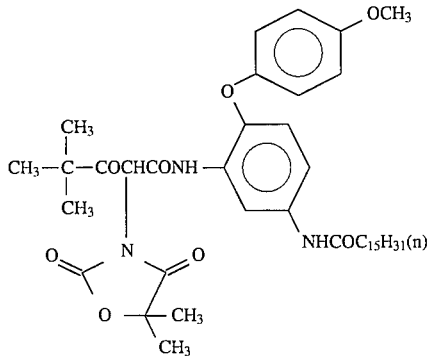

-continued
Y3-8
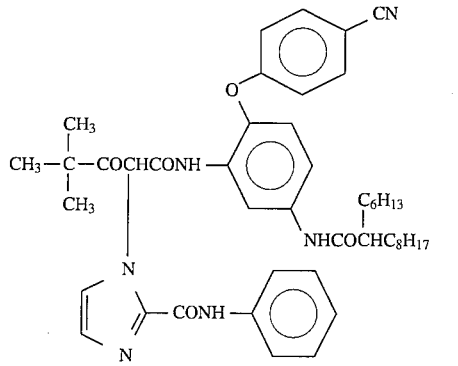
Y3-9
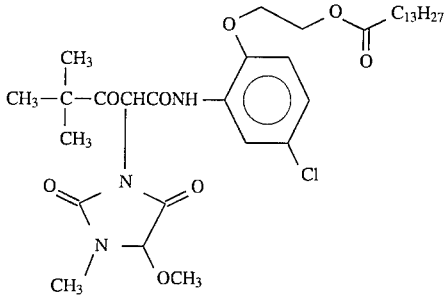
Y3-10
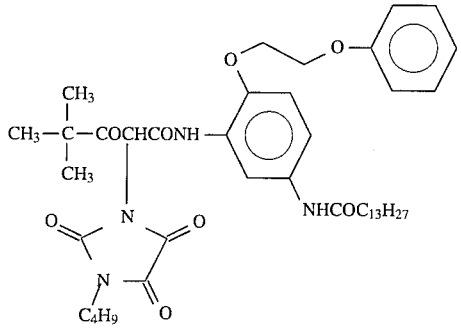
Y3-11
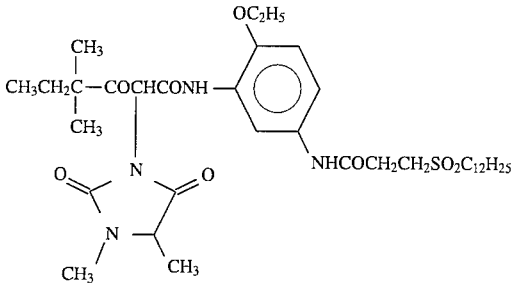
Y3-12
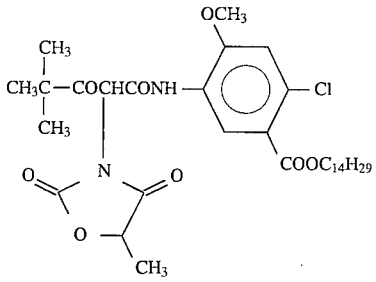

-continued

Y3-13

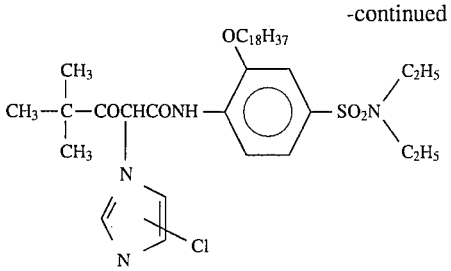

Compounds of formula (III) for use in the present invention are described in, for example, JP-A 63-231451, 63-123047, 63-241547, 1-173499, 1-213648, 1-250944.

To incorporate the specific yellow couplers defined herein into a silver halide color photographic material, at least one layer containing at least one of such couplers is coated on a support. The layer containing such coupler(s) may be any hydrophilic colloid layer to be coated on a support. Preferably, the couplers are added to light-sensitive silver halide emulsion layers, especially preferably to blue-sensitive layers.

The amount of the yellow coupler of formula (I), (II) or (III) to be in the silver halide color photographic material of the present invention is preferably from 0.01 to 10 mmol/$m^2$, more preferably from 0.05 to 5 mmol/$m^2$, most preferably from 0.1 to 2 mmol/$m^2$. As a matter of course, two or more couplers of formulae (I), (II) and (III) may be incorporated into the photographic material of the present invention. Two or more couplers of the same formula or different formulae (I), (II) and/or (III) may be combined. If desired, couplers of formulae (I), (II) and/or (III) may be combined with other coupler(s) than those of these formulae. Where coupler(s) of formulae (I), (II) and/or (III) is/are combined with other coupler(s), it is desired that the proportion of the former is 30 mol % or more. In any of such cases, the preferred amount of the coupler of formula (I), (II) or (III) to be in the photographic material of the present invention is as defined above.

The amount of the silver halide emulsion to be in the silver halide emulsion layer containing the particular yellow coupler(s) defined herein is preferably from 0.5 to 50 times, more preferably from 1 to 20 times, most preferably from 2 to 10 times, by mol of silver therein, as large as the amount of the coupler(s) in the layer.

To add the above-defined coupler to the hydrophilic colloid layer constituting the photographic material of the present invention, various known methods may be employed. In general, known oil-in-water dispersion methods such as oil-protecting methods are employed. As one method, the coupler is dissolved in a high boiling point organic solvent, such as phosphates, phthalates, etc., along with an auxiliary solvent having a low boiling point, and then the resulting solution is dispersed in an aqueous solution of gelatin containing a surfactant. As another method, water or an aqueous solution of gelatin is added to a solution of the coupler containing a surfactant to give an oil-in-water dispersion after phase conversion. As still another method, a known Fisher dispersion method may be employed when the coupler is soluble in alkalis. To remove the low boiling point organic solvent from the thus-prepared coupler dispersion, it is often preferred to subject the dispersion to distillation, noodle washing, ultrafiltration or the like treatment.

As the dispersion medium for these couplers, preferably used are high boiling point organic solvents having a dielectric constant of from 2 to 20 (at 25° C.) and an index of refraction of from 1.4 to 1.7. The ratio by weight of the dispersion medium to the coupler is preferably from 0.1/1 to 10/1, more preferably from 0.3/1 to 3/1.

Next, compounds of formula (IV) for use in the present invention are mentioned in more detail hereunder.

In formula (IV), $R_{a1}$ represents a hydrogen atom, an aliphatic group (preferably an optionally substituted alkyl group having from 1 to 40 carbon atoms, e.g., methyl, i-propyl, cyclohexyl, benzyl, dodecyl, 2-methanesulfonylethyl), an aromatic carbonyl group (this may have substituent(s) and preferably has from 6 to 42 carbon atoms, e.g., benzoyl, toluoyl, 3-octyloxybenzoyl), a saturated aliphatic carbonyl group (this may have substituent(s) and preferably has from 2 to 42 carbon atoms, e.g., acetyl, benzoyl, pivaloyl, myristoyl), or a sulfonyl group (this may have substituent(s) and preferably has from 1 to 40 carbon atoms, e.g., methanesulfonyl, butanesulfonyl, benzenesulfonyl).

$R_{a2}$ and $R_{a3}$ may be the same or different and each represents a hydrogen atom, an aliphatic group (preferably, an optionally substituted alkyl group having from 1 to 40 carbon atoms, e.g., methyl, ethyl, i-propyl, cyclohexyl, t-butyl), an aliphatic-oxy group (preferably, an optionally substituted alkoxy group having from 1 to 40 carbon atoms, e.g., methoxy, butoxy, cyclohexyloxy, dodecyloxy), an acylamino group (this may have substituent(s) and preferably has from 2 to 42 carbon atoms, e.g., acetamino, myristoylamino, pivaloylamino), an aliphatic-oxycarbonyl group (preferably, an optionally substituted alkoxycarbonyl group having from 2 to 42 carbon atoms, e.g., methoxycarbonyl, butoxycarbonyl, cyclohexyloxycarbonyl), or a carbamoyl group (this may have substituent(s) and preferably has from 2 to 42 carbon atoms, e.g., dimethylcarbamoyl, N-methyl-N-phenylcarbamoyl). $R_{4a}$ and $R_{5a}$ may be the same or different and each represents an aliphatic group (preferably, an optionally substituted alkyl group having from 1 to 40 carbon atoms, e.g., methyl, ethyl, i-propyl, cyclohexyl, t-butyl), or an acylamino group (this may have substituent(s) and preferably has from 2 to 42 carbon atoms, e.g., acetamino, myristoylamino, pivaloylamino). Z represents a chemical bond or a divalent linking group (e.g., an alkylene group, an alkylidene group, —S—, —$SO_2$—, —O—; preferably a substituted or unsubstituted alkylene or alkylidene group having from 1 to 30 carbon atoms, such as methylene or ethylidene). When n or m is 2, then plural $R_{a4}$'s or $R_{a5}$'s may be the same or different.

Of compounds of formula (IV), preferred are those of the following general formula (A-I):

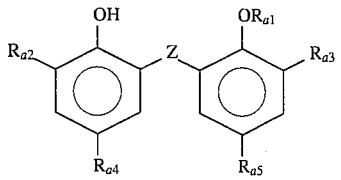

(A-I)

wherein $R_{a1}$, $R_{a2}$, $R_{a3}$, $R_{a4}$, $R_{a5}$ and Z have the same meanings as those in formula (IV).

In view of the effect of the present invention, $R_{a1}$ is preferably a hydrogen atom or an aliphatic group, especially preferably a hydrogen atom.

Also in view of the effect of the present invention, $R_{a2}$, $R_{a3}$, $R_{a4}$, and $R_{a5}$ are preferably alkyl groups, especially preferably those having a hydrogen atom at the 1-position. Most preferably, they are methyl groups.

Also in view of the effect of the present invention, Z is preferably an alkylidene group, more preferably —$C(R_{a6})_2$—X (Two groups of $R_{a6}$ are the same or different each other). $R_{a6}$ is a hydrogen atom or an alkyl group (this may have substituent(s) and preferably has from 1 to 30 carbon atoms, e.g., methyl, ethyl, i-propyl, s-butyl, 2,4,4-trimethylpentyl, undecyl, 2,4-di-pentylphenoxymethyl, cyclohexyl, benzyl). In view of the effect of the present invention, $R_{a6}$ is preferably an alkyl group, more preferably a branched alkyl group.

Specific examples of these compounds are mentioned below, which, however, are not intended to restrict the scope of the present invention.

(A-1)

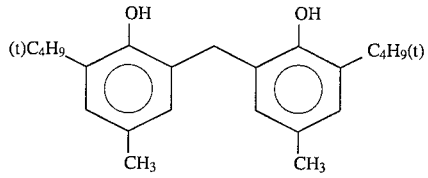

(A-2)

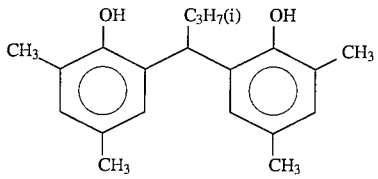

(A-3)

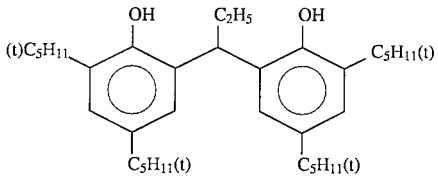

(A-4)

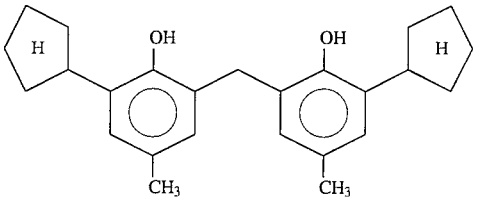

(A-5)

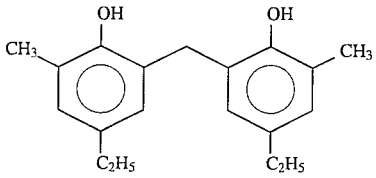

(A-6)

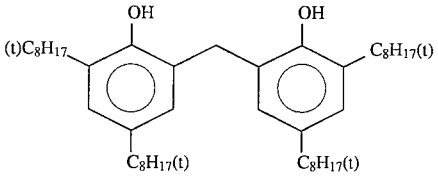

(A-7)

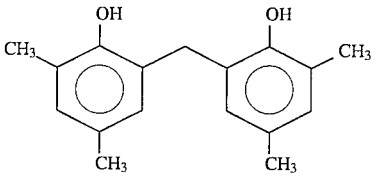

(A-8)

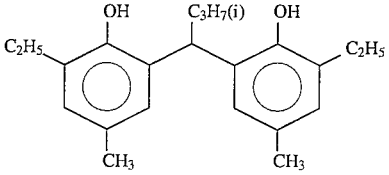

(A-9)

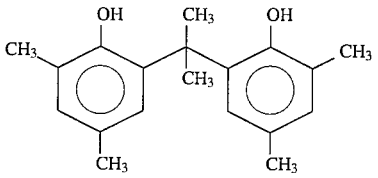

(A-10)

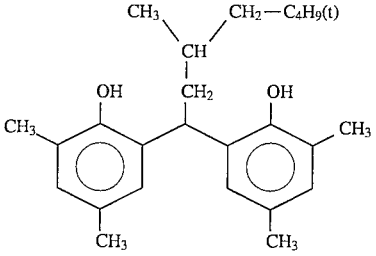

(A-11)

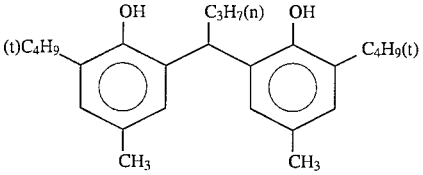

(A-12)

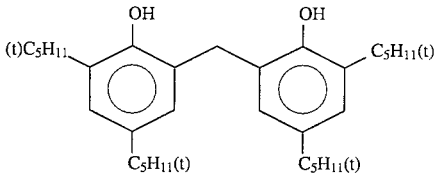

(A-13)

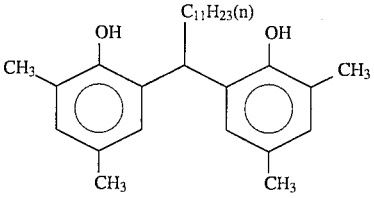

(A-14)

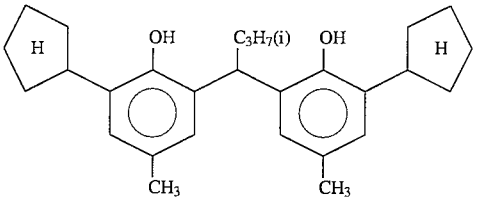

-continued
(A-15)
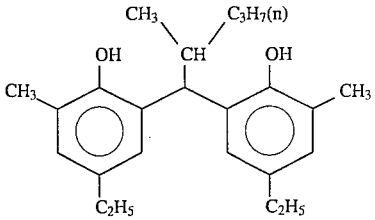
(A-16)
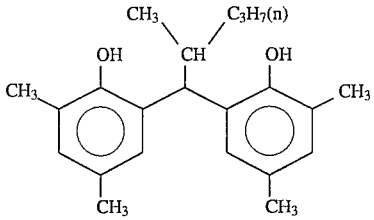
(A-17)
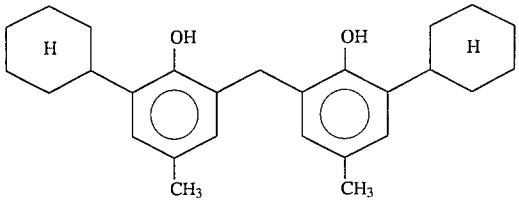
(A-18)
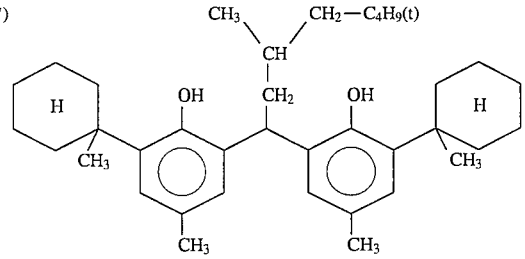
(A-19)
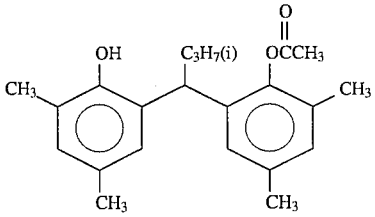
(A-20)
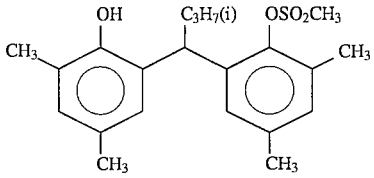
(A-21)
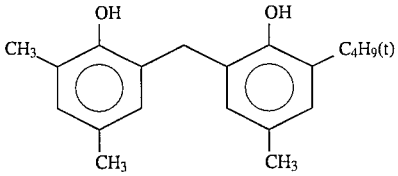
(A-22)
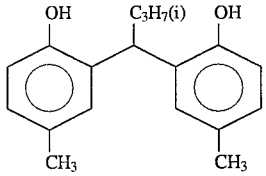
(A-23)
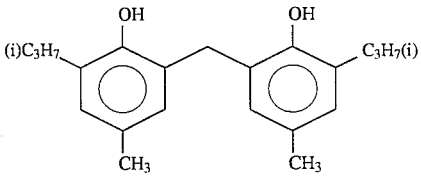
(A-24)
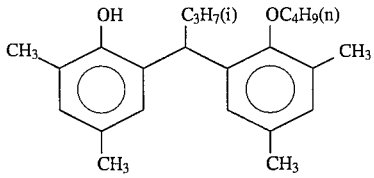
(A-25)
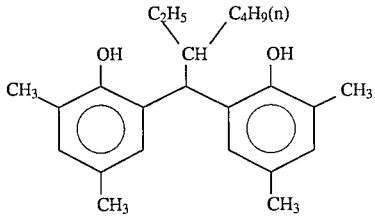
(A-26)
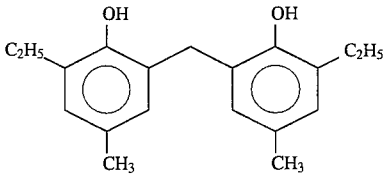
(A-27)
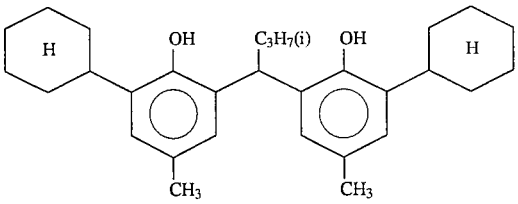
(A-28)
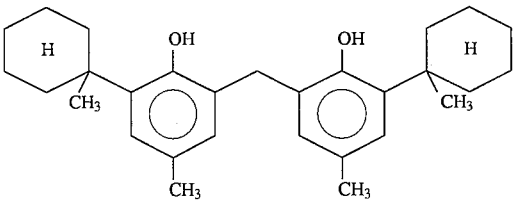

-continued
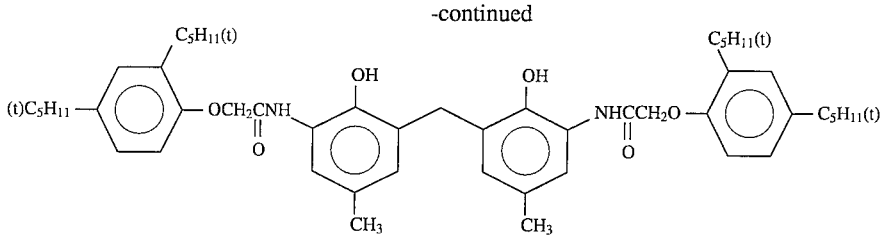
(A-29)
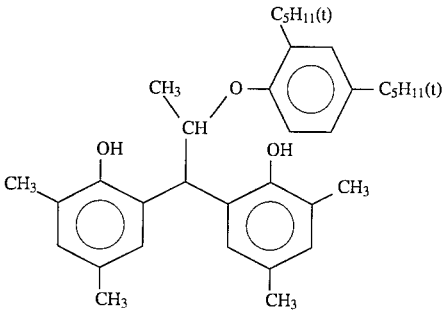
(A-30)
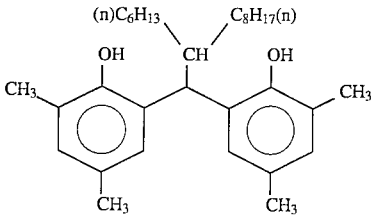
(A-31)
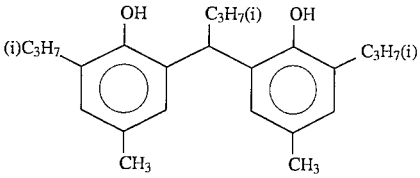
(A-32)
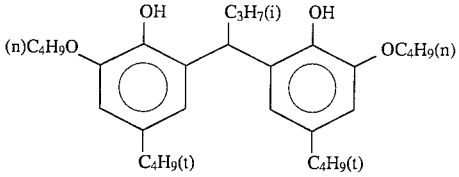
(A-33)
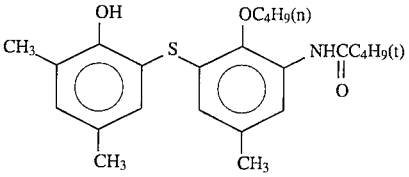
(A-34)
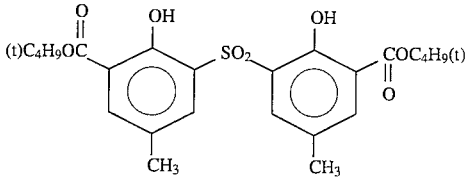
(A-35)
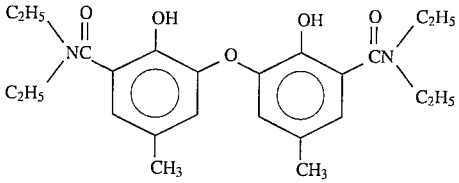
(A-36)
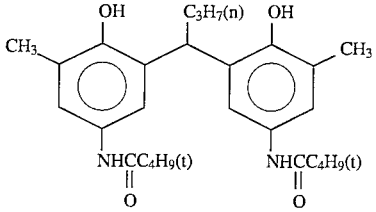
(A-37)
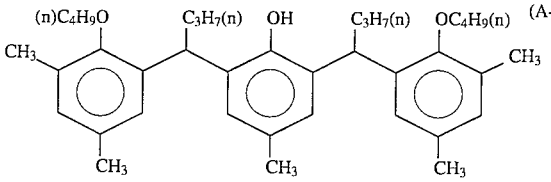
(A-38)
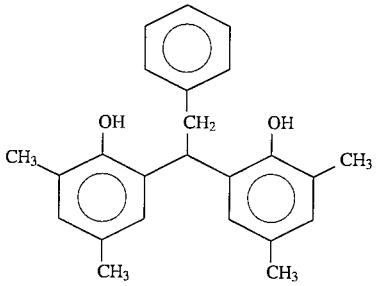
(A-39)
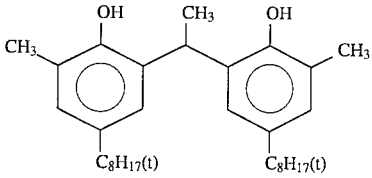
(A-40)
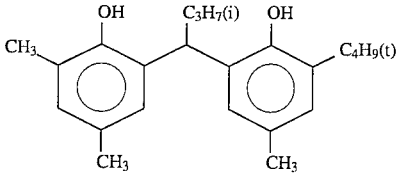
(A-41)

-continued (A-42)

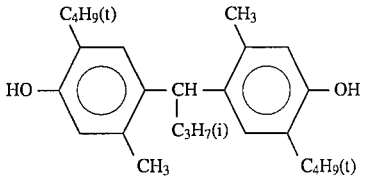

(A-43)

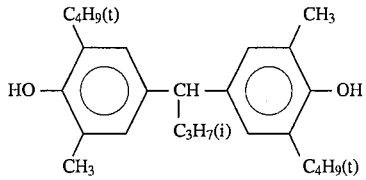

(A-44)

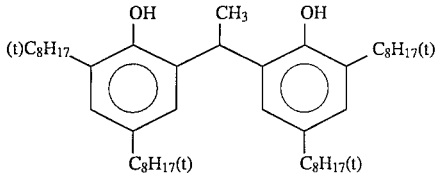

(A-45)

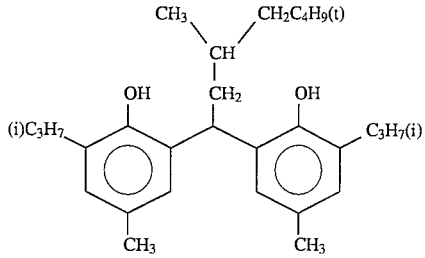

(A-46)

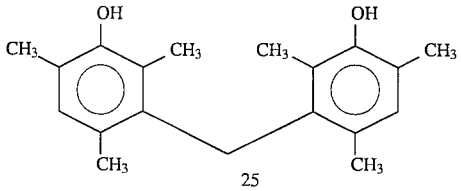

Compounds of formula (IV) for use in the present invention can be produced by the methods described in JP-A 62-262047 and 4-340960 or according to them.

The amount of the compound of formula (IV) to be in the photographic material of the present invention varies, depending on the kind and the amount of the coupler(s) to be in the material along with the compound. Suitably, the amount is from 0.5 to 300 mol %, preferably from 1 to 200 mol %, relative to one mol of the coupler of formulae (I), (II) and (III) used along with the compound.

Next, compounds of formula (V) for use in the present invention are mentioned in detail hereunder.

In formula (V), $R_{b1}$, $R_{b2}$, $R_{b3}$, $R_{b4}$, $R_{b5}$, $R_{b6}$, $Rb_7$ and $R_{b8}$ may be the same or different and each represents a hydrogen atom, an aliphatic group (preferably, an optionally substituted alkyl group having from 1 to 30 carbon atoms, e.g., methyl, i-propyl, t-octyl, benzyl, cyclohexyl, dodecyl, s-butyl, 1,1-dimethyl-4-methoxycarbonylbutyl, 2-phenoxyethyl), an acyl group (this may have substituent(s) and preferably has from 2 to 36 carbon atoms, e.g., acetyl, pivaloyl, dodecanoyl, benzoyl, 3-hexadecyloxybenzoyl), an acylamino group (this may have substituent(s) and preferably has from 2 to 36 carbon atoms, e.g., acetamino, pivaloylamino, 2-ethylhexanoylamino, 2-(2,4-di-pentylphenoxy)octanoylamino, dodecanoylamino, 3-butoxybenzoylamino), an aliphatic-oxycarbonyl group (preferably, an optionally substituted alkoxycarbonyl group having from 2 to 36 carbon atoms, e.g., methoxycarbonyl, dodecyloxycarbonyl, 2-hexyloxyethoxycarbonyl), an aryloxycarbonyl group (this may have substituent(s) and preferably has from 7 to 42 carbon atoms, e.g., 2,4-di-pentylphenoxycarbonyl, 4-methoxyphenoxycarbonyl), a halogen atom (e.g., fluorine, chlorine, bromine), a sulfonyl group (this may have substituent(s) and preferably has from 1 to 30 carbon atoms, e.g., methanesulfonyl, octanesulfonyl, 4-(4-t-octylphenoxy)butanesulfonyl, 4-dodecyloxybenzenesulfonyl), a carbamoyl group (this may have substituent(s) and preferably has from 2 to 36 carbon atoms, e.g., methylcarbamoyl, diethylcarbamoyl, N-methyl-N-phenylcarbamoyl), a sulfamoyl group (this may have substituent(s) and preferably has from 1 to 30 carbon atoms, e.g., methylsulfamoyl, dibutylsulfamoyl, phenylsulfamoyl), or $—X_b—R_{b9}$. $X_b$ represents —O—, —S— or $—N(R_{b10})—$, A represents a non-metallic atomic group necessary for forming a spiro ring (preferably, an optionally-substituted, 5-membered to 7-membered spiro ring, e.g., 1,1-spiroindane, 2,2-spirochroman) or a bicyclic ring (preferably, an optionally-substituted, 5-membered to 7-membered bicyclic ring, e.g., benzofuro(3,2-b)benzofuran). $R_{b9}$ and $R_{b10}$ may be the same or different and each represents an aliphatic group (preferably, an optionally substituted alkyl group having from 1 to 30 carbon atoms, e.g., methyl, i-propyl, benzyl, cyclohexyl, dodecyl, s-butyl, 2-phenoxyethyl). Two of $R_{b1}$ to $R_{b8}$, which are ortho-positioned each other, may be bonded each other to form a 5-membered to 8-membered ring which may have substituent(s). Examples of the ring include a coumaran ring, a chroman ring, an indane ring, an indene ring, a quinoline ring, etc. $R_{b9}$ and $R_{b10}$ may be bonded to each other to form a 5-membered to 7-membered ring which may have substituent(s). Examples of the ring include a 4-morpholine ring, a 1-piperidine ring, a 1-pyrrolidine ring. etc. At least one of $R_{b1}$ to $R_{b4}$ and at least one of $R_{b5}$ to $R_{b8}$ are the same or different $—X_b—R_{b9}$.

In view of the effect of the present invention, $R_{b9}$ and $R_{b10}$ are preferably alkyl groups.

Also in view of the effect of the present invention, $R_{b1}$ to $R_{b8}$ each are preferably a hydrogen atom, an alkyl group, an acylamino group or $—X_b—R_{b9}$.

Also in view of the effect of the present invention, compounds of the following general formulae (B-I) to (B-V) are more preferred.

(B-I)

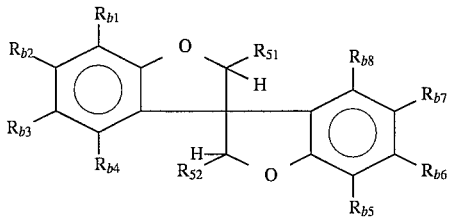

-continued

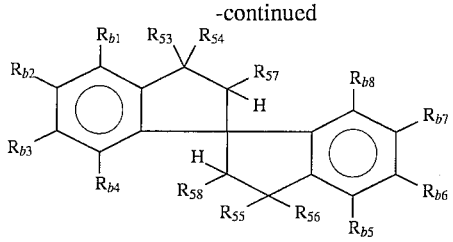

(B-II)

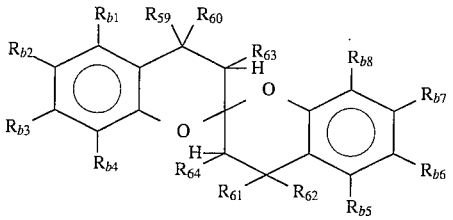

(B-III)

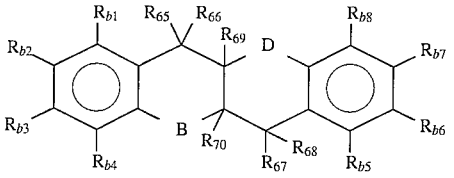

(B-IV)

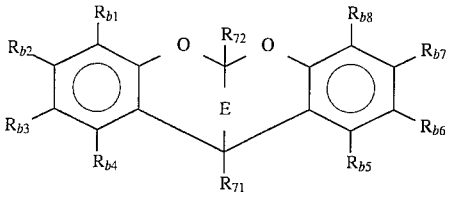

(B-V)

In formulae (B-I) to (B-V), $R_{b1}$ to $R_{b10}$ and $X_b$ have the same meanings as those in formula (V).

$R_{51}$ to $R_{72}$ may be the same or different and each represents a hydrogen atom, an alkyl group (this may have substituent(s) and preferably has from 1 to 20 carbon atoms, e.g., methyl, ethyl, i-propyl, dodecyl, benzyl, cyclohexyl), or an aryl group (this may have substituent(s) and preferably has from 6 to 26 carbon atoms, phenyl, 4-methylphenyl). B and D each represent a single bond, —$C(R_{80})(R_{81})$— or —O—; E represents a single bond or —$C(R_{80})(R_{81})$—. $R_{80}$ and $R_{81}$ may be the same or different and each represents a hydrogen atom, an alkyl group (this may have substituent(s) and preferably has from 1 to 20 carbon atoms, e.g., methyl, ethyl, i-propyl, dodecyl, benzyl), or an aryl group (this may have substituent(s) and preferably has from 6 to 26 carbon atoms, e.g., phenyl, 4-methylphenyl).

In view of the effect of the present invention, $R_{51}$ to $R_{72}$ each are preferably a hydrogen atom or an alkyl group.

Also in view of the effect of the present invention, $R_{b3}$ and $R_{b7}$ in formula (B-I) are preferably the same or different —$X_b$—$R_{b9}$ and more preferably both $R_{b3}$ and $R_{b7}$ are —$X_b$—$R_{b9}$.

Also in view of the effect of the present invention, $R_{b1}$, $R_{b4}$, $R_{b5}$ and $R_{b8}$ in formula (B-II) are preferably the same or different —$X_b$—$R_{b9}$ and more preferably all of $R_{b1}$, $R_{b4}$, $R_{b5}$ and $R_{b8}$ are —$X_b$—$R_{b9}$.

Also in view of the effect of the present invention, $R_{b2}$, $R_{b3}$, $R_{b6}$ and $R_{b7}$ in formula (B-II) are preferably the same or different —$X_b$—$R_{b9}$ and more preferably all of $R_{b2}$, $R_{b3}$, $R_{b6}$ and $R_{b7}$ are —$X_b$—$R_{b9}$.

Also in view of the effect of the present invention, $R_{b2}$ and $R_{b6}$ in formula (B-III) are preferably the same or different —$X_b$—$R_{b9}$ and more preferably $R_{b2}$ and $R_{b6}$ are both —$X_b$—$R_{b9}$.

Also in view of the effect of the present invention, B and D in formula (B-IV) are preferably —O— and $R_{b2}$ and $R_{b6}$ in the same are preferably the same or different —$X_b$—$R_{b9}$ and more preferably both $R_{b2}$ and $R_{b6}$ are —$X_b$—$R_{b9}$.

Also in view of the effect of the present invention, B and D in formula (B-IV) are preferably single bonds and $R_{b1}$, $R_{b4}$, $R_{b5}$ and $R_{b8}$ in the same are preferably the same or different —$X_b$—$R_{b9}$, and more preferably all of $R_{b1}$, $R_{b4}$, $R_{b5}$ and $R_{b8}$ are —$X_b$—$R_{b9}$.

Also in view of the effect of the present invention, B and D in formula (B-IV) are preferably single bonds and $R_{b2}$, $R_{b3}$, $R_{b6}$ and $R_{b7}$ in the same are preferably the same or different —$X_b$—$R_{b9}$ and more preferably all of $R_{b2}$, $Rb_3$, $R_{b6}$ and $R_{b7}$ are —$X_b$—$R_{b9}$.

Also in view of the effect of the present invention, $R_{b3}$ and $R_{b6}$ in formula (B-V) are preferably the same or different —$X_b$—$R_{b9}$ and more preferably both $R_{b3}$ and $R_{b6}$ are —$X_b$—$R_{b9}$.

Of compounds of formulae (B-I) to (B-V), preferred are those of formulae (B-II), (B-IV) and (B-V), more preferred are those of formulae (B-II) and (B-IV) and most preferred are those of formula (B-II), in view of the effect of the present invention.

Specific examples of compounds of formula (V) for use in the present invention are mentioned below, which, however, are not intended to restrict the scope of the present invention.

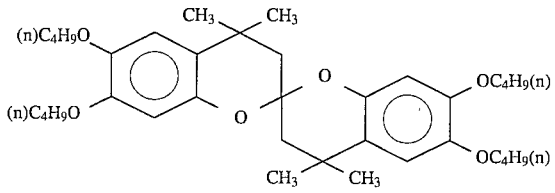

(B-1)

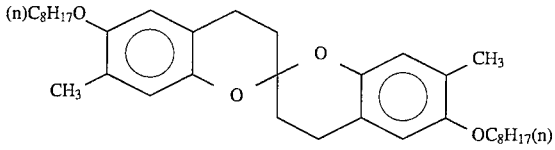

(B-2)

-continued
(B-3)
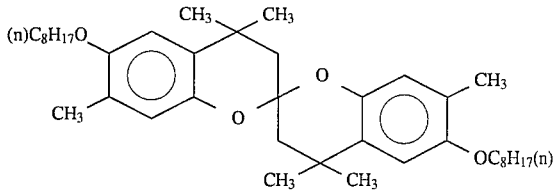
(B-4)
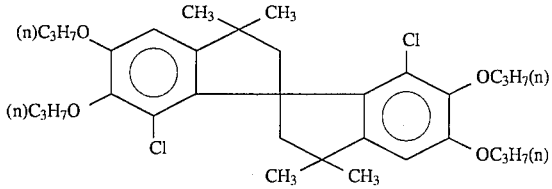
(B-5)
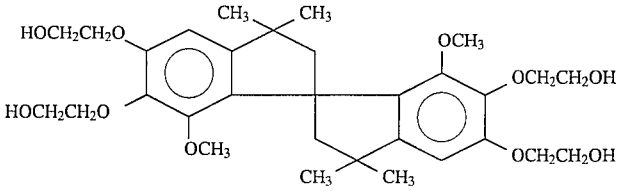
(B-6)
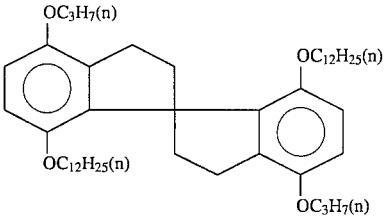
(B-7)
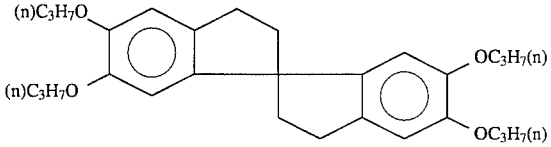
(B-8)
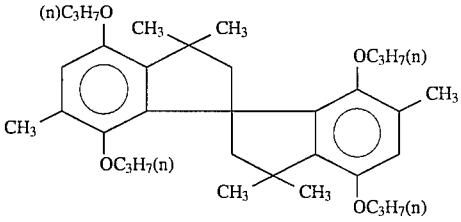
(B-9)
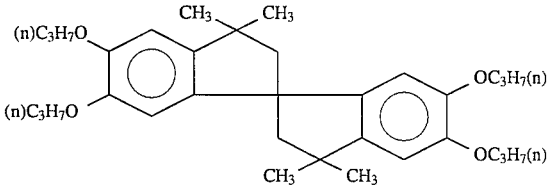
(B-10)
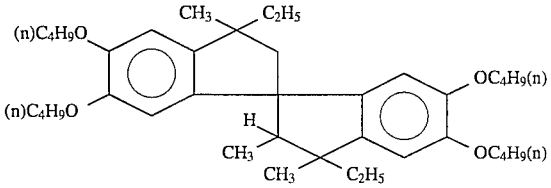

-continued
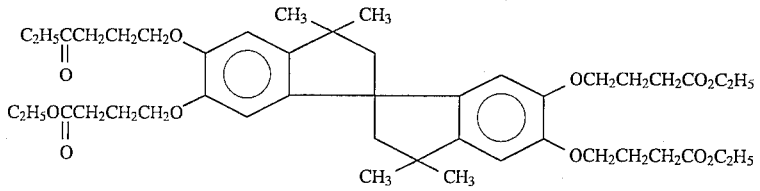
(B-11)
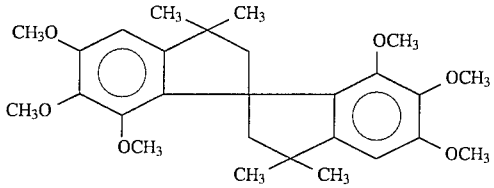
(B-12)
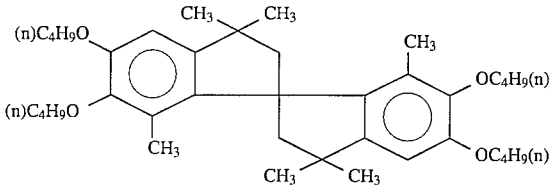
(B-13)
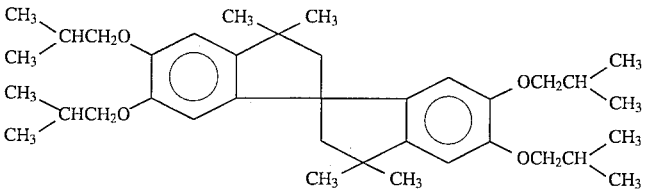
(B-14)
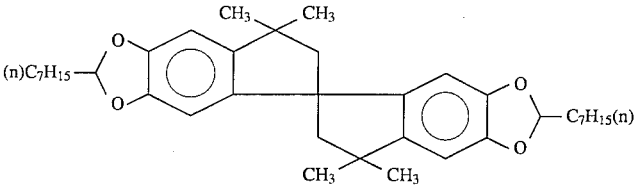
(B-15)
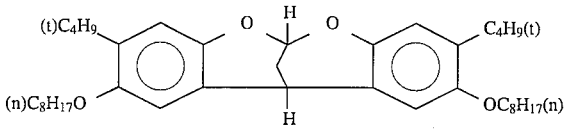
(B-16)
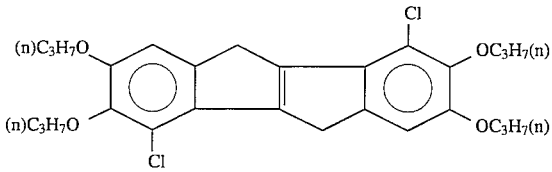
(B-17)
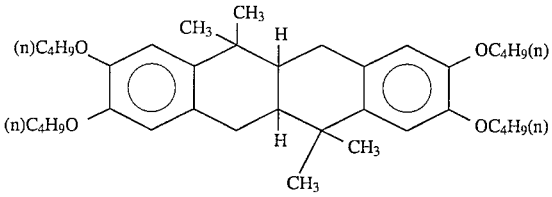
(B-18)
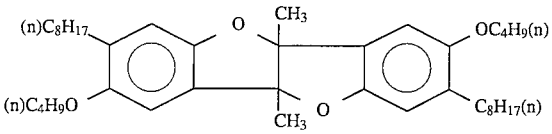
(B-19)

-continued (B-20)

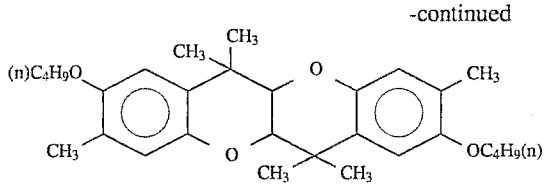

(B-21)

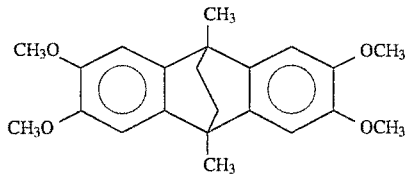

(B-22)

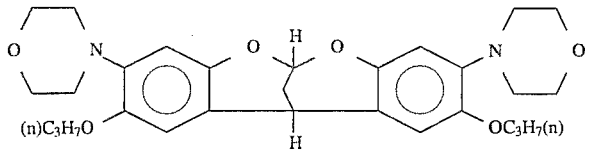

(B-23)

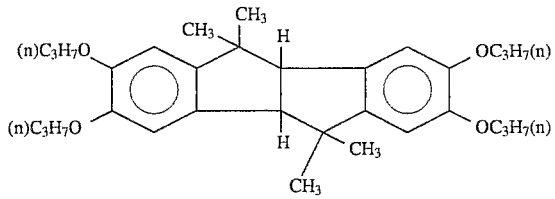

(B-24)

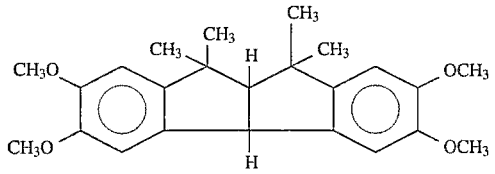

(B-25)

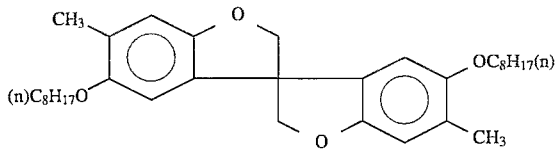

(B-26)

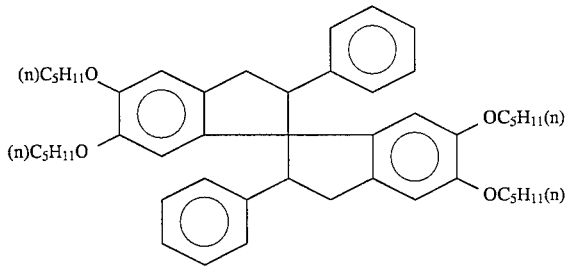

These compounds can be produced by the methods described in JP-A 56-159644, 62-244045, 62-244246, 62-273531, 63-95439, EP 239,972, and JP-A 4-330440 or according to them.

The amount of the compound of formula (V) to be in the photographic material of the present invention varies, depending on the kind and the amount of the yellow coupler(s) to be in the material along with the compound. Suitably, the amount is from 0.5 to 300 mol %, preferably from 1 to 200 mol %, most preferably from 1 to 100 mol %, relative to one mol of the coupler of formulae (I), (II) and (III) used along with the compound.

The ratio of the compound of formula (IV) to the compound of formula (V) to be in the photographic material of the present invention is preferably approximately from 0.5/1 to 2/1 by mol.

The yellow coupler-containing layer in the photographic material of the present invention may contain a polymer. As the polymer, usable are those described in International Patent Laid-Open No. WO88/00723 and JP-A 63-44658.

The polymer may be any of water-insoluble polymers. Above all, preferred are vinyl polymers and polyester polymers having —(C=O)— bonds in the repeating units, as they are effective in preventing cyan colors from being turbid.

Two or more different vinyl monomers are copolymerized to form copolymers for use in the present invention, depending on the properties (e.g., solubilizing property) of the resulting copolymers. In order to control the coloring property and the solubility of the coupler along with the copolymer according to the present invention, copolymers to be prepared by copolymerizing comonomers having acid group(s) can be used as far as the copolymers are not soluble in water. If desired, two or more crosslinkable, ethylenic unsaturated monomers may also be copolymerized to prepare copolymers for use in the present invention. As preferred monomers, for example, mentioned are those described in JP-A 60-151636.

Where hydrophilic vinyl monomers (which are homopolymerized to give water-soluble homopolymers) are used to prepare copolymers for use in the present invention, the proportion of such hydrophilic vinyl monomers in the resulting copolymers is not specifically defined as far as the copolymers are not soluble in water. In general, however, the proportion is preferably 40 mol % or less, more preferably 20 mol % or less, especially preferably 10 mol % or less. Where the hydrophilic comonomers to be copolymerized to form copolymers for use in the present invention have acid group(s), the proportion of such hydrophilic comonomers in the resulting copolymers is generally 20 mol % or less, preferably 10 mol % or less, in view of the storability of the color image to be formed on the photographic material. Most preferably, however, such hydrophilic comonomers having acid group(s) are not used in preparing copolymers for use in the present invention.

Monomers preferably used in preparing polymers for use in the present invention are methacrylates, acrylamides and methacrylamides. Especially preferred are acrylamides and methacrylamides.

The number average molecular weight of the polymers for use in the present invention is preferably from 5,000 to 150,000, more preferably from 10,000 to 100,000.

The water-insoluble polymers for use in the present invention are such that the solubility of the polymer in 100 g of distilled water (at 25° C.) is 3 g or less, preferably 1 g or less. It is desirable that the water-insoluble polymers for use in the present invention are soluble in organic solvents.

Some specific examples of polymers usable in the present invention are mentioned below, which, however, are not limitative. The ratio of the comonomers constituting the copolymers mentioned below is by mol.

P-1) Polymethyl methacrylate

P-2) Polyethyl methacrylate

P-3) Polyisopropyl methacrylate

P-4) Polymethyl chloroacrylate

P-5) Poly(2-tert-butylphenyl acrylate)

P-6) Poly(4-tert-butylphenyl acrylate)

P-7) Ethyl methacrylate/n-butyl acrylate copolymer (70/30)

P-8) Methyl methacrylate/acrylonitrile copolymer (65/35)

P-9) Methyl methacrylate/styrene copolymer (90/10)

P-10) N-tert-butylmethacrylamide/methyl methacrylate/acrylic acid copolymer (60/30/10)

P-11) Methyl methacrylate/styrene/vinylsulfonamide copolymer (70/20/10)

P-12) Methyl methacrylate/cyclohexyl methacrylate copolymer (50/50)

P-13) Methyl methacrylate/acrylic acid copolymer (95/5)

P-14) Methyl methacrylate/n-butyl methacrylate copolymer (65/35)

P-15) Methyl methacrylate/N-vinyl-2-pyrrolidone copolymer (90/10)

P-16) Poly(N-sec-butylacrylamide)

P-17) Poly(N-tert-butylacrylamide)

P-18) Cyclohexyl methacrylate/methyl methacrylate copolymer (60/40)

P-19) N-butyl methacrylate/methyl methacrylate/acrylamide copolymer (20/70/10)

P-20) Diacetoneacrylamide/methyl methacrylate copolymer (20/80),

P-21) N-tert-butylacrylamide/methyl methacrylate copolymer (40/60)

P-22) Poly(N-n-butylacrylamide)

P-23) Tert-butyl methacrylate/N-tert-butylacrylamide copolymer (50/50)

P-24) Tert-butyl methacrylate/methyl methacrylate copolymer (70/30)

P-25) Poly(N-tert-butylacrylamide)

P-26) N-tert-butylacrylamide/methyl methacrylate copolymer (60/40)

P-27) Methyl methacrylate/acrylonitrile copolymer (70/30)

P-28) Methyl methacrylate/styrene copolymer (75/25)

P-29) Methyl methacrylate/hexyl methacrylate copolymer (70/30)

P-30) Poly(4-biphenyl acrylate)

P-31) Poly(2-chlorophenyl acrylate)

P-32) Poly(4-chlorophenyl acrylate)

P-33) Poly(pentachlorophenyl acrylate)

P-34) Poly(4-ethoxycarbonylphenyl acrylate)

P-35) Poly(4-methoxycarbonylphenyl acrylate)

P-36) Poly(4-cyanophenyl acrylate)

P-37) Poly(4-methoxyphenyl acrylate)

P-38) Poly(3,5-dimethyladamantyl acrylate)

P-39) Poly(3-dimethylaminophenyl acrylate)

P-40) Poly(2-naphthyl acrylate)

P-41) Poly(phenyl acrylate)

P-42) Poly(N,N-dibutylacrylamide)

P-43) Poly(isohexylacrylamide)

P-44) Poly(isooctylacrylamide)

P-45) Poly(N-methyl-N-phenylacrylamide)

P-46) Poly(adamantyl methacrylate)

P-47) Poly(sec-butyl methacrylate)

P-48) N-tert-butylacrylamide/acrylic acid copolymer (97/3)

P-49) Poly(2-chloroethyl methacrylate)

P-50) Poly(2-cyanoethyl methacrylate)

P-51) Poly(2-cyanomethylphenyl methacrylate)

P-52) Poly(4-cyanophenyl methacrylate)

P-53) Poly(cyclohexyl methacrylate)

P-54) Poly(2-hydroxypropyl methacrylate)

P-55) Poly(4-methoxycarbonylphenyl methacrylate)

P-56) Poly(3,5-dimethyladamantyl methacrylate)

P-57) Poly(phenyl methacrylate)

P-58) Poly(4-butoxycarbonylphenylmethacrylamide)

P-59) Poly(4-carboxyphenylmethacrylamide)

P-60) Poly(4-ethoxycarbonylphenylmethacrylamide)

P-61) Poly(4-methoxycarbonylphenylmethacrylamide)

P-62) Poly(cyclohexyl chloroacrylate)

P-63) Poly(ethyl chloroacrylate)

P-64) Poly(isobutyl chloroacrylate)

P-65) Poly(isopropyl chloroacrylate)

P-66) Poly(phenylacrylamide)

P-67) Poly(cyclohexylacrylamide)

P-68) Poly(phenylmethacrylamide)

P-69) Poly(cyclohexylmethacrylamide)

P-70) Poly(butylene adipate)

To disperse photographic additives such as couplers, etc. and water-insoluble polymers, employable are the methods mentioned below. Where polymers are in the form of loadable latexes, photographic additives are dissolved in a water-miscible organic polymer, and the resulting solution is blended with a loadable latex of a water-insoluble polymer whereby said photographic additives are infiltrated into the polymer. (The details of the method are described in U. S. Pat. No. 4,203,716.) Preferably, a polymer which is insoluble in water but is soluble in organic solvents is dissolved in an organic solvent along with photographic additives, and the resulting solution is dispersed and emulsified in a hydrophilic binder such as an aqueous solution of gelatin (optionally in the presence of a surfactant), using a dispersing means such as a stirrer, a homogenizer, a colloid mill, a flow jet mixer, an ultrasonic disperser, etc. (The details of the method are described in U.S. Pat. No. 4,857,499 and International Patent Laid-Open No. W088/00723.)

If desired, monomer components constituting any of the above-mentioned polymers are polymerized in the presence of photographic additives, by suspension polymerization, solution polymerization or bulk polymerization, and the resulting product may be dispersed in a hydrophilic binder in the same manner as mentioned above. (The details of the method are described in JP-A 60-107642).

The amount of the water-insoluble polymer to be in the silver halide color photographic material of the present invention is preferably from 0.01/1 to 2.0/1, more preferably from 0.1/1 to 2.0/1, further more preferably from 0.2/1 to 1.5/1, as the ratio by weight to the coupler of formulae (I), (II) and (III) to be in the light-sensitive layer of the photographic material along with the polymer.

Next, amide compounds of formula (VI) for use in the present invention are mentioned in detail hereunder.

In formula (VI), $R_{17}$, $R_{18}$ and $R_{19}$ each are preferably an alkyl group having from 1 to 36 carbon atoms or an aryl group having from 6 to 36 carbon atoms. These groups may optionally be substituted by substituent(s), for example, selected from a halogen atom, an alkyl group, an alkoxy group, an aryl group, an aryloxy group, an alkylsulfonyl group, an arylsulfonyl group, an alkoxycarbonyl group, a carbamoyl group, etc. Where $R_{18}$ and $R_{19}$ are both alkyl groups, they may be bonded to each other to form a 5-membered to 7-membered ring. The ring may have therein one or more hetero atoms of O, S, N and P. Either one of $R_{18}$ and $R_{19}$ may be a hydrogen atom.

Of compounds of formula (VI), especially preferred are those of the following general formula (VI-A):

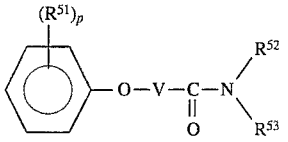

(VI-A)

wherein $R^{51}$ represents a halogen atom (fluorine, chlorine, bromine, iodine), an alkyl group having from 1 to 24 carbon atoms (e.g., methyl, ethyl, iso-propyl, tert-butyl, tert-pentyl, cyclopentyl, cyclohexyl, 1,1,3,3-tetramethylpropyl, n-decyl, n-pentadecyl, tert-pentadecyl), or an alkoxy group having from 1 to 24 carbon atoms (e.g., methoxy, ethoxy, butoxy, octyloxy, benzyloxy, dodecyloxy);

$R^{52}$ and $R^{53}$ each independently represent a hydrogen atom, or an alkyl group having from 1 to 24 carbon atoms (e.g., methyl, ethyl, iso-propyl, tert-butyl, methoxyethyl, benzyl, 2-ethylhexyl, n-hexyl, n-decyl, n-dodecyl);

V represents an alkylene group having from 1 to 24 carbon atoms (e.g., methylene, ethylene, trimethylene, ethylidene, propylidene);

p represents an integer of from 1 to 3, provided that when p is a plural number, plural $R^{51}$'s may be the same or different;

$R^{52}$ and $R^{53}$ may be bonded to each other to form a 5-membered to 7-membered ring, which may have therein at least one or more hetero atoms of O, S, N and P.

Specific examples of amide compounds of formula (VI) are mentioned below, which, however, are not intended to restrict the scope of the present invention.

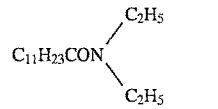

C-1

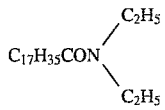

C-2

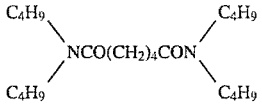

C-3

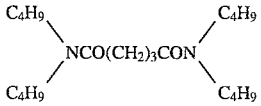

C-4

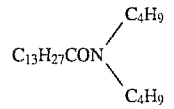

C-5

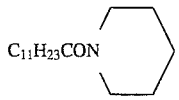

C-6

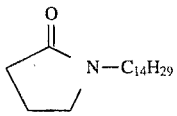

C-7

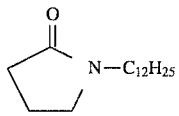

C-8

-continued
C-9
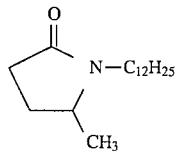
C-10
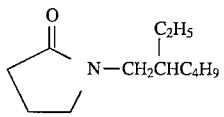
C-11
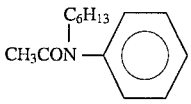
C-12
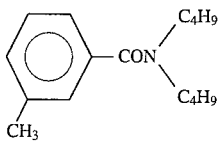
C-13
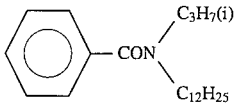
C-14
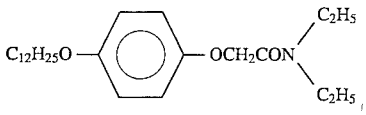
C-15
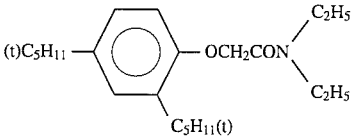
C-16
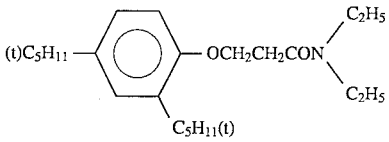
C-17
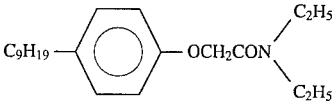
C-18
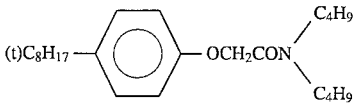
C-19
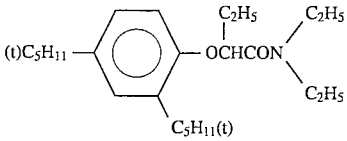
C-20
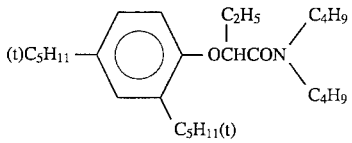
C-21
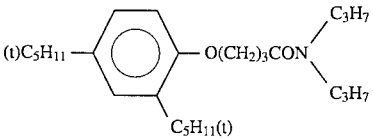
C-22
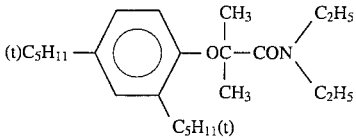
C-23
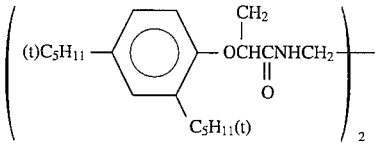
C-24
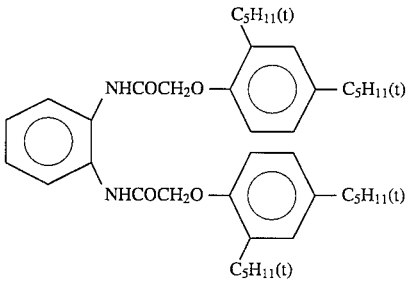
C-25
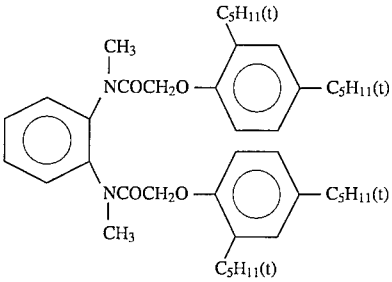
C-26
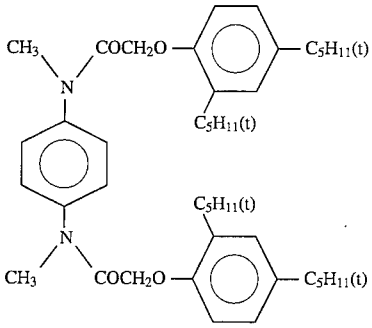

-continued

C-27

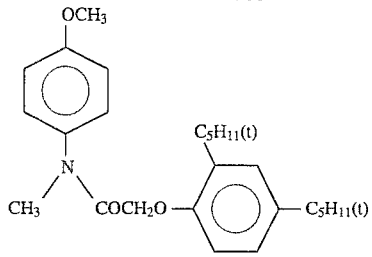

C-28

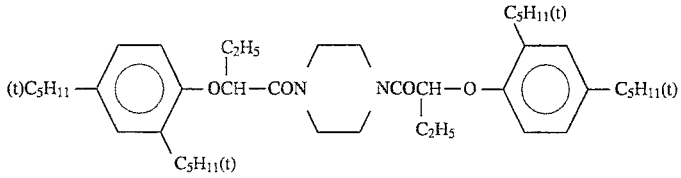

C-29

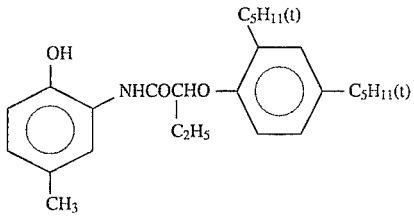

C-30

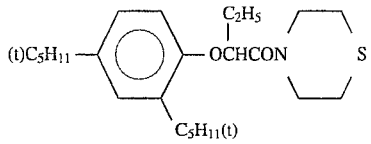

C-31

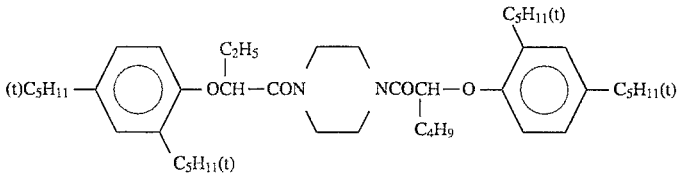

C-32

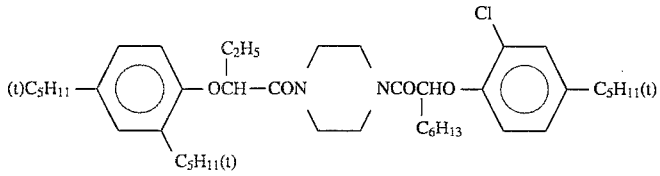

These amide compounds can be produced by known methods. For instance, these can be produced by condensing a carboxylic acid anhydride or chloride and an amine. Specific examples of producing these are described in, for example, JP-B 58-25260, JP-A 62-254149 and U.S. Pat. No. 4,171,975.

It is desirable that the compound of formula (VI) is dissolved in a high boiling point organic solvent and an auxiliary solvent along with couplers and the resulting solution is emulsified and dispersed in gelatin. The amount of the compound of formula (VI) to be added to the coupler-containing layer in the photographic material of the present invention may be from 1 to 200% by weight, preferably from 5 to 100% by weight, more preferably from 10 to 50% by weight, relative to the amount of the coupler to be in the layer.

As the silver halide grains for use in the present invention, preferred are silver chloride, silver chlorobromide or silver chloroiodobromide grains having a silver chloride content of 95 mol % or more. Especially preferred are silver chlorobromide or silver chloride grains substantially not containing silver iodide, in order to accelerate the developing time for processing the photographic material. Silver halide grains substantially not containing silver iodide as referred to herein means those having a silver iodide content of 1 mol % or less, preferably 0.2 mol % or less. On the other hand, in order to increase the high intensity sensitivity, to increase the color-sensitized sensitivity or to improve the storage stability of the photographic material, high-silver chloride grains containing from 0.01 to 3 mol % of silver iodide on their surfaces, such as those described in JP-A 3-84545 are also preferably used, as the case may be. Regarding the halogen composition of grains of constituting an emulsion for use in the present invention, the grains may have different halogen compositions. However, when the emulsion contains grains each having the same halogen composition, the property of the grains may easily be homogenized. Regarding the halide composition distribution of the grains of constituting a silver halide emulsion for use in the present invention, the grain may have a so-called uniform halogen composition structure where any part of the grain has the same halogen composition; or the grain may have a so-called laminate (core/shell) structure where the halogen composition of the core of the grain is different from that of the shell of the same; or the grain may have a composite halogen composition structure where the inside or surface of the grain has a non-layered different halogen composition part (for example, when such a non-layered different halogen composition part is on the surface of the grain, it may be on the edge, corner or plane of the grain as a conjugated structure). Any of such halogen compositions may properly be selected. In order to obtain a high sensitivity photographic material, the latter laminate or composite halogen composition structure grains are advantageously employed, rather than the first uniform halogen composition structure grains. Such laminate or composite halogen composition structure grains are also preferred for preventing generation of pressure marks. In the case of laminate or composite halogen composition structure grains, the boundary between the different halogen composition parts may be a definite one or may also be an indefinite one of forming a mixed crystal structure because of the difference in the halogen compositions between the adjacent parts. If desired, the boundary between them may positively have a continuous structure variation.

The high-silver chloride grains for use in the present invention are preferably those having layered or non-layered, localized phases of silver bromide (silver bromide-rich localized phase) in the inside and/or on the surface of the silver halide grain, in the manner as mentioned above. The halide composition in the localized phase is preferably such that the phase has a silver bromide content of at least 10 mol %, more preferably higher than 20 mol %. The silver bromide content in the localized phase may be analyzed by X-ray diffraction (for example, described in *Lecture on New Experimental Chemistry,* No. 6, Analysis of Structure, edited by Japan Chemical Society, published by Maruzen Publishing Co.). The localized phase may be in the inside of the grain and/or on the edges, corners and/or planes of the surface of the grain. As one preferred example, mentioned is an embodiment where the localized phase has grown on the corners of the grain by epitaxial growth.

In order to reduce the amount of the replenisher to the developer to be used in processing the photographic material of the present invention, it is effective to further increase the silver chloride content in the silver halide emulsions constituting the material. In this case, preferably used are almost pure silver chloride emulsions having a silver chloride content of from 98 mol % to 100 mol %.

The silver halide grains of constituting the silver halide emulsion of the present invention may have a mean-grain size of preferably from 0.1 μm to 2 μm. (The grain size indicates a diameter of a circle having an area equivalent to the projected area of the grain, and the mean grain size indicates a number average value to be obtained from the measured grain sizes.)

Regarding the grain size distribution of the emulsion, a so-called monodispersed emulsion having a fluctuation coefficient (to be obtained by dividing the standard deviation of the grain size distribution by the mean grain size) of being 20% or less, preferably 15% or less, more preferably 10% or less is preferred. For the purpose of obtaining a broad latitude, two or more monodispersed emulsions may be blended to form a mixed emulsion for one layer, or they may be separately coated to form plural layers. Such blending or separate coating is preferably effected for this purpose.

Regarding the shape of the silver halide grains of constituting the photographic emulsion of the present invention, the grains may be regular crystalline ones such as cubic, tetradecahedral or octahedral crystalline ones, or irregular crystalline ones such as spherical or tabular crystalline ones, or may be composite crystalline ones composed of such regular and irregular crystalline ones. Mixtures of grains having different crystal forms may also be used in the present invention. Of these, preferred are mixtures containing the above-mentioned regular crystalline grains in a proportion of 50% or more, preferably 70% or more, more preferably 90% or more.

Apart from these, silver halide emulsions containing tabular grains having a mean aspect ratio (circle-corresponding diameter/thickness) of 5 or more, preferably 8 or more, in a proportion of 50% or more of the total grains in terms of their projected areas are also preferably used in the present invention.

The silver (bromo)chloride emulsions for use in the present invention may be prepared, for example, by the methods described in P. Glafkides, *Chemie et Phisique Photographique* (published by Paul Montel, 1967); G. F. Duffin, *Photographic Emulsion Chemistry* (published by Focal Press, 1966); and V. L. Zelikman et al., *Making and Coating Photographic Emulsion* (published by Focal Press, 1964). Briefly, they may be prepared by any of acid methods, neutral methods and ammonia methods. As the system of reacting soluble silver salts and soluble halides, employable is any of a single jet method, a double jet method and a combination of them. Also employable is a so-called reversed mixing method where silver halide grains are formed in an atmosphere having excess silver ions. As one system of a double jet method, employable is a so-called controlled double jet method, in which the pAg in the liquid phase where silver halide grains are being formed is kept constant. According to this method, silver halide emulsions comprising regular crystalline grains having nearly uniform grain sizes may be obtained.

It is preferred that the localized phase or the base of the silver halide grain of the present invention contains heterologous metal ions or complex ions. As preferred metal ions for this use, mentioned are metal ions belonging to the Group VIII and the Group IIb of the Periodic Table and their complexes, as well as lead ion and thallium ion. Specifically, the localized phase may contain ions chosen from among iridium ion, rhodium ion and iron ions and their complex ions while the base may contain ions chosen from among osmium ion, iridium ion, rhodium ion, platinum ion, ruthenium ion, palladium ion, cobalt ion, nickel ion and iron ion and their complex ions, optionally as combined. The localized phase and the base in one grain may have different contents of different metal ions. They may contain a plurality of such metal ions and complex ions. In particular, it is preferred that the localized phase of silver bromide contains iron and iridium compounds.

Compounds donating such metal ions may be incorporated into the localized phase and/or the other part (base) of the silver halide grains of the present invention, for example, by adding the compound to an aqueous gelatin solution which is to be a dispersing medium, or to an aqueous halide solution, an aqueous silver salt solution or other aqueous solutions at the step of forming the silver halide grains, or in the form of fine silver halide grains containing the metal ions which are dissolved in the system from which the silver halide grains are formed.

The incorporation of the metal ions into the silver halide grains of the present invention may be effected before, during or just after the formation of the grains. The time when the incorporation is effected may be determined, depending on the position of the grain into which the metal ion shall be incorporated.

The silver halide emulsions for use in the present invention is generally subjected to chemical sensitization and color sensitization.

The chemical sensitization includes, for example, chalcogen sensitization using a chalcogen sensitizing agent (such as typically sulfur sensitization using unstable sulfur compounds, selenium sensitization using selenium compounds, tellurium sensitization using tellurium compounds), noble metal sensitization (such as typically gold sensitization) and reduction sensitization, which may be employed singly or as combined. As the compounds to be used for such chemical sensitization, for example, preferred are those described in JP-A 62-215272, from page 18, right lower column to page 22, right upper column.

To more effectively attain the effect of the present invention, gold-sensitized, high-silver chloride emulsions are used in the present invention.

The emulsions to be used in the present invention are so-called surface latent-type emulsions which form latent images essentially on the surfaces of the grains.

The silver halide emulsions for use in the present invention may contain various compounds or precursors, for the purpose of preventing the photographic material from being fogged during preparation, storage or photographic processing of the material and of stabilizing the photographic properties of the material. Specific examples of such compounds which are preferably used in the present invention are described in the above-mentioned JP-A 62-215272, pages 39 to 72. In addition, the 5-arylamino-1,2,3,4-thiatriazole compounds (where the aryl residue has at least one electron-attracting group) described in EP 0447647 are also preferably used in the present invention.

The color sensitization is effected so as to make the emulsions of the layers constituting the photographic material of the present invention sensitive to light falling within a desired wavelength range.

For the color sensitization, used are color-sensitizing dyes effective in making photographic emulsions sensitive to blue, green and red ranges. Such are described in, for example, F. M. Harmer, Heterocyclic Compound—Cyanine Dyes and Related Compounds (John Wiley 7 Sons, New York, London, 1964). Specific examples of color-sensitizing compounds as well as color-sensitizing methods which are preferably employed in the present invention are described in, for example, the above-mentioned JP-A 62-215272, from page 22, right upper column to page 38. In particular, the color-sensitizing dyes described in JP-A 3-123340 are especially preferred as red-sensitizing dyes to be applied to silver halide grains having a high silver chloride content, in view of the high stability of the dyes themselves, the high intensity of adsorption of the dyes to silver halide grains, and the low temperature dependence of the dyes during exposure of photographic materials.

Where the photographic material of the present invention is desired to be made highly sensitive to infrared range, preferably used are the sensitizing dyes described in JP-A 3-15049, from page 12, left upper column to page 21, left lower column; JP-A 3-20730, from page 4, left lower column to page 15, left lower column; EP 0420011, from page 4, line 21 to page 6, line 54; EP 0420012, from page 4, line 12 to page 10, line 33; and EP 0443466, U.S. Pat. No. 4,975,362.

To incorporate these color-sensitizing dyes into the silver halide emulsions of the present invention, for example, they may be directly dispersed thereinto, or alternatively, they are first dissolved in a single solvent such as water, methanol, ethanol, propanol, methyl cellosolve, 2,2,3,3-tetrafluoropropanol, etc. or a mixed solvent comprising them, and thereafter the resulting solution may be added to the emulsions. Apart from these cases, the dyes are formed into aqueous solutions in the presence of acids or bases in the manner such as that described in JP-B 44-23389, 44-27555, 57-22089, or are formed into aqueous solutions or colloidal dispersion in the presence of surfactants in the manner such as that described in U.S. Pat. Nos. 3,822,135, 4,006,025, and the resulting solutions or dispersions may be added to the emulsions. Also, they are first dissolved in solvents which are substantially immiscible with water, such as phenoxyethanol, etc. and then dispersed in water or hydrophilic colloids, and the resulting dispersions may be added to the emulsions. Also, they are directly dispersed into hydrophilic colloids in the manner such as that described in JP-A 53-102733, 58-105141, and the resulting dispersions may be added to the emulsions. Anyhow, the color-sensitizing dyes may be added to the emulsions at any time when the emulsions are prepared and which has heretofore been known acceptable. In other words, the time when the dyes are added to the emulsions may be any of before or during formation of the silver halide grains, immediately after formation of them and before rinsing them, before or during chemical sensitization of them, immediately after chemical sensitization of them and before cooling and solidifying them, and during preparation of coating compositions. More generally, the dyes are added to the emulsions after chemical sensitization of the emulsions and before coating them. If desired, however, the dyes may be added to the emulsions along with chemically-sensitizing dyes so as to effect the color sensitization and the chemical sensitization of the emulsions at the same time, in the manner such as that described in U.S. Pat. Nos. 3,628,969, 4,225,666; or the dyes may be added to the emulsions prior to the chemical sensitization of the emulsions in the manner such as that described in JP-A 58-113928; or the color sensitization of the emulsions may be started before the completion of the formation of precipitates of silver halide grains. In addition, it is also possible to divide the color-sensitizing dye to be added into plural parts, which are added to the emulsions at several times, in the manner such as that taught by U.S. Pat. No. 4,225,666. According to the process, a part of the color-sensitizing dye is added to the emulsions prior to the chemical sensitization of them and the remaining part thereof is added thereto after the chemical sensitization. The addition of the color-sensitizing dyes to the photographic emulsions may be effected at any time when the silver halide grains are formed, for example, in accordance with the process taught by U.S. Pat. No. 4,183,756. Of the above-mentioned methods, especially preferred is the method where the dyes are added to the emulsions before the step of rinsing the emulsions or before the step of chemically sensitizing them.

The amount of the color-sensitizing dye to be added varies in a broad range, depending on the case of using it. Preferred is the range of from $0.5\times10^{-6}$ mol to $1.0\times10^{-2}$ mol, more preferably from $1.0\times10^{-6}$ mol to $5.0\times10^{-3}$ mol, relative to one mol of the silver halide to which the dye is added.

When the photographic material of the present invention contains color-sensitizing dyes capable of making it sensitive to light falling within a red to infrared range, it is preferred to incorporate into the photographic material the compounds described in JP-A 2-157749, from page 13, right bottom column to page 22, right bottom column, along with the dyes. Using these compounds, the storability of the photographic material, the stability during processing the material and the supercolor-sensitizing effect of the material may be specifically improved. Above all, the compounds of formulae (IV), (V) and (VI) described in said patent publication are especially preferred. The compound is added to the photographic material in an amount of from $0.5\times10^{-5}$ mol to $5.0\times10^{-2}$ mol, preferably from $5.0\times10^{-5}$ mol to $5.0\times10^{-3}$ mol, relative to one mol of the silver halide in the material. The preferred range of the amount of the compound to be added is from 0.1 to 10000 molar times, preferably from 0.5 to molar 5000 times the sensitizing dye to be combined with the compound.

The photographic material of the present invention may be applied to a printing system using an ordinary negative printer. In addition to this, the material is also preferably applied to digital scanning exposure using monochromatic high-density lights such as gas lasers, light-emitting diodes, semiconductor lasers, secondary high-harmonics generating light sources (SHG) comprising a combination of a semiconductor laser or a solid laser where a semiconductor laser is used as an exciting light source and non-linear optical crystals, etc. In order to make the system compact and low-priced, use of semiconductor lasers or secondary high-harmonics generating light sources (SHG) comprising a combination of a semiconductor laser or solid laser and non-linear optical crystals is preferred. In particular, in order to design a low-priced, long-life and highly-safe device, use of semiconductor lasers is preferred, and it is desired to use a semiconductor laser as at least one light source for exposure.

When the above-mentioned light sources for scanning exposure are used, the maximum color sensitivity of the photographic material of the present invention may be freely defined, depending on the wavelength of the light source to be used for scanning exposure of the material. Using SHG light sources to be obtained by combining a solid laser where a semiconductor is used as the exciting light source or a semiconductor and non-linear optical crystals, the oscillating wavelength of the laser may be halved so that blue light and green light may be obtained. Therefore, the maximum color sensitivity of the photographic material to be exposed with such light sources may fall within ordinary ranges of three colors of blue, green and red. When semiconductor lasers are used as light sources so as to make the exposure device low-priced, highly-safe and compact, it is preferred that at least two layers constituting the photographic material to be exposed to them have a maximum color sensitivity at 670 nm or longer. This is because the wavelength range of the light to be emitted by low-priced and stable III–V Groups semiconductor lasers which are available at present is only from red to infrared range. In a laboratory level, however, oscillation of II–VI Groups semiconductor lasers in green to blue range has been confirmed. Therefore, it is surely expected that such semiconductor lasers may be used stably at low costs, after further development of the technique of producing such semiconductor lasers. If so, the necessity of making the photographic material have at least two photographic emulsion layers that have a maximum color sensitivity at 670 nm or longer will be neglected.

In such scanning exposure, the period of time for which the silver halides in the photographic material are exposed means the period of time for which a certain small area of the material is exposed. As the small area, generally used is the minimum unit for which the quantity of light is controlled from the corresponding digital data. The minimum unit is referred to as a pixel. Therefore, the exposure time per pixel shall be varied, depending on the size of pixel. The size of pixel depends on the pixel density, and its actual range is from 50 to 2000 dpi. Where the exposure time is defined to be such that a pixel size having a pixel density of 400 dpi is exposed for the defined time, the preferred exposure time may be $10^{-4}$ second or less, more preferably $10^{-6}$ second or less.

The photographic material of the present invention preferably contains dyes which are decolored by photographic processing, such as those described in EP 0337490A2, pages 27 to 76, especially oxonole dyes or cyanine dyes, in its hydrophilic colloid layers, for the purpose of anti-irradiation and anti-halation and of improving the safety of the material against safelight.

Some of these water-soluble dyes often worsen the color separation of processed photographic materials or the safety thereof against safelight, if their amounts added are increased. As dyes which can be used without worsening the color separation of processed photographic materials, preferred are the water-soluble dyes described in Japanese Patent Application Nos. 3-310143, 3-310189 and 3-310139.

The photographic material of the present invention may have a colored layer, in place of or along with the water-soluble dyes, which may be decolored while the material is processed. The colored layer to be used, which may be decolored while the photographic material is processed, may be kept in direct contact with the emulsion layers or may be disposed in the material in such a way that it is kept in indirect contact with the emulsion layers via an interlayer containing gelatin or a color mixing preventing agent such as hydroquinone. It is preferred that the colored layer is disposed below the emulsion layer which colors to give a primary color of the same kind as the color of the colored layer, nearer to the support than the emulsion layer. It is possible either to dispose the corresponding colored layer below each of all the emulsion layers in accordance with the primary color to be yielded by each emulsion layer or to dispose it below some of those freely selected from the emulsion layers. It is also possible to dispose a colored layer corresponding to plural emulsion layers yielding different colors. It is preferred that the optical reflective density of the colored layer falls from 0.2 to 3.0, more preferably from 0.5 to 2.5, especially preferably from 0.8 to 2.0, at the longest wavelength in the wavelength range of the light to be used for exposing the photographic material. (The wavelength range is the range of visible rays, which is from 400 nm to 700 nm, for ordinary printer exposure, while, for scanning exposure, it corresponds to the wavelength range of the light source to be used for scanning exposure.)

To provide the colored layer in the photographic material of the present invention, any known method may be employed. For instance, employable are a method of incorporating a dispersion of fine grains of a solid dye, such as those described in JP-A 2-282244, from page 3, right top column to page 8 and those described in JP-A 3-7931, from page 3, right upper column to page 11, left lower column, into a hydrophilic colloid layer; a method of mordanting a cationic polymer with an anionic dye; a method of making a dye adsorb to fine grains of silver halides, etc. to thereby fix the dye in the colored layer; and a method of using a colloidal silver such as that described in JP-A 1-239544. As the method of dispersing fine grains of a solid dye into a hydrophilic colloid layer, for example, JP-A 2-308244 has disclosed, on pages 4 to 13, a method of incorporating fine grains of a dye which is substantially insoluble in water at least at pH 6 or lower but is substantially soluble in water at least at pH 8 or higher, into a colloid layer. One example of the method of mordanting a cationic polymer with an anionic dye has been described in JP-A 2-84637, pages 18 to 26. Methods for preparing colloidal silvers, which act as a light-absorbing agent, are disclosed in U.S. Pat. Nos. 2,688,601 and 3,459,563. Of these methods, preferred are the method of incorporating fine dye grains and the method of using a colloidal silver.

As the binder or protective colloid which may be used in the photographic material of the present invention, gelatin is preferred but any other hydrophilic colloid may also be used singly or along with gelatin. As the gelatin, preferred is a low-calcium gelatin having a calcium content of 800 ppm or less, more preferably 200 ppm or less. In order to prevent the growth of various fungi or bacteria, which grow in hydrophilic colloid layers to worsen the image quality of the images to be formed, it is preferred to add an anti-microbial agent such as that described in JP-A 63-271247 to the hydrophilic colloid layers constituting the photographic material of the present invention.

Where the photographic material of the present invention is subjected to printer exposure, it is preferred to use a band-stop filter such as that described in U.S. Pat. No. 4,880,726. Using this, color mixing may be inhibited so that the color reproducibility of the photographic material is noticeably improved.

The exposed photographic material of the present invention is processed according to conventional color development. To rapidly process it, the material is, after having been subjected to color development, preferably blixed. In particular, when the material contains the above-mentioned high-silver chloride emulsions, the pH value of the blixer to be used is preferably about 6.5 or less, more preferably about 6 or less, so as to promote the desilvering of the material.

As silver halide emulsions and other elements (e.g., additives, etc.) of constituting the photographic material of the present invention, photographic layers of constituting the material (e.g., arrangement of layers), and methods of processing the material and additives usable in the processing methods, those described in the following patent publications, especially in European Patent 0,355,660A2 (corresponding to JP-A 2-139544), are preferably employed.

| Photographic Elements | JP-A 62-215272 | JP-A 2-33144 | EP 0,355,660A2 |
|---|---|---|---|
| Silver Halide Emulsions | From page 10, right upper column, line 6 to page 12, left lower column, line 5; and from page 12, right lower column, line 4 up to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 up to page 18, left lower column, last line | — | — |
| Chemical Sensitizers | Page 12, from left lower column, line 3 up to right lower column, line 5 up; and from page 18, right lower column, line 1 to page 22, right upper column, line 9 up | Page 29, right lower column, line 12 to last line | Page 47, lines 4 to 9 |
| Color Sensitizers (Color Sensitizing Methods) | From page 22, right upper column, line 8 up to page 38, last line | Page 30, left upper column; lines 1 to 13 | Page 47, lines 10 to 15 |
| Emulsion Stabilizers | From page 39 left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36 left upper column, line 4 up | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right | From page 63, line 51 to page 64, line 56 |

-continued

| Photographic Elements | JP-A 62-215272 | JP-A 2-33144 | EP 0,355,660A2 |
|---|---|---|---|
| | | lower column, line 12 to page 35, right upper column, line 7 | |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right lower column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 up to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders(hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

The cited specification of JP-A 62-215272 is one as amedned by the letter of amendment filed on March 16, 1987.

Water-insoluble but organic-solvent-soluble homopolymers or copolymers may be added to cyan couplers or magenta couplers so as to disperse them into emulsions, like yellow couplers mentioned above.

It is preferred that the photographic material of the present invention contains color image stability improving compounds such as those described in EP 0,277,589A2 along with couplers. In particular, such compounds are preferably combined with pyrazoloazole couplers, pyrrolotriazole couplers and the particular yellow couplers defined hereinabove.

Specifically, it is preferred to add to the photographic material of the present invention compounds capable of chemically bonding to the aromatic amine developing agent remaining in the material after its color development to form therein substantially colorless compounds which are chemically inactive, such as those described in the above-mentioned EP specification and/or compounds capable of chemically bonding to the oxidation product of an aromatic amine developing agent remaining in the material after its color development to form therein substantially colorless compounds which are chemically inactive, such as those described in the above-mentioned EP specification, singly or as combined, since the compounds added to the material can prevent the color developing agent or its oxidation product remaining in the processed material from reacting with the couplers in the material to form stains or can prevent other harmful side effects while the processed material is stored.

As cyan couplers for use in the present invention, preferred are diphenylimidazole cyan couplers such as those described in JP-A 2-33144 as well as 3-hydroxypyridine cyan couplers such as those described in EP 0333185A2

(especially preferably, one of 4-equivalent couplers illustrated therein, Coupler (42), into which splitting-off chloride groups have been introduced so as to make it 2-equivalent, and Couplers (6) and (9)), active cyclic methylene cyan couplers such as those described in JP-A 64-32260 (especially preferably, Couplers 3, 8 and 34 illustrated therein), pyrrolopyrazole cyan couplers such as those described in EP 0456226A1, pyrroloimidazole cyan couplers such as those described in EP 0484909, and pyrrolotriazole cyan couplers such as those described in EP 0488248 and EP 0491197A1. Of these, especially preferred are pyrrolotriazole cyan couplers.

As magenta couplers usable in the present invention, for example, mentioned are 5-pyrazolone magenta couplers and pyrazolazole magenta couplers such as those described in the references referred to in the above-mentioned table. Above all, preferred are pyrazolotriazole couplers in which a secondary or tertiary alkyl group is directly bonded to the 2-, 3- or 6-position of the pyrazolotriazole ring, such as those described in JP-A 61-65245; pyrazoloazole couplers having sulfonamido group(s) in the molecule, such as those described in JP-A 61-65246; pyrazoloazole couplers having alkoxyphenylsulfonamido ballast group(s) in the molecule, such as those described in JP-A 61-147254; and pyrazoloazole couplers having an alkoxy or aryloxy group at the 6-position in the molecule, such as those described in EP 226,849A and EP 294785A, since such couplers have good coloring properties and form good images having favorable color hue and high image stability.

As 5-pyrazolone magenta couplers, preferred are those described in International Patent Laid-Open Nos. WO92/18901, WO92/18902 and WO92/18903, from which an arylthio group splits off, since the storage stability of color images formed is good and the quality of color images formed fluctuates little during processing of photographic materials.

As yellow couplers which can be combined with the particular yellow couplers defined herein, mentioned are known pivaloyl couplers except the particular yellow couplers defined herein. It is desired that the amount of such additional yellow couplers to be added to the photographic material of the present invention is not more than 70 mol % of the total amount of all the yellow couplers in the material, in view of the color reproducibility of the material.

To process the color photographic material of the present invention, the methods referred to in the above-mentioned table can be employed. In addition to these, the processing materials and the processing methods described in JP-A 2-207250, from page 26, right lower column, line 1 to page 34, right upper column, line 9 and in JP-A 4-97355, from page 5, left upper column, line 17 to page 18, right lower column, line 20 are preferably employed.

The present invention is described in more detail by means of the following examples, which, however, are not intended to restrict the scope of the present invention.

EXAMPLE 1

A paper support that had been duplex-laminated with polyethylene was treated by corona discharging, and this was coated with a subbing gelatin layer containing sodium dodecylbenzenesulfonate and then with various photographic constitutive layers mentioned below. Thus, a multi-layered color printing paper, No. 101, having the layer constitution mentioned below was prepared. Coating liquids were prepared in the manner mentioned below.

Preparation of Coating Liquid for First Layer:

130.0 g of yellow coupler (ExY-1), 8.0 g of color image stabilizer (Cpd-3), 30 g of solvent (Solv-1) and 30 g of solvent (Solv-2) were dissolved in 180 ml of ethyl acetate, and the resulting solution was emulsified and dispersed in 1000 g of an aqueous solution of 10% gelatin containing 60 ml of 10% sodium dodecylbenzenesulfonate and 10 g of citric acid, to prepare emulsified dispersion A. On the other hand, silver chlorobromide emulsion A was prepared. This was a 3/7 (as silver molar ratio) mixture comprising a large-size emulsion A of cubic grains with a mean grain size of 0.88 μm and a small-size emulsion A of cubic grains with a mean grain size of 0.70 μm, in which the two emulsions each had a fluctuation coefficient of grain size distribution of 0.08 and 0.10, respectively, and each contained silver chlorobromide grains each having 0.3 mol % of AgBr locally on the surfaces of the base grains and the remainder of silver chloride. The large-size emulsion A contained blue-sensitizing dyes A and B mentioned below, in an amount of $2.0\times10^{-4}$ mol, per mol of silver, each; and the small-size emulsion A contained them in an amount of $2.5\times10^{-4}$ mol, per mol of silver, each. This silver chlorobromide emulsion A was chemically sensitized by sulfur sensitization and gold sensitization. The above-mentioned emulsified dispersion A and this silver chlorobromide emulsion A were mixed and formed into a coating liquid for the layer having the composition mentioned below.

Coating liquids for the second layer to the seventh layer were prepared in the same manner as above. As the gelatin hardening agent in each layer, used was sodium 1-hydroxy-3,5-dichloro-s-triazine.

To each layer, added were 25.0 mg/m$^2$ of Cpd-14 and 50.0 mg/m$^2$ of Cpd-15.

The following color-sensitizing dyes were added to the silver chlorobromide emulsions in the light-sensitive emulsion layers.

Blue-sensitive Emulsion Layer:

Sensitizing Dye A:

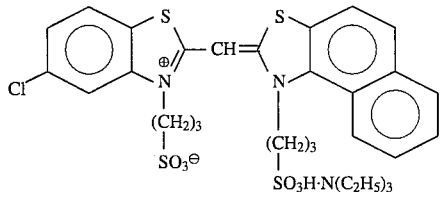

and

Sensitizing Dye B:

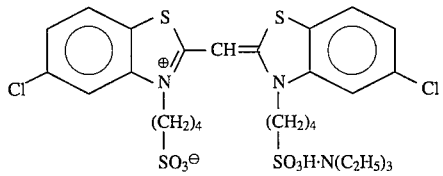

(These were added each in an amount of $2.0\times10^{-4}$ mol per mol of silver halide to the large-size emulsion and $2.5\times10^{-4}$ mol per mol of silver halide to the small-size emulsion.)

Green-sensitive Emulsion Layer:

Sensitizing Dye C:

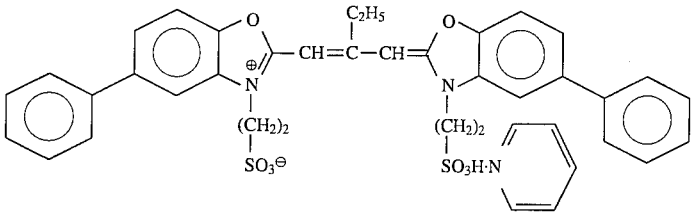

(This was added in an amount of $4.0\times10^{-4}$ mol per mol of silver halide to the large-size emulsion and $5.6\times10^{-4}$ mol per mol of silver halide to the small-size emulsion.)

Sensitizing Dye D:

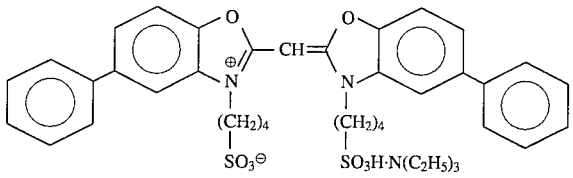

(This was added in an amount of $7.0\times10^{-5}$ mol per mol of silver halide to the large-size emulsion and $1.0\times10^{-4}$ mol per mol of silver halide to the small-size emulsion.)

Red-sensitive Emulsion Layer:

Sensitizing Dye E:

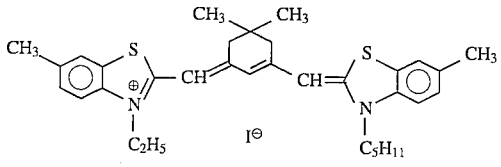

(This was added in an amount of $1.0\times10^{-4}$ mol per mol of silver halide to the large-size emulsion and $1.2\times10^{-4}$ mol per mol of silver halide to the small-size emulsion.)

To the red-sensitive emulsion layer was added the following compound in an amount of $2.6\times10^{-3}$ mol per mol of silver halide.

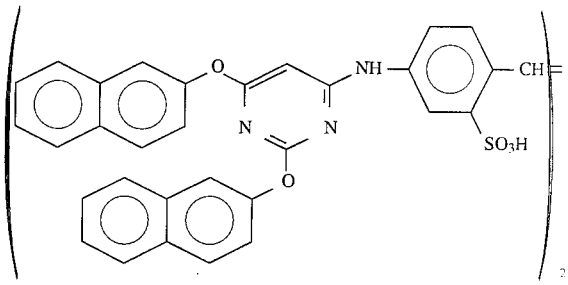

To each of the blue-sensitive emulsion layer, the green-sensitive emulsion layer and the red-sensitive emulsion layer was added 1-(5-methylureidophenyl)-5-mercaptotetrazole in an amount of $8.5\times10^{-5}$ mol, $7.7\times10^{-4}$ mol and $2.5\times10^{-4}$ mol, each per mol of silver halide, respectively.

To each of the blue-sensitive emulsion layer and the green-sensitive emulsion layer was added 4-hydroxy-6-methyl-1,3,3a,7-tetrazaindene in an amount of $1\times10^{-4}$ mol and $2\times10^{-4}$ mol, each per mol of silver halide, respectively.

Layer Constitution of Photographic Material Sample No. 101:

The composition of each layer of the photographic material sample is mentioned below. The number indicates the amount of the component coated ($g/m^2$). The amount of the silver halide emulsion coated is represented by the amount of silver therein coated.

| | |
|---|---|
| Support: | |
| Polyethylene-laminated Paper (containig 14% by weight of white pigment ($TiO_2$) and bluish dye (ultramarine) in polyethylene below the first layer) | |
| First Layer (Blue-sensitive Emulsion Layer): | |
| Above-mentioned Silver Chlorobromide Emulsion | 0.30 |
| Gelatin | 1.46 |
| Yellow Coupler (ExY-1) | 0.65 |
| Color Image Stabilizer (Cpd-3) | 0.04 |
| Solvent (Solv-1) | 0.15 |
| Solvent (Solv-2) | 0.15 |
| Second Layer (Color Mixing Preventing Layer): | |
| Gelatin | 0.10 |
| Color Mixing Preventing Agent (Cpd-4) | 0.10 |

-continued

| | |
|---|---|
| Solvent (Solv-7) | 0.05 |
| Solvent (Solv-2) | 0.25 |
| Solvent (Solv-3) | 0.25 |
| Third Layer (Green-sensitive Emulsion Layer): | |
| Silver Chlorobromide Emulsion (⅓ (as silver molar ratio) mixture comprising a large-size emulsion B of cubic grains with a mean grain size of 0.55 μm and a small-size emulsion B of cubic grains with a mean grain size of 0.39 μm; the two emulsions each having a fluctuation coefficient of grain size distribution of 0.10 and 0.08, respectively, and each having 0.8 mol % of AgBr locally on the surfaces of the base grains and the remainder of silver chloride | 0.13 |
| Gelatin | 1.45 |
| Magenta Coupler (ExM) | 0.18 |
| Color Image Stabilizer (Cpd-5) | 0.15 |
| Color Image Stabilizer (Cpd-2) | 0.03 |
| Color Image Stabilizer (Cpd-6) | 0.01 |
| Color Image Stabilizer (Cpd-7) | 0.01 |
| Color Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color Mixing Preventing Layer): | |
| Gelatin | 0.80 |
| Color Mixing Preventing Agent (Cpd-4) | 0.08 |
| Solvent (Solv-7) | 0.03 |
| Solvent (Solv-2) | 0.20 |
| Solvent (Solv-3) | 0.20 |
| Fifth Layer (Red-sensitive Emulsion Layer): | |
| Silver Chlorobromide Emulsion (¼ (as silver molar ratio) mixture comprising a large-size emulsion C of cubic grains with a mean grain size of 0.50 μm and a small-size emulsion C of cubic grains with a mean grain size of 0.41 μm; the two emulsions each having a fluctuation coefficient of grain size distribution of 0.09 and 0.11, respectively, and each having 0.8 mol % of AgBr locally on the surfaces of the base grains and the remainder of silver chloride) | 0.20 |
| Gelatin | 0.85 |
| Cyan Coupler (ExC) | 0.31 |
| Ultraviolet Absorbent (UV-2) | 0.18 |
| Color Image Stabilizer (Cpd-9) | 0.01 |
| Additive (Cpd-10) | 0.01 |
| Additive (Cpd-11) | 0.01 |
| Solvent (Solv-6) | 0.22 |
| Color Image Stabilizer (Cpd-8) | 0.01 |
| Color Image Stabilizer (Cpd-6) | 0.01 |
| Solvent (Solv-1) | 0.01 |
| Color Image Stabilizer (Cpd-1) | 0.31 |
| Sixth Layer (Ultraviolet Absorbing Layer): | |
| Gelatin | 0.55 |
| Ultraviolet Absorbent (UV-1) | 0.38 |
| Color Image Stabilizer (Cpd-12) | 0.15 |
| Color Image Stabilizer (Cpd-5) | 0.02 |
| Seventh Layer (Protective Layer): | |
| Gelatin | 1.13 |
| Acryl-modified Copolymer of Polyvinyl Alcohol (modification degree 17%) | 0.05 |
| Liquid Paraffin | 0.02 |
| Color Image Stabilizer (Cpd-13) | 0.01 |
| The compounds used above are mentioned below. | |

-continued
(ExY) Yellow Coupler:
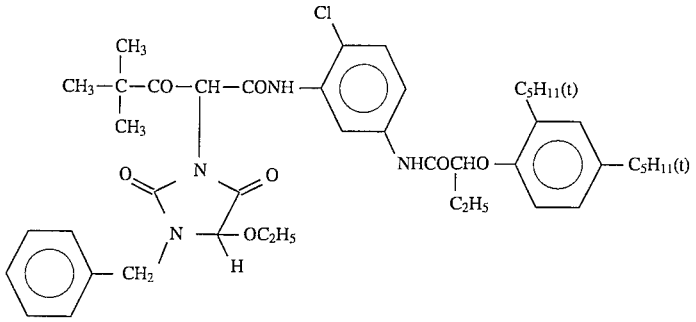
(ExM) Magenta Coupler:
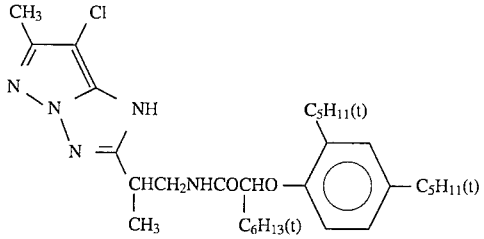
(ExC) Cyan Coupler:
3/7 (by mol) mixture of the following:
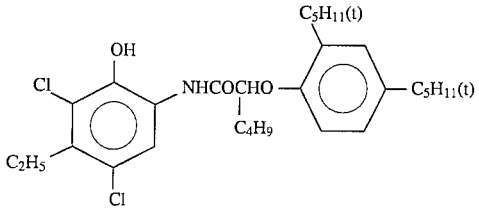
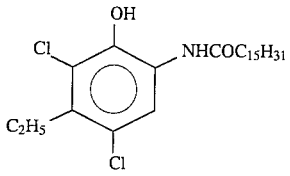
(Cpd-1) Color Image Stabilizer:
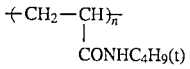
mean molecular weight: 60,000
(Cpd-2) Color Image Stabilizer:
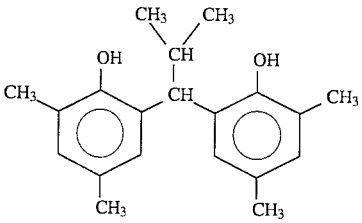

-continued
(Cpd-3) Color Image Stabilizer:
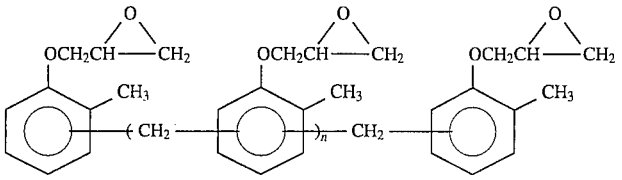
n = 7 to 8 (as mean value)
(Cpd-4) Color Mixing Preventing Agent:
1/1 (by weight) mixture of the following (1) and (2):
(1)
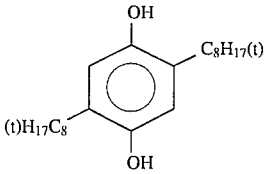
(2)
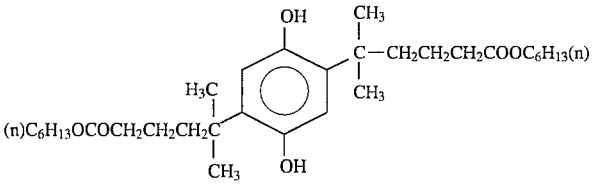
(Cpd-5) Color Image Stabilizer:
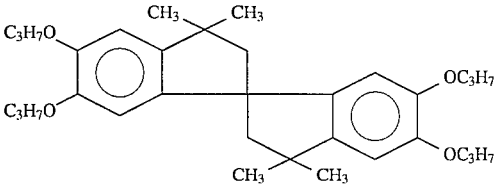
(Cpd-6) Color Image Stabilizer:
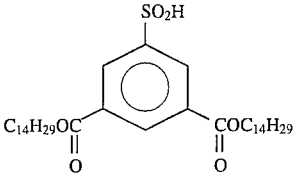
(Cpd-7) Color Image Stabilizer:
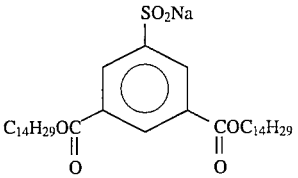
(Cpd-8) Color Image Stabilizer:
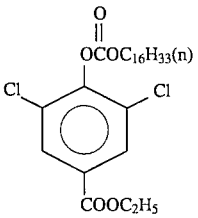

-continued
(Cpd-9) Color Image Stabilizer:
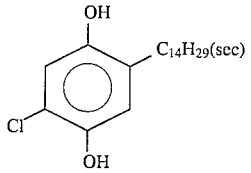
(Cpd-10) Additive:
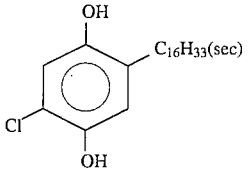
(Cpd-11) Additive:
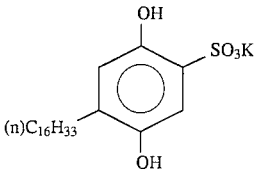
(Cpd-12) Color Image Stabilizer:
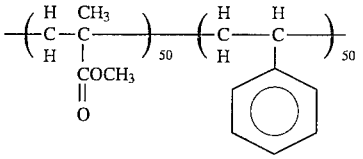
mean molecular weight: about 60,000
(Cpd-13) Color Image Stabilizer:
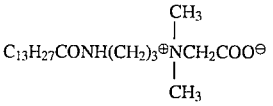
(Cpd-14) Antiseptic:
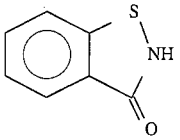
(Cpd-15) Antiseptic:
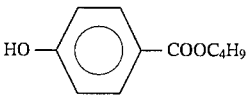
(UV-1) Ultraviolet Absorbent:
1/5/10/5 mixture (by weight) of the following (1), (2), (3), (4):
(1)
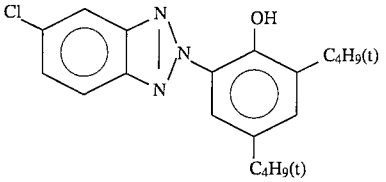

-continued
(2)
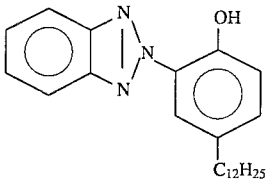
(3)
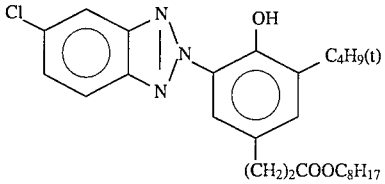
(4)
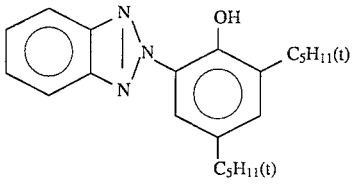
(UV-2) Ultraviolet Absorbent:
1/2/2 mixture (by weight) of the following (1), (2), (3):
(1)
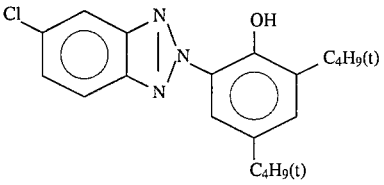
(2)
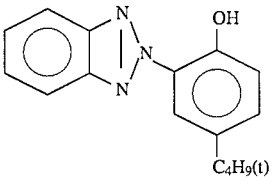
(3)
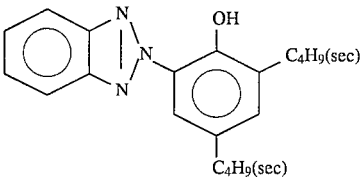
(Solv-1) Solvent:
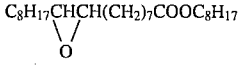
(Solv-2) Solvent:
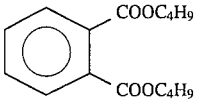
(Solv-3) Solvent:
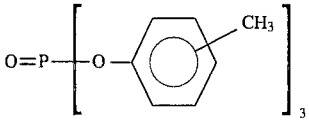

-continued (Solv-4) Solvent:

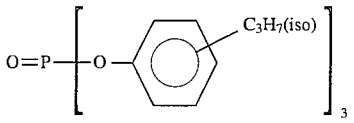

(Solv-5) Solvent:

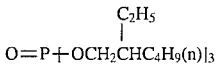

(Solv-6) Solvent:

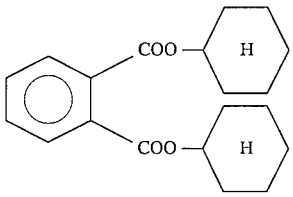

(Solv-7) Solvent:

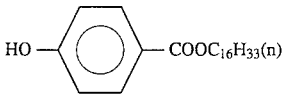

Samples Nos. 102 to 173 were prepared in the same manner as in preparation of Sample No. 101, except that the yellow coupler in the first layer (blue-sensitive layer) was replaced by the same molar amount of the coupler shown in Table 1 below and that the compound(s) shown in the same table was/were added to the first layer in an amount of 25 mol % per mol of the coupler. The polymer used herein had a number average molecular weight of about 60,000.

Sample No. 101 prepared above was exposed to white light by flat lighting at a ratio of 30% of its area. Then, this was continuously processed according to the process mentioned below until the amount of the replenisher to the color developer became two times the capacity of the color developer tank (running process).

Processing Steps:

(*) This is the amount of the replenisher per $m^2$ of the sample being processed.
(**) In addition to this (60 ml), 120 ml per $m^2$ of the sample being processed were returned back from the rinsing bath (1).
Rinsing was effected by a three-tank countercurrent cascade system from the rinsing tank (3) to the rinsing tank (1).

| Step | Temp. | Time | Replenisher (ml) (*) |
|---|---|---|---|
| Color Development | 38.5° C. | 45 sec | 73 |
| Bleach-Fixation | 35° C. | 45 sec | 60(**) |
| Rinsing (1) | 35° C. | 30 sec | — |
| Rinsing (2) | 35° C. | 30 sec | — |
| Rinsing (3) | 35° C. | 30 sec | 360 |
| Drying | 80° C. | 60 sec | |

The processing solutions used in the above-mentioned process are mentioned below.

| | Tank Solution | Replenisher |
|---|---|---|
| Color Developer: | | |
| Water | 800 ml | 800 ml |
| Ethylenediamine-tetraacetic Acid | 3.0 g | 3.0 g |
| Disodium 4,5-Dihydroxybenzene-1,3-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Brightening Agent (WHITEX 4B, product by Sumitomo Chemical Co.) | 1.0 g | 3.0 g |
| Sodium Sulfite | 0.1 g | 0.1 g |
| Disodium-N,N-bis(sulfonatoethyl)hydroxylamine | 5.0 g | 10.0 g |

-continued

| | Tank Solution | Re-plenisher |
|---|---|---|
| Sodium Triisopropylnaphthalene(β)sulfonate | 0.1 g | 0.1 g |
| N-ethyl-N-(β-methanesulfonamidoethyl)-3-methyl-4-aminoaniline 3/2 Sulfate Monohydrate | 5.0 g | 11.5 g |
| Water to make | 1000 ml | 1000 ml |
| pH (adjusted with potassium hydroxide and sulfuric acid, 25° C.) | 10.00 | 11.00 |
| Bleach-fixing Solution: | | |
| Water | 600 ml | 150 ml |
| Ammonium Thiosulfate (750 g/liter) | 93 ml | 230 ml |
| Ammonium Sulfite | 40 g | 100 g |
| Ammonium Ethylenediaminetetraacetato/iron(III) | 55 g | 135 g |
| Ethylenediaminetetraacetic Acid | 5 g | 12.5 g |
| Nitric Acid (67%) | 30 g | 65 g |
| Water to make | 1000 ml | 1000 ml |
| pH (adjusted with acetic acid and aqueous ammonia, 25° C.) | 5.8 | 5.6 |
| Rinsing Solution: | | |
| Both the tank solution and the replenisher were the same. | | |
| Sodium Chloroisocyanurate | 0.02 g | |
| Deionized Water (having an electroconductivity of 5 μs/cm or less) | 1000 ml | |
| pH | 6.5 | |

On the other hand, a color negative film (HG400; produced by Fuji Photo Film Co.) that had been separately imagewise exposed and processed to have a still-life picture (lemons and oranges) thereon was printed out onto each of Samples Nos. 101 to 173, using an enlarger, to prepare samples for assessing their color reproducibility.

Apart from these, Samples Nos. 101 to 173 were sensitometrically exposed through a three-color sensitometry filter, using a sensitometer (FWH Model, having a color temperature of 3200° K. at its light source). The exposure was conducted for 0.1 second, by which the exposure amount was 250 CMS. Using these samples, their fastness to light and their coloring properties were evaluated.

All of the exposed samples were developed, using the running solution prepared above.

Color Reproducibility:

Each of the printed samples was observed with the naked eye, using a light source for evaluating the color reproducibility of color prints, and was assessed with respect to the faithfulness of the color reproduction therein.

⊙: The color of lemons was faithfully reproduced on the print, as pure yellow with no turbidity.

○: The color of lemons was faithfully reproduced on the print, as yellow.

x: The color of lemons was reproduced on the print, as orange.

Fastness to Light:

Each of the sensitometrically-processed samples was exposed to light for one week, using a xenon fade meter (80000 luxes). The percentage (%) of each of the yellow densities (D1.5, D0.5) of the faded yellow areas corresponding to the non-faded areas having an original yellow density (DO) of 1.5 and 0.5, respectively, was obtained.

Coloring Property:

The maximum reflective density (Dmax) of the yellow color image in each of the sensitometrically-processed samples was measured.

The results of these tests are shown in Table 1 below.

TABLE 1

| Sample No. | Yellow Coupler | Color Image Stabilizer (IV) | Color Image Stabilizer (V) | Polymer | Color Image Stabilizer (VI) | Color Reproducibility | Dmax | Percentage of Color Retention (%) D0 = 1.5 | D0 = 0.5 | Remarks |
|---|---|---|---|---|---|---|---|---|---|---|
| 101 | ExY-1 | — | — | — | — | X | 2.01 | 70 | 72 | comparative sample |
| 102 | Y1-2 | — | — | — | — | ⊙ | 2.52 | 69 | 71 | comparative sample |
| 103 | Y1-39 | — | — | — | — | ○ | 2.45 | 70 | 71 | comparative sample |
| 104 | Y2-3 | — | — | — | — | ○ | 2.48 | 70 | 72 | comparative sample |
| 105 | Y2-20 | — | — | — | — | ⊙ | 2.50 | 69 | 71 | comparative sample |
| 106 | Y2-27 | — | — | — | — | ○ | 2.15 | 68 | 70 | comparative sample |
| 107 | Y3-1 | — | — | — | — | ○ | 2.13 | 70 | 71 | comparative sample |
| 108 | Y3-4 | — | — | — | — | ○ | 2.11 | 70 | 72 | comparative sample |

TABLE 1-continued

| Sample No. | Yellow Coupler | Color Image Stabilizer (IV) | Color Image Stabilizer (V) | Polymer | Color Image Stabilizer (VI) | Color Reproducibility | Dmax | Percentage of Color Retention (%) D0 = 1.5 | D0 = 0.5 | Remarks |
|---|---|---|---|---|---|---|---|---|---|---|
| 109 | ExY-1 | A-1 | — | — | — | X | 2.02 | 83 | 76 | comparative sample |
| 110 | ExY-1 | A-2 | — | — | — | X | 2.05 | 88 | 81 | comparative sample |
| 111 | ExY-1 | A-24 | — | — | — | X | 2.03 | 81 | 75 | comparative sample |
| 112 | ExY-1 | A-27 | — | — | — | X | 2.03 | 86 | 79 | comparative sample |
| 113 | ExY-1 | — | B-9 | — | — | X | 2.01 | 74 | 76 | comparative sample |
| 114 | ExY-1 | — | B-20 | — | — | X | 2.02 | 73 | 76 | comparative sample |
| 115 | ExY-1 | — | B-24 | — | — | X | 2.05 | 74 | 75 | comparative sample |
| 116 | ExY-1 | A-2 | B-9 | — | — | X | 2.04 | 94 | 93 | comparative sample |
| 117 | ExY-1 | A-2 | B-20 | — | — | X | 2.02 | 93 | 92 | comparative sample |
| 118 | ExY-1 | A-27 | B-9 | — | — | X | 2.03 | 92 | 90 | comparative sample |
| 119 | ExY-1 | A-1 | B-24 | — | — | X | 2.06 | 90 | 90 | comparative sample |
| 120 | Y1-2 | A-1 | — | — | — | ◎ | 2.54 | 84 | 75 | comparative sample |
| 121 | Y1-2 | A-2 | — | — | — | ◎ | 2.53 | 89 | 82 | comparative sample |
| 122 | Y1-2 | A-24 | — | — | — | ◎ | 2.55 | 79 | 74 | comparative sample |
| 123 | Y1-2 | A-27 | — | — | — | ◎ | 2.52 | 87 | 79 | comparative sample |
| 124 | Y1-2 | — | B-9 | — | — | ◎ | 2.53 | 73 | 75 | comparative sample |
| 125 | Y1-2 | — | B-20 | — | — | ◎ | 2.53 | 74 | 76 | comparative sample |
| 126 | Y1-2 | — | B-24 | — | — | ◎ | 2.54 | 75 | 76 | comparative sample |
| 127 | Y1-2 | A-2 | B-9 | — | — | ◎ | 2.53 | 95 | 94 | sample of the invention |
| 128 | Y1-2 | A-2 | B-20 | — | — | ◎ | 2.53 | 94 | 94 | sample of the invention |
| 129 | Y1-2 | A-27 | B-9 | — | — | ◎ | 2.53 | 92 | 92 | sample of the invention |
| 130 | Y1-2 | A-1 | B-24 | — | — | ◎ | 2.54 | 91 | 92 | sample of the invention |
| 131 | Y1-39 | A-2 | — | — | — | ○ | 2.46 | 88 | 79 | comparative sample |
| 132 | Y1-39 | — | B-9 | — | — | ○ | 2.49 | 74 | 75 | comparative sample |
| 133 | Y1-39 | A-2 | B-9 | — | — | ○ | 2.48 | 93 | 93 | sample of the invention |
| 134 | Y2-3 | A-1 | — | — | — | ○ | 2.50 | 83 | 75 | comparative sample |
| 135 | Y2-3 | A-2 | — | — | — | ○ | 2.49 | 86 | 78 | comparative sample |
| 136 | Y2-3 | A-24 | — | — | — | ○ | 2.52 | 80 | 74 | comparative sample |
| 137 | Y2-3 | A-27 | — | — | — | ○ | 2.51 | 85 | 76 | comparative sample |
| 138 | Y2-3 | — | B-9 | — | — | ○ | 2.50 | 75 | 76 | comparative sample |
| 139 | Y2-3 | — | B-20 | — | — | ○ | 2.50 | 73 | 74 | comparative sample |
| 140 | Y2-3 | — | B-24 | — | — | ○ | 2.49 | 74 | 75 | comparative sample |
| 141 | Y2-3 | A-2 | B-9 | — | — | ○ | 2.51 | 94 | 93 | sample of the invention |
| 142 | Y2-3 | A-2 | B-20 | — | — | ○ | 2.50 | 94 | 94 | sample of the invention |
| 143 | Y2-3 | A-27 | B-9 | — | — | ○ | 2.51 | 93 | 93 | sample of the invention |
| 144 | Y2-3 | A-1 | B-24 | — | — | ○ | 2.52 | 93 | 92 | sample of the invention |
| 145 | Y2-20 | A-2 | — | — | — | ◎ | 2.52 | 87 | 78 | comparative |

TABLE 1-continued

| Sample No. | Yellow Coupler | Color Image Stabilizer (IV) | Color Image Stabilizer (V) | Polymer | Color Image Stabilizer (VI) | Color Reproducibility | Dmax | Percentage of Color Retention (%) D0 = 1.5 | D0 = 0.5 | Remarks |
|---|---|---|---|---|---|---|---|---|---|---|
| 146 | Y2-20 | — | B-9 | — | — | ◎ | 2.53 | 75 | 75 | sample comparative sample |
| 147 | Y2-20 | A-2 | B-9 | — | — | ◎ | 2.53 | 95 | 93 | sample of the invention |
| 148 | Y2-27 | A-2 | — | — | — | ○ | 2.18 | 87 | 79 | comparative sample |
| 149 | Y2-27 | — | B-9 | — | — | ○ | 2.17 | 73 | 75 | comparative sample |
| 150 | Y2-27 | A-2 | B-9 | — | — | ○ | 2.19 | 94 | 94 | sample of the invention |
| 151 | Y3-1 | A-1 | — | — | — | ○ | 2.13 | 82 | 76 | comparative sample |
| 152 | Y3-1 | A-2 | — | — | — | ○ | 2.15 | 86 | 78 | comparative sample |
| 153 | Y3-1 | A-24 | — | — | — | ○ | 2.17 | 80 | 75 | comparative sample |
| 154 | Y3-1 | A-27 | — | — | — | ○ | 2.14 | 85 | 76 | comparative sample |
| 155 | Y3-1 | — | B-9 | — | — | ○ | 2.15 | 73 | 74 | comparative sample |
| 156 | Y3-1 | — | B-20 | — | — | ○ | 2.13 | 72 | 74 | comparative sample |
| 157 | Y3-1 | — | B-24 | — | — | ○ | 2.13 | 72 | 74 | comparative sample |
| 158 | Y3-1 | A-2 | B-9 | — | — | ○ | 2.17 | 94 | 94 | sample of the invention |
| 159 | Y3-1 | A-2 | B-20 | — | — | ○ | 2.15 | 93 | 93 | sample of the invention |
| 160 | Y3-1 | A-27 | B-9 | — | — | ○ | 2.13 | 93 | 92 | sample of the invention |
| 161 | Y3-1 | A-1 | B-24 | — | — | ○ | 2.13 | 92 | 91 | sample of the invention |
| 162 | Y3-4 | A-2 | — | — | — | ○ | 2.13 | 87 | 76 | comparative sample |
| 163 | Y3-4 | — | B-9 | — | — | ○ | 2.13 | 73 | 74 | comparative sample |
| 164 | Y3-4 | A-2 | B-9 | — | — | ○ | 2.15 | 93 | 94 | sample of the invention |
| 165 | ExY-1 | A-2 | B-9 | P-17 | — | X | 2.03 | 96 | 95 | comparative sample |
| 166 | ExY-1 | A-2 | B-9 | — | C-28 | X | 2.04 | 96 | 95 | comparative sample |
| 167 | ExY-1 | A-2 | B-9 | — | C-31 | X | 2.04 | 96 | 96 | comparative sample |
| 168 | Y1-2 | A-2 | B-9 | P-17 | — | ◎ | 2.55 | 97 | 96 | sample of the invention |
| 169 | Y1-2 | A-2 | B-9 | — | C-28 | ◎ | 2.55 | 97 | 97 | sample of the invention |
| 170 | Y1-2 | A-2 | B-9 | — | C-31 | ◎ | 2.56 | 97 | 97 | sample of the invention |
| 171 | Y2-3 | A-2 | B-9 | P-17 | — | ○ | 2.54 | 97 | 97 | sample of the invention |
| 172 | Y2-3 | A-2 | B-9 | — | C-28 | ○ | 2.54 | 97 | 96 | sample of the invention |
| 173 | Y2-3 | A-2 | B-9 | — | C-31 | ○ | 2.55 | 97 | 97 | sample of the invention |
| 174 | Y3-1 | A-2 | B-9 | P-17 | — | ○ | 2.17 | 96 | 95 | sample of the invention |
| 175 | Y3-1 | A-2 | B-9 | — | C-28 | ○ | 2.18 | 96 | 96 | sample of the invention |
| 176 | Y3-1 | A-2 | B-9 | — | C-31 | ○ | 2.18 | 96 | 97 | sample of the invention |

Comparing Sample No. 101 with Samples Nos. 102 to 108, etc., it is known that the samples each containing the yellow coupler of formula (I), (II) or (III) faithfully reproduced the yellow color of lemons and had good color reproducibility. Comparing Sample No. 102 with Samples Nos. 120 to 123, etc., it is known that, when the compound of formula (IV) was added to the yellow coupler-containing layer, then the percentage of color retention at D0=1.5 was large. This means that the fastness to light of the image formed was improved at the high-density area by the addition of the compound of formula (IV). However, the color retention at D0=0.5 was not so much improved as that at D0=1.5, even by the addition of the compound of formula (IV). This means that the effect of the compounds of formula (IV) in improving the fastness to light of the image at the low-density area was small.

On the other hand, comparing Sample No. 102 with Samples Nos. 124 to 126, etc., it is known that when the compound of formula (V) was added to the yellow coupler-containing layer, then the percentage of color retention was only slightly increased at D0=1.5 and at D0=0.5. This means that the effect of the compounds of formula (V) in improving the fastness to light of the image at the high-density area and at the low-density area was small.

As opposed to these, comparing Sample No. 102 with Samples Nos. 127 to 130, it is known that when both the compound of formula (IV) and the compound of formula (V) were added to the yellow coupler-containing layer, then the percentage of color retention was significantly greatly increased at D0=1.5 and at D0=0.5. This means that the fastness to light of the image was much improved at both the high-density area and the low-density area by the addition of these two compounds.

These results have revealed the following facts: The particular yellow couplers defined herein have good color reproducibility. When only the compound of formula (IV) is added to the yellow coupler-containing layer, the fastness to light of the image formed is improved essentially at the high-density area only. When the compound of formula (V) is added to the same, the fastness to light of the image formed is improved only slightly. However, when both the compound of formula (IV) and the compound of formula (V) are added to the same, the fastness to light of the image formed is improved at from the high-density area to the low-density area.

Comparing Sample No. 127 with Sample No. 168 or with Samples Nos. 169, 170, etc., it is known that when the polymer defined herein or the amide compound of formula (VI) was added to the layer containing the particular yellow coupler defined herein along with both the compound of formula (IV) and the compound of formula (V) had been added, then the light fastness of the image formed was much more improved.

EXAMPLE 2

In the same manner as in preparation of Sample No. 101 in Example 1, Sample No. 201 having the layer constitution mentioned below was prepared. Color sensitizing dyes mentioned below were used to sensitize the silver chlorobromide in each of the light-sensitive emulsion layers of Sample No. 201.

Blue-sensitive Emulsion Layer:

Sensitizing Dye A:

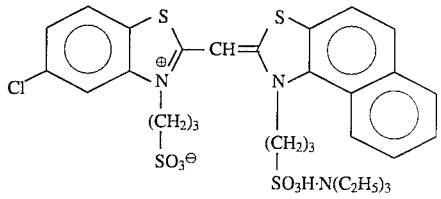

Sensitizing Dye B:

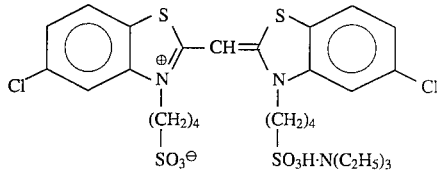

Sensitizing Dye C:

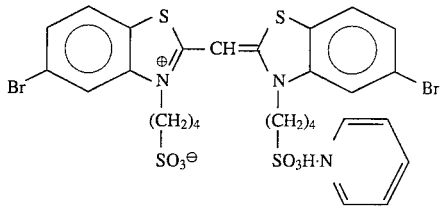

(These were added each in an amount of $1.4\times10^{-4}$ mol per mol of silver halide to the large-size emulsion and $1.7\times10^{-4}$ mol per mol of silver halide to the small-size emulsion.)

Green-sensitive Emulsion Layer:

Sensitizing Dye D:

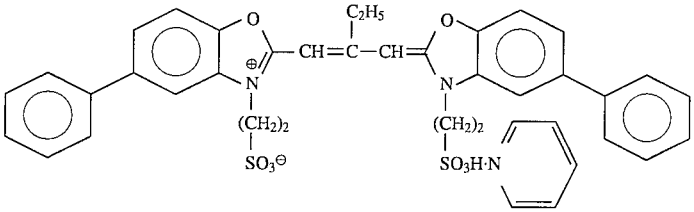

Sensitizing Dye E:

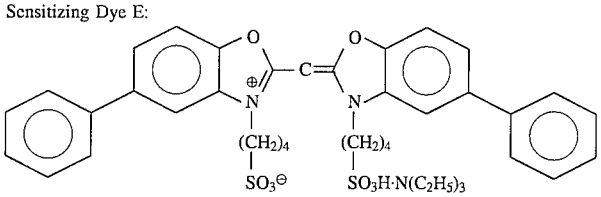

-continued

Sensitizing Dye F:

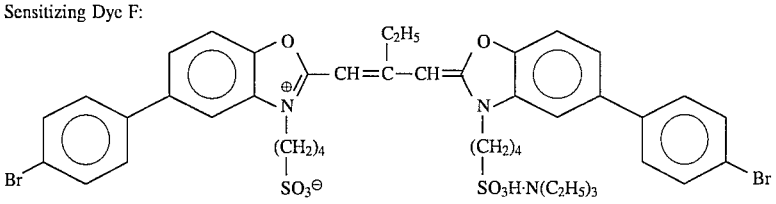

(Sensitizing dye D was added in an amount of $3.0\times10^{-4}$ mol per mol of silver halide to the large-size emulsion and $3.6\times10^{-4}$ mol per mol of silver halide to the small-size emulsion; Sensitizing dye E was added in an amount of $4.0\times10^{-5}$ mol per mol of silver halide to the large-size emulsion and $7.0\times10^{-5}$ mol per mol of silver halide to the small-size emulsion; and Sensitizing dye F was added in an amount of $2.0\times10^{-4}$ mol per mol of silver halide to the large-size emulsion and $2.8\times10^{-4}$ mol per mol of silver halide to the small-size emulsion.)

Red-sensitive Emulsion Layer:

Sensitizing Dye G:

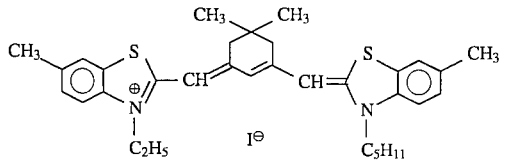

Sensitizing Dye H:

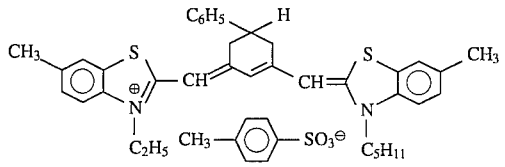

(These were added each in an amount of $5.0\times10^{-5}$ mol per mol of silver halide to the large-size emulsion and $6.0\times10^{-4}$ mol per mol of silver halide to the small-size emulsion.)

To the red-sensitive emulsion layer was added the following compound in an amount of $2.6\times10^{-3}$ mol per mol of silver halide.

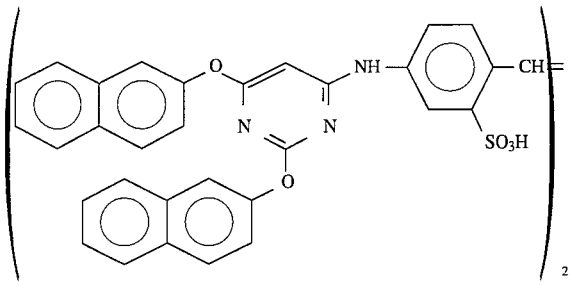

To each of the blue-sensitive emulsion layer, the green-sensitive emulsion layer and the red-sensitive emulsion layer was added 1-(5-methylureidophenyl)-5-mercaptotetrazole in an amount of $8.5\times10^{-4}$ mol, $5.0\times10^{-3}$ mol and $2.5\times10^{-4}$ mol, each per mol of silver halide, respectively.

To each of the blue-sensitive emulsion layer and the green-sensitive emulsion layer was added 4-hydroxy-6-methyl-1,3,3a,7-tetrazaindene in an amount of $1\times10^{-4}$ mol and $2\times10^{-4}$ mol, each per mol of silver halide, respectively.

The following dyes were added to each emulsion layer for anti-irradiation. (The amount as parenthesized indicates the amount of each dye coated.)

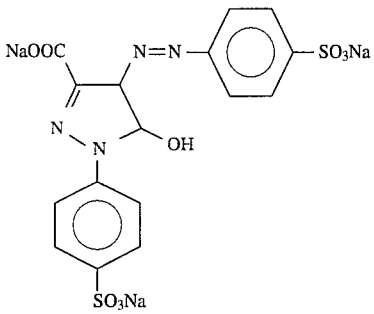

(10 mg/m²)

-continued
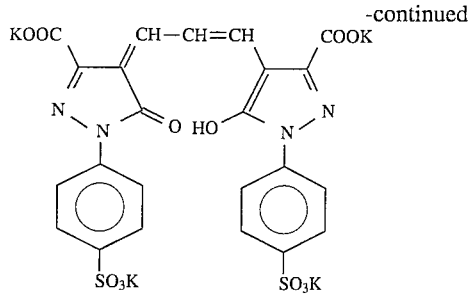
(10 mg/m²)
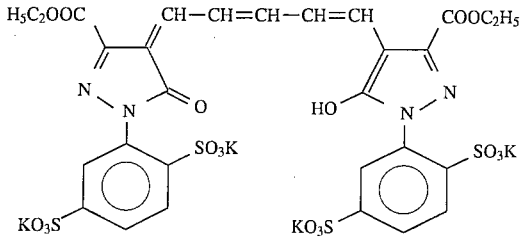
(40 mg/m²)
and
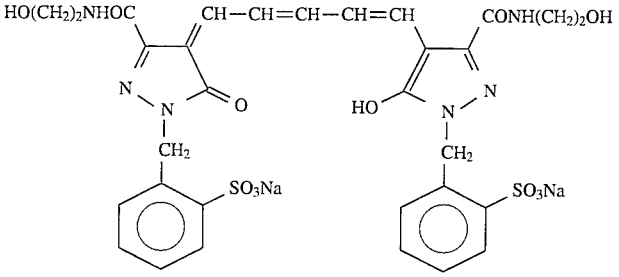
(20 mg/m²)
Layer Constitution of Photographic Material Sample No. 201:

| | |
|---|---|
| Support: | |
| Polyethylene-laminated Paper (containing 14% by weight of white pigment ($TiO_2$) and bluish dye (ultramarine) in polyethylene below the first layer) | |
| First Layer (Blue-sensitive Emulsion Layer): | |
| Silver Chlorobromide Emulsion (3/7 (as silver molar ratio) mixture comprising a large-size emulsion A of cubic grains with a mean grain size of 0.88 μm and a small-size emulsion A of cubic grains with a mean grain size of 0.70 μm; the two emulsions each having a fluctuation coefficient of grain size distribution of 0.08 and 0.10, respectively, and each having 0.3 mol % of AgBr locally on the surfaces of the base grains and the remainder of silver chloride) | 0.27 |
| Gelatin | 1.36 |
| Yellow Coupler (ExY2) | 0.79 |
| Color Image Stabilizer (Cpd-3) | 0.08 |
| Color Image Stabilizer (Cpd-5) | 0.04 |
| Solvent (Solv-1) | 0.13 |
| Solvent (Solv-5) | 0.13 |
| Second Layer (Color Mixing Preventing Layer): | |
| Gelatin | 1.10 |
| Color Mixing Preventing Agent (Cpd-4) | 0.08 |
| Solvent (Solv-1) | 0.10 |
| Solvent (Solv-2) | 0.15 |
| Solvent (Solv-3) | 0.25 |
| Solvent (Solv-8) | 0.03 |
| Third Layer (Green-sensitive Emulsion Layer): | |
| Silver Chlorobromide Emulsion (1/3 (as silver molar ratio) mixture comprising a large-size emulsion B of cubic grains with a mean grain size of 0.55 μm and a small-size emulsion B of cubic grains with a mean grain size of 0.39 μm; the two emulsions each having a fluctuation coefficient of grain size distribution of 0.10 and 0.08, respectively, and each having 0.8 mol % of AgBr locally on the surfaces of the base grains composed of silver chloride) | 0.13 |
| Gelatin | 1.45 |
| Magenta Coupler (ExM) | 0.16 |
| Ultraviolet Absorbent (UV-2) | 0.16 |
| Color Image Stabilizer (Cpd-2) | 0.03 |
| Color Image Stabilizer (Cpd-5) | 0.10 |
| Color Image Stabilizer (Cpd-6) | 0.01 |
| Color Image Stabilizer (Cpd-7) | 0.01 |
| Color Image Stabilizer (Cpd-8) | 0.08 |
| Color Image Stabilizer (Cpd-10) | 0.02 |
| Solvent (Solv-3) | 0.13 |
| Solvent (Solv-4) | 0.39 |
| Solvent (Solv-6) | 0.26 |
| Fourth Layer (Color Mixing Preventing Layer): | |
| Gelatin | 0.07 |
| Color Mixing Preventing Agent (Cpd-4) | 0.06 |
| Solvent (Solv-1) | 0.07 |
| Solvent (Solv-2) | 0.11 |
| Solvent (Solv-3) | 0.18 |
| Solvent (Solv-8) | 0.02 |
| Fifth Layer (Red-sensitive Emulsion Layer): | |
| Silver Chlorobromide Emulsion (1/4 (as silver molar ratio) mixture comprising a large-size emulsion C of cubic grains with a mean grain size of 0.50 μm and a small-size emulsion C of cubic grains with a mean grain size of 0.41 μm; the two emulsions each having a fluctuation coefficient of grain size distribution of 0.09 and 0.11, respectively, and each having 0.8 mol % of AgBr locally on the surfaces of the base grains composed of silver chloride) | 0.20 |
| Gelatin | 0.85 |
| Cyan Coupler (ExC) | 0.33 |
| Ultraviolet Absorbent (UV-2) | 0.18 |
| Color Image Stabilizer (Cpd-9) | 0.02 |

-continued

| | |
|---|---|
| Color Image Stabilizer (Cpd-10) | 0.01 |
| Solvent (Solv-7) | 0.22 |
| Color Image Stabilizer (Cpd-8) | 0.01 |
| Color Image Stabilizer (Cpd-6) | 0.01 |
| Solvent (Solv-1) | 0.01 |
| Color Image Stabilizer (Cpd-1) | 0.33 |
| Sixth Layer (Ultraviolet Absorbing Layer): | |
| Gelatin | 0.60 |
| Ultraviolet Absorbent (UV-1) | 0.39 |
| Color Image Stabilizer (Cpd-5) | 0.01 |
| Color Image Stabilizer (Cpd-7) | 0.05 |
| Solvent (Solv-9) | 0.05 |
| Seventh Layer (Protective Layer): | |
| Gelatin | 1.00 |
| Acryl-modified Copolymer of Polyvinyl Alcohol (modification degree 17%) | 0.05 |
| Liquid Paraffin | 0.02 |
| Color Image Stabilizer (Cpd-13) | 0.01 |

The compounds used above are mentioned below.

(ExY) Yellow Coupler:

1/1 (by mol) mixture of the following:

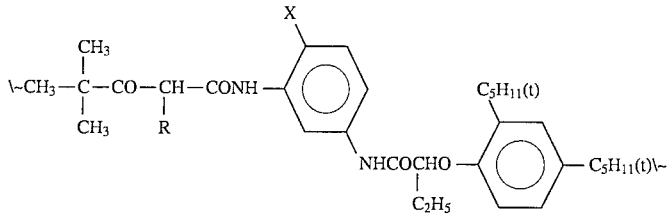

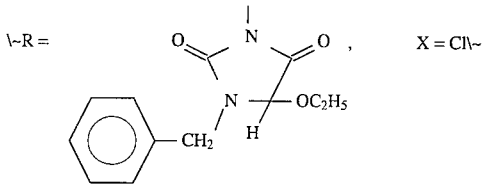

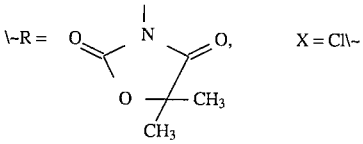

(ExM) Magenta Coupler:

1/1 (by mol) mixture of the following:

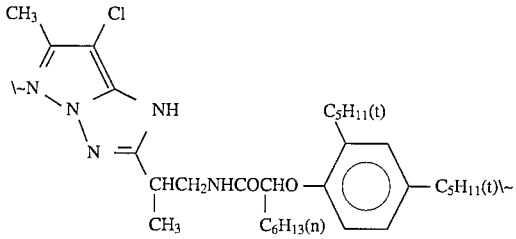

-continued
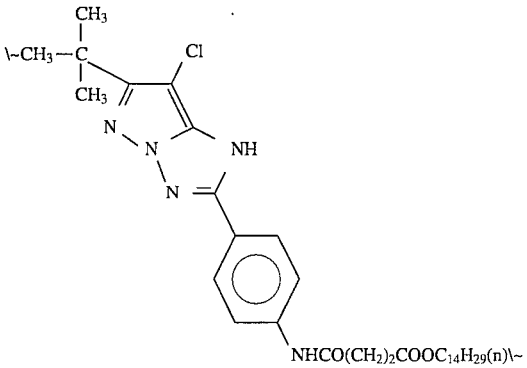
(ExC) Cyan Coupler:
25/75 (by mol) mixture of the following:
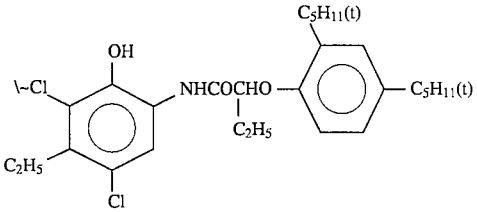
and
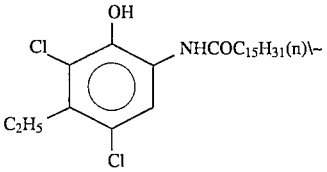
(Cpd-1) Color Image Stabilizer:
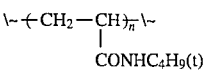
(Cpd-2) Color Image Stabilizer:
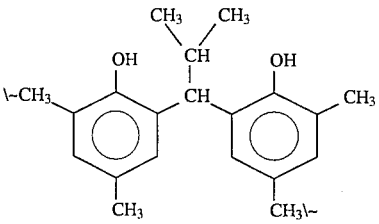
(Cpd-3) Color Image Stabilizer:
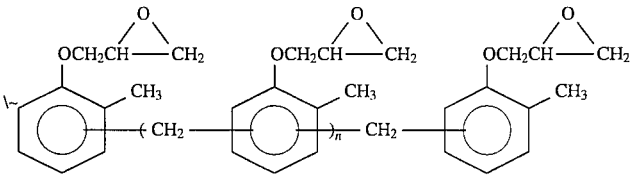
n = 7 to 8 (as a mean value)

-continued
(Cpd-4) Color Mixing Preventing Agent:
1/1/1 (by weight) mixture of the following:
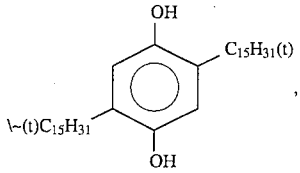
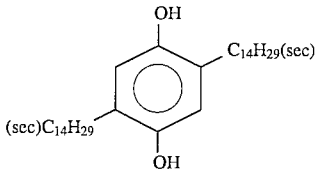
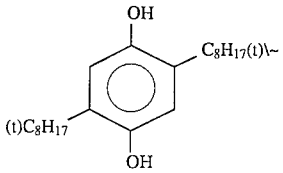
(Cpd-5) Color Image Stabilizer:
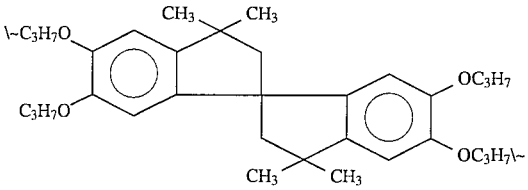
(Cpd-6) Color Image Stabilizer:
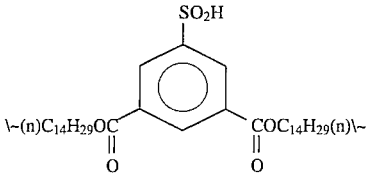
(Cpd-7) Color Image Stabilizer:
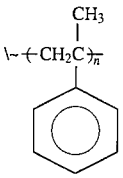
number average molecular weight: 600\~
(Cpd-8) Color Image Stabilizer:
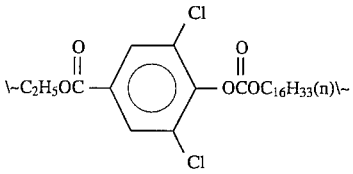
(Cpd-9) Color Image Stabilizer:
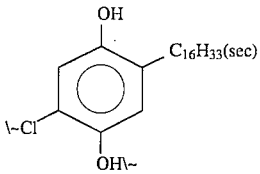

-continued
(Cpd-10) Color Image Stabilizer:
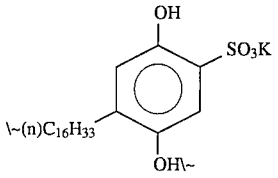
(Cpd-11) Additive
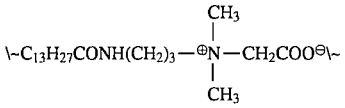
(Cpd-12) Antiseptic:
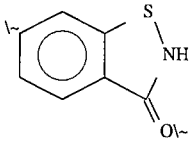
(Cpd-13) Antiseptic:
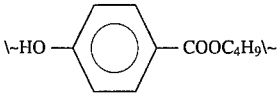
(UV-1) Ultraviolet Absorbent:
1/3/1/3 (by weight) mixture comprising the following:
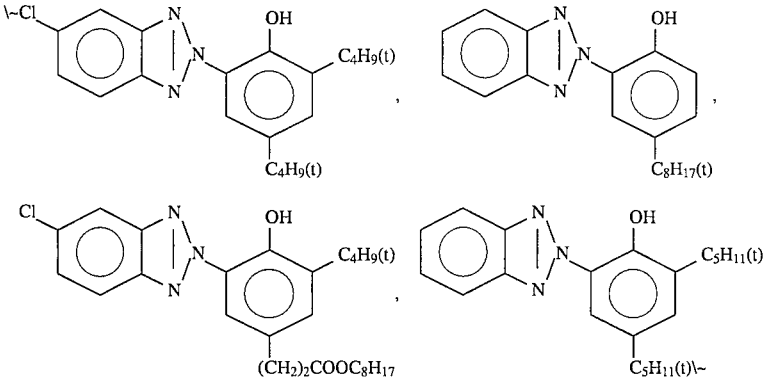
(UV-2) Ultraviolet Absorbent:
2/3/4 (by weight) mixture comprising the following:
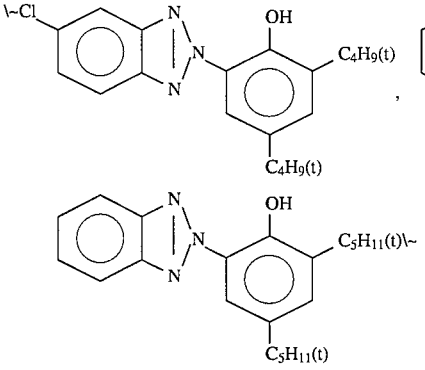

-continued (Solv-1) Solvent:

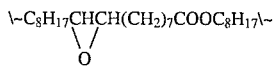

(Solv-2) Solvent:

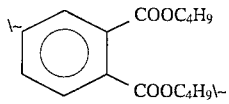

(Solv-3) Solvent:

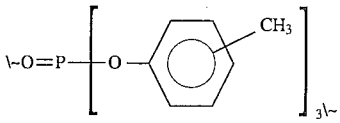

(Solv-4) Solvent:

(Solv-5) Solvent:

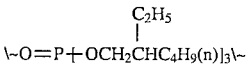

(Solv-6) Solvent:

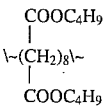

(Solv-7) Solvent:

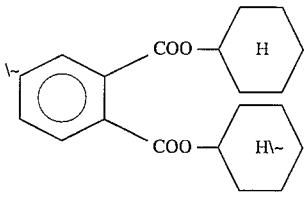

(Solv-8) Solvent:

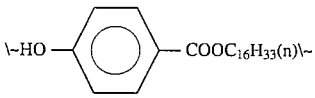

(Solv-9) Solvent:

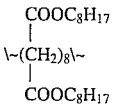

Samples Nos. 202 to 231 were prepared in the same manner as in preparation of Sample No. 101, except that the yellow coupler in the first layer (blue-sensitive layer) was replaced by the same molar amount of the coupler shown in Table 2 below and that the compound(s) shown in the same table was/were added to the first layer in an amount of 25 mol % per mol of the coupler. The polymer used herein had a number average molecular weight of about 60,000.

TABLE 2

| Sample No. | Yellow Coupler | Color Image Stabilizer (IV) | Color Image Stabilizer (V) | Polymer | Color Image Stabilizer (VI) | Color Reproducibility | Dmax | Percentage of Color Retention (%) D0 = 1.5 | D0 = 0.5 | Remarks |
|---|---|---|---|---|---|---|---|---|---|---|
| 201 | ExY2 | — | — | — | — | X | 2.03 | 73 | 74 | comparative sample |
| 202 | ExY2 | A-3 | — | — | — | X | 2.06 | 89 | 82 | comparative sample |
| 203 | ExY2 | — | B-10 | — | — | X | 2.05 | 76 | 76 | comparative sample |
| 204 | ExY2 | A-3 | B-10 | — | — | X | 2.04 | 95 | 95 | comparative sample |
| 205 | ExY2 | A-3 | B-10 | P-68 | — | X | 2.04 | 97 | 96 | comparative sample |
| 206 | ExY2 | A-3 | B-10 | — | C-31 | X | 2.06 | 96 | 97 | comparative sample |
| 207 | Y2-34 | — | — | — | — | ◎ | 2.52 | 72 | 72 | comparative sample |
| 208 | Y2-34 | A-3 | — | — | — | ◎ | 2.53 | 89 | 81 | comparative sample |
| 209 | Y2-34 | A-16 | — | — | — | ◎ | 2.53 | 88 | 80 | comparative sample |
| 210 | Y2-34 | A-12 | — | — | — | ◎ | 2.52 | 85 | 77 | comparative sample |
| 211 | Y2-34 | A-36 | — | — | — | ◎ | 2.54 | 84 | 76 | comparative sample |
| 212 | Y2-34 | A-38 | — | — | — | ◎ | 2.52 | 85 | 76 | comparative sample |
| 213 | Y2-34 | A-42 | — | — | — | ◎ | 2.52 | 84 | 76 | comparative sample |
| 214 | Y2-34 | — | B-10 | — | — | ◎ | 2.52 | 74 | 74 | comparative sample |
| 215 | Y2-34 | — | B-14 | — | — | ◎ | 2.53 | 75 | 74 | comparative sample |
| 216 | Y2-34 | — | B-18 | — | — | ◎ | 2.53 | 74 | 74 | comparative sample |
| 217 | Y2-34 | — | B-25 | — | — | ◎ | 2.53 | 75 | 75 | comparative sample |
| 218 | Y2-34 | A-3 | B-10 | — | — | ◎ | 2.53 | 95 | 95 | sample of the invention |
| 219 | Y2-34 | A-16 | B-10 | — | — | ◎ | 2.53 | 95 | 94 | sample of the invention |
| 220 | Y2-34 | A-12 | B-14 | — | — | ◎ | 2.54 | 93 | 94 | sample of the invention |
| 221 | Y2-34 | A-36 | B-18 | — | — | ◎ | 2.53 | 92 | 92 | sample of the invention |
| 222 | Y2-34 | A-38 | B-18 | — | — | ◎ | 2.54 | 92 | 93 | sample of the invention |
| 223 | Y2-34 | A-42 | B-25 | — | — | ◎ | 2.54 | 92 | 94 | sample of the invention |
| 224 | Y2-34 | A-3 | B-10 | P-68 | — | ◎ | 2.53 | 97 | 96 | sample of the invention |
| 225 | Y2-34 | A-3 | B-16 | P-1 | — | ◎ | 2.53 | 96 | 95 | sample of the invention |
| 226 | Y2-34 | A-16 | B-18 | P-26 | — | ◎ | 2.53 | 96 | 95 | sample of the invention |
| 227 | Y2-34 | A-12 | B-18 | P-43 | — | ◎ | 2.54 | 95 | 94 | sample of the invention |
| 228 | Y2-34 | A-36 | B-14 | — | C-31 | ◎ | 2.54 | 95 | 95 | sample of the invention |
| 229 | Y2-34 | A-38 | B-14 | — | C-32 | ◎ | 2.54 | 95 | 95 | sample of the invention |
| 230 | Y2-34 | A-42 | B-10 | — | C-25 | ◎ | 2.53 | 95 | 95 | sample of the invention |
| 231 | Y2-34 | A-42 | B-10 | — | C-22 | ◎ | 2.53 | 95 | 95 | sample of the invention |

As has been explained in detail hereinabove, the silver halide color photographic material of the present invention, containing at least one particular acylamide-type yellow coupler in at least one light-sensitive layer therein along with a particular bisphenolic image stabilizer and a particular spirocyclic or bicyclic image stabilizer, has excellent coloring properties and excellent color reproducibility and forms thereon color images having high fastness to light all from the high-density areas to the low-density areas.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having at least one or more light-sensitive silver halide emulsion layers on a support, wherein at least one of said light-sensitive layers contains at least one yellow coupler of the following formulae (I), (II) and (III), at least one compound of the following formula (IV) and at least one compound of the following formula (V):

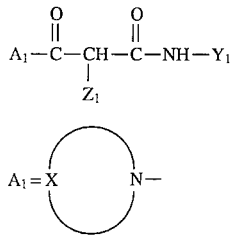

(I)

wherein

X represents an organic residue necessary for forming a nitrogen-containing hetero ring together with the nitrogen atom in the formula;

$Y_1$ represents an aromatic group or a heterocyclic group;

$Z_1$ represents a group splitting off from the coupler of the formula by coupling reaction with an oxidation product of an aromatic primary amine developing agent,

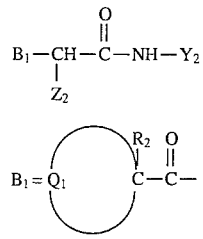

(II)

wherein $R_2$ represents a monovalent group except a hydrogen atom;

$Q_1$ represents a non-metallic atomic group necessary for forming, together with the carbon atom in the formula, a 3-membered to 5-membered hydrocarbon ring or a 3-membered to 6-membered hereto ring having therein at least one hetero atom selected from N, O, S and P; provided that $R_2$ may be bonded to $Q_1$ to form a bi-cyclic ring or a higher poly-cyclic ring;

$Z_2$ represents a hydrogen atom, or a group splitting off from the coupler of the formula by coupling reaction with an oxidation product of an aromatic primary amine developing agent;

$Y_2$ has the same meaning as $Y_1$ in formula (I),

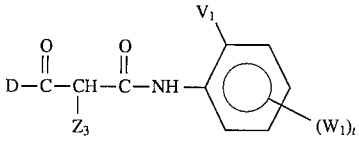

(III)

wherein

D represents a tertiary alkyl group;

$V_1$ represents a fluorine atom, an alkoxy group, an aryloxy group, a dialkylamino group, an alkylthio group, an arylthio group, or an alkyl group;

$Z_3$ has the same meaning as $Z_1$ in formula (I);

$W_1$ represents a group substitutable on the benzene ring in the formula;

t represents an integer of from 0 to 4, and when t is 2 or more, then the plural $W_1$'s may be the same or different,

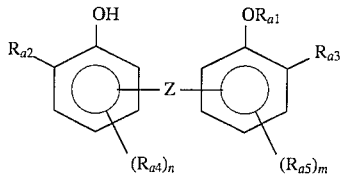

(IV)

wherein $R_{a1}$ represents a hydrogen atom, an aliphatic group, an aromatic carbonyl group, a saturated aliphatic carbonyl group, or a sulfonyl group;

$R_{a2}$ and $R_{a3}$ may be the same or different and each represents a hydrogen atom, an aliphatic group, an aliphatic-oxy group, an acylamino group, an aliphatic-oxycarbonyl group, or a carbamoyl group;

$R_{a4}$ and $R_{a5}$ may be the same or different and each represents an aliphatic group or an acylamino group;

Z represents a chemical bond or a divalent linking group;

n and m each represent 0, 1 or 2, and when n or m is 2, then the plural $R_{a4}$'s or $R_{a5}$'s may be the same or different,

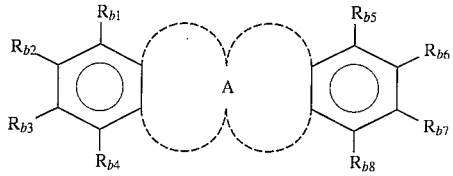

(V)

wherein $R_{b1}$, $R_{b2}$, $R_{b3}$, $R_{b4}$, $R_{b5}$, $R_{b6}$, $R_{b7}$ and $R_{b8}$ may be the same or different and each represents a hydrogen atom, an aliphatic group, an acyl group, an acylamino group, an aliphatic-oxycarbonyl group, an aryloxycarbonyl group, a halogen atom, a sulfonyl group, a carbamoyl group, a sulfamoyl group, or $—X_b—R_{b9}$;

A represents a non-metallic atomic group necessary for forming a spiro ring or a bicyclic ring;

$X_b$ represents —O—, —S— or $—N(R_{b10})—$;

$R_{b9}$ and $R_{b10}$ may be the same or different and each represents an aliphatic group; ortho-positioned two groups of $R_{b1}$ to $R_{b8}$ may be bonded to each other to form a 5-membered to 8-membered ring;

$R_{b9}$ and $R_{b10}$ may be bonded each other to form a 5-membered to 7-membered ring;

provided that at least one of $R_{b1}$ to $R_{b4}$ and at least one of $R_{b5}$ to $R_{b8}$ are the same or different $—X_b—R_{b9}$.

2. The silver halide color photographic material as claimed in claim 1, wherein yellow coupler of formula (I) is that of formula (I-A):

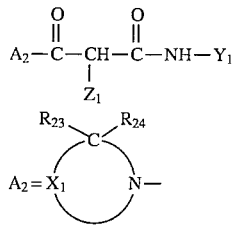

(I-A)

wherein $Y_1$ and $Z_1$ have the same meanings as those in formula (I);

$X_1$ represents an organic residue necessary for forming a nitrogen-containing hetero ring along with $>C(R_{23})(R_{24})$ and $>N—$ in the formula;

$R_{23}$ and $R_{24}$ each represent a hydrogen atom or a substituent.

3. The silver halide color photographic material as claimed in claim 1, in which yellow coupler of formula (I) is that of formula (I-B):

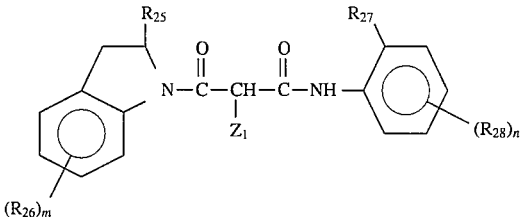

(I-B)

wherein $R_{25}$ represents a hydrogen atom or a substituent;

$R_{26}$, $R_{27}$ and $R_{28}$ each represent a substituent;

$Z_1$ has the same meaning as that in formula (I);

m and n each represent an integer of from 0 to 4, and when m and n each are an integer of 2 or more, plural $R_{26}$'s and $R_{27}$'s each may be the same or different or may be bonded to each other to form ring(s).

4. The silver halide color photographic material as claimed in claim 1, in which yellow couplers of formula (II) are those of formula (II-A):

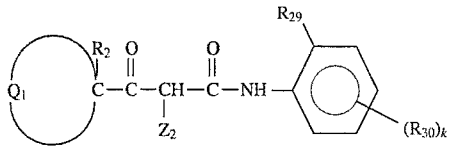

(II-A)

wherein $R_2$ represents a monovalent substituent except a hydrogen atom;

$Q_1$ represents a non-metallic atomic group necessary for forming, along with the carbon atom in the formula, a 3-membered to 5-membered hydrocarbon ring or a 3-membered to 6-membered hetero ring having therein at least one hetero atom selected from N, S, O and P;

$R_{29}$ represents a hydrogen atom, a halogen atom, an alkoxy group, an aryloxy group, an alkylthio group, an arylthio group, an alkyl group, or an amino group;

$R_{30}$ represents a group substitutable on the benzene ring of the formula;

$Z_2$ represents a hydrogen atom, or a group which may split off from the coupler by coupling reaction with an oxidation product of an aromatic primary amine developing agent;

k represents an integer of from 0 to 4; provided that when k is a plural number, plural $R_{30}$'s may be the same or different;

$R_2$ may be bonded to $Q_1$ to form a bi-cyclic or poly-cyclic ring.

5. The silver halide color photographic material as claimed in claim 1, wherein compounds of formula (IV) are those of formula (A-I):

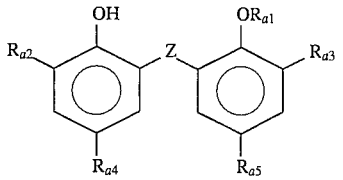

(A-I)

wherein $R_{a1}$, $R_{a2}$, $R_{a3}$, $R_{a4}$, $R_{a5}$ and Z have the same meanings as those in formula (IV).

6. The silver halide color photographic material as claimed in claim 1, wherein compounds of formula (V) are those of formulae (B-I) to (B-V):

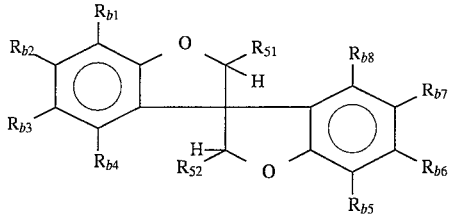

(B-I)

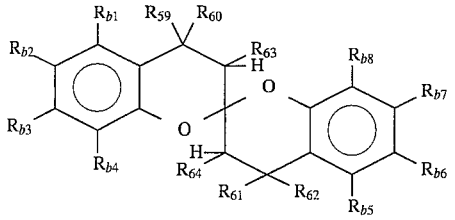

(B-II)

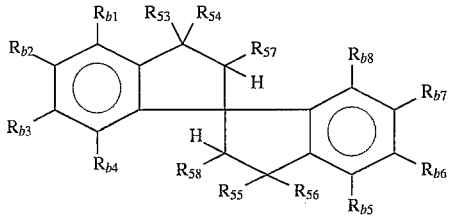

(B-III)

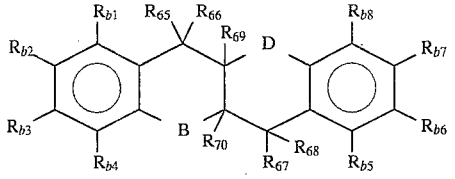

(B-IV)

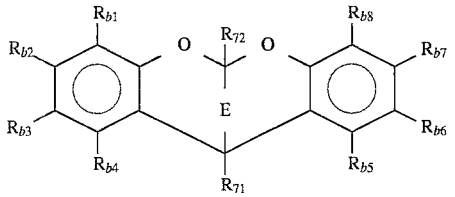

(B-V)

wherein $R_{b1}$ to $R_{b10}$ and $X_b$ have the same meanings as those in formula (V);

$R_{51}$ to $R_{72}$ may be the same or different and each represents a hydrogen atom, an alkyl group, or an aryl group;

B and D each represent a single bond, $—C(R_{80})(R_{81})—$ or —O—;

E represents a single bond or $—C(R_{80})(R_{81})—$;

$R_{80}$ and $R_{81}$ may be the same or different and each represents a hydrogen atom, an alkyl group, or an aryl group.

7. The silver halide color photographic material as claimed in claim 1, which contains, in the yellow coupler-containing light-sensitive layer, a water-insoluble homopolymer or copolymer or at least one compound of the following general formula (VI):

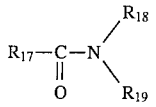

(VI)

wherein $R_{17}$, $R_{18}$ and $R_{19}$ each independently represent an alkyl group or an aryl group; and when $R_{18}$ and $R_{19}$ are both alkyl groups, they may be bonded to each other to form a 5-membered to 7-membered ring; and either one of $R_{18}$ and $R_{19}$ may be a hydrogen atom.

8. The silver halide color photographic material as claimed in claim 7, wherein the water-insoluble homopolymer or copolymer is selected from water-insoluble vinyl homopolymers or copolymers and polyester homopolymers or copolymers each having —(C═O)— bonds in the repeating units.

9. The silver halide color photographic material as claimed in claim 7, wherein compounds of formula (VI) are those of formula (VI-A):

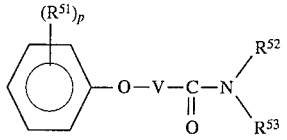

(VI-A)

wherein $R^{51}$ represents a halogen atom, an alkyl group having from 1 to 24 carbon atoms, or an alkoxy group having from 1 to 24 carbon atoms;

$R^{52}$ and $R^{53}$ each independently represent a hydrogen atom, or an alkyl group having from 1 to 24 carbon atoms;

V represents an alkylene group having from 1 to 24 carbon atoms;

p represents an integer of from 1 to 3, provided that when p is a plural number, plural $R_{51}$'s may be the same or different;

$R^{52}$ and $R^{53}$ may be bonded to each other to form a 5-membered to 7-membered ring, which may have therein at least one or more hetero atoms of O, S, N and P.

10. The silver halide color photographic material as claimed in claim 1, wherein the yellow coupler of formula (I), (II), or (III) is used in an amount of from 0.01 to 10 mmol/$m^2$.

11. The silver halide color photographic material as claimed in claim 1, wherein the compound of formula (IV) is used in an amount of from 0.5 to 300 mol % relative to one mol of the coupler(s) of formulae (I), (II) and (III).

12. The silver halide color photographic material as claimed in claim 1, wherein the compound of formula (V) is used in an amount of from 0.5 to 300 mol % relative to one mol of the coupler(s) of formulae (I), (II) and (III).

13. The silver halide color photographic material as claimed in claim 1, wherein the compound of formula (IV) to the compound of formula (V) are used in a ratio of 0.5/1 to 2/1 by mol.

14. The silver halide color photographic material as claimed in claim 1, wherein the water-insoluble polymer is used in an amount of from 0.01/1 to 2.0/1 as the ratio by weight to the coupler(s) of formula (I), (II) and (III).

15. The silver halide color photographic material as claimed in claim 1, wherein the silver halide emulsion layer contains silver halide grains comprising silver chloride, silver chlorobromide or silver chloroiodobromide grains having a silver chloride content of 95 mol % or more.

* * * * *